US008352258B2

(12) United States Patent
Yamanashi et al.

(10) Patent No.: US 8,352,258 B2
(45) Date of Patent: Jan. 8, 2013

(54) ENCODING DEVICE, DECODING DEVICE, AND METHODS THEREOF BASED ON SUBBANDS COMMON TO PAST AND CURRENT FRAMES

(75) Inventors: Tomofumi Yamanashi, Kanagawa (JP); Masahiro Oshikiri, Kanagawa (JP)

(73) Assignee: Panasonic Corporation, Osaka (JP)

( * ) Notice: Subject to any disclaimer, the term of this patent is extended or adjusted under 35 U.S.C. 154(b) by 887 days.

(21) Appl. No.: 12/517,956

(22) PCT Filed: Dec. 12, 2007

(86) PCT No.: PCT/JP2007/073966
§ 371 (c)(1),
(2), (4) Date: Jun. 5, 2009

(87) PCT Pub. No.: WO2008/072670
PCT Pub. Date: Jun. 19, 2008

(65) Prior Publication Data

US 2010/0169081 A1 Jul. 1, 2010

(30) Foreign Application Priority Data

Dec. 13, 2006 (JP) ..... 2006-336270
Mar. 2, 2007 (JP) ..... 2007-053499
May 17, 2007 (JP) ..... 2007-132078
Jul. 13, 2007 (JP) ..... 2007-185078

(51) Int. Cl.
*G10L 21/00* (2006.01)

(52) U.S. Cl. ..... 704/230

(58) Field of Classification Search ..... 704/230, 704/500–504
See application file for complete search history.

(56) References Cited

U.S. PATENT DOCUMENTS 5,222,189 A * 6/1993 Fielder ..... 704/229
5,684,920 A * 11/1997 Iwakami et al. ..... 704/203
5,819,212 A 10/1998 Matsumoto et al.
6,370,502 B1 * 4/2002 Wu et al. ..... 704/230
(Continued)

FOREIGN PATENT DOCUMENTS

JP 8-211900 8/1996
(Continued)

OTHER PUBLICATIONS

Salavedra J M et al., "APVQ encoder applied to wideband speech coding", Spoken Language, 1996, ICLSP 96, Proceedings, Fourth International Conference on Philadelphia, PA, USA Oct. 3-6, 1996, New York, NY, IEEE, US, vol. 2, pp. 941-944.
(Continued)

*Primary Examiner* — Michael N Opsasnick
(74) *Attorney, Agent, or Firm* — Greenblum & Bernstein, P.L.C.

(57) ABSTRACT

An encoding device includes: a frequency region converter which converts an inputted audio signal into a frequency region; a band selector which selects a quantization object band from a plurality of sub bands obtained by dividing the frequency region; and a shape quantizer which quantizes the shape of the frequency region parameter of the quantization object band. When a prediction encoding presence/absence determiner determines that the number of common sub bands between the quantization object band and the quantization object band selected in the past is not smaller than a predetermined value, a gain quantizer performs prediction encoding on the gain of the frequency region parameter of the quantization object band. When the number of common sub bands is smaller than the predetermined value, the gain quantizer non-predictively encodes the gain of the frequency region parameter of the quantization object band.

20 Claims, 29 Drawing Sheets

U.S. PATENT DOCUMENTS

| | | | | |
|---|---|---|---|---|
| 6,704,706 | B2 * | 3/2004 | Wu et al. | 704/230 |
| 7,460,990 | B2 * | 12/2008 | Mehrotra et al. | 704/206 |
| 7,885,809 | B2 * | 2/2011 | Ramprashad | 704/222 |
| 7,957,958 | B2 * | 6/2011 | Sato | 704/207 |
| 2001/0027391 | A1 | 10/2001 | Yasunaga et al. | |
| 2002/0176353 | A1 * | 11/2002 | Atlas et al. | 370/203 |
| 2003/0093271 | A1 | 5/2003 | Tsushima et al. | |
| 2005/0165611 | A1 * | 7/2005 | Mehrotra et al. | 704/500 |
| 2007/0016427 | A1 * | 1/2007 | Thumpudi et al. | 704/500 |
| 2009/0055172 | A1 | 2/2009 | Yoshida | |
| 2009/0070107 | A1 | 3/2009 | Kawashima et al. | |
| 2009/0076809 | A1 | 3/2009 | Yoshida | |
| 2009/0083041 | A1 | 3/2009 | Yoshida | |
| 2009/0119111 | A1 | 5/2009 | Goto et al. | |

FOREIGN PATENT DOCUMENTS

| | | |
|---|---|---|
| JP | 9-127987 | 5/1997 |
| JP | 10-1431198 | 5/1998 |
| JP | 2006-293405 | 10/2006 |

OTHER PUBLICATIONS

Supplementary European Search Report from E.P.O. in corresponding EP 0512, mail date is Feb. 10, 2011.

Oshikiri et al., "A Scalable coder designed for 10-kHz Bandwidth speech", 2002 IEEE Speech Coding Workshop. Proceedings, pp. 111-113.

Oshikiri et al., "A 10 kHz bandwidth scalable codec using adaptive selection VQ of time-frequency coefficients", Forum on Information Technology, vol. FIT 2003, No., pp. 239-240, vol. 2, Aug. 25, 2003, along with an English language translation thereof.

Oshikiri et al., "Efficient Spectrum Coding for Super-Wideband Speech and Its Application to 7/10/15KHZ Bandwidth Scalable Coders", Proc IEEE Int Conf Acoust Speech Signal Process, vol. 2004, No. vol. 1, pp. I.481-I484, 2004.

Oshikiri et al., "A 7/10/15kHz Bandwidth scalable coder using pitch filtering based spectrum coding", The Acoustical Society of Japan, Research Committee Meeting, lecture thesis collection, vol. 2004, No., pp. 327-328 Spring 1, Mar. 17, 2004, along with an English language translation thereof.

Oshikiri et al., "Improvement of the super-wideband scalable coder using pitch filtering based spectrum coding", The Acoustical Society of Japan, Research Committee Meeting, lecture thesis collection, vol. 2004, No., pp. 297-298 Autumn 1, Sep. 21, 2004, along with an English language translation thereof.

Oshikiri et al., "Study on a low-delay MDCT analysis window for a scalable speech coder", The Acoustical Society of Japan, Research Committee Meeting, lecture thesis collection, vol. 2005, No., pp. 203-204 Spring 1, Mar. 8, 2005, along with an English language translation thereof.

Oshikiri et al., "A 7/10/15kHz Bandwidth Scalable Speeds Coder Using Pitch Filtering Based Spectrum Coding", IEICE D, vol. J89-D, No. 2, pp. 281-291, Feb. 1, 2006, along with an English language translation thereof.

S.A. Ramprashad, "A two stage hybrid embedded speech/audio coding structure", Proc. IEEE ICASSP '98, pp. 337-340, May 1998.

B. Kovesi et al., "A scalable speech and audio coding scheme with continuous bitrate flexibility", Proc. IEEE ICASSP 2004, pp. I-273-I-276, May 2004.

J.Sung-Kyo et al., "A bit-rate/bandwidth scalable speech coder based on ITU-T G. 723. 1 standard", Proc. IEEE ICASSP 2004, pp. I-285-I-288, May 2004.

M. Dietz et al., "Spectral band replication, a novel approach in audio coding", The 112$^{th}$ Audio Engineering Society Convention, Paper 5553, May 2002.

Oshikiri, "Research on variable bit rate high efficiency speech coding focused on speech spectrum", Doctoral thesis, Tokai University, Mar. 24, 2006, along with an English language translation thereof.

Jin, A et al., "Scalable Audio Coding Based on Hierarchical Transform Coding Modules", IEICE vol. J83-A, No. 3, pp. 241-252, Mar. 2000, along with an English language translation thereof.

B. Grill, "A bit rate scalable perceptual coder for MPEG-4 audio", The 103$^{rd}$ Audio Engineering Society Convention, Preprint 4620, Sep. 1997.

Oshikiri et al., "A narrowband/wideband scalable speech coder using AMR coder as a core-layer", The Acoustical Society of Japan, Research Committee Meeting, lecture thesis collection (CD-ROM), vol. 2006, No., pp. 1-Q-28 Spring, Mar. 7, 2006, along with an English language translation thereof.

K-T. Kim et al., "A new bandwidth scalable wideband speech/audio coder", Proceedings of IEEE International Conference on Acoustics, Speech and Signal Proceeding 2002 (ICASSP-2002), pp. I-657-I-660.

B. Geiser et al., "A qualified ITU-T G. 729EV codec candidate for hierarchical speech and audio coding", Proceeding of IEEE 8$^{th}$ Workshop on Multimedia Signal Proceeding, pp. 114-118 (Oct. 3, 2006).

S, Ragot et al., "A 8-32 kbit/s scalable wideband speech and audio coding candidate for ITU-T G729EV standardization", Proceeding of IEEE international Conference on Acoustics Speech and Signal Processing 2006 (ICASSP-2006), pp. I-1-I-4 (May 14, 2006).

ITU-T, "G. 729 based embedded rariable bit-rate coder: an 8-32 kbit/s scalable wideband coder bit-stream interoperable with G. 729", ITU-T Recommendation G. 729.1 (2006).

S. Ragot et al., "ITU-T G. 729.1: an 8-32 kbit/s scalable coder intercoperable with G. 729 for wideband delephony and voice over IP", Proceedings of IEEE international Conference on Acoustics, Speech, and Signal Processing 2007 (ICASSP 2007), pp. IV-529-IV-532 (Apr. 15, 2007).

English language Abstract of JP 9-127987, May 16, 1997.

English language Abstract of JP 2006-293405, Oct. 26, 2006.

English language Abstract of JP 10-1431198, May 29, 1998.

English language Abstract of JP 8-211900, Aug. 20, 1996.

Eriksson et al., "Exploiting Interframe Correlation in Spectral Quantization", "Acoustics, Speech, and Signal Processing", 1996, ICASSP-96, Conference Proceedings, May 7-10, 1996, pp. 765-768, vol. 2.

* cited by examiner

ENCODING DEVICE, DECODING DEVICE, AND METHODS THEREOF BASED ON SUBBANDS COMMON TO PAST AND CURRENT FRAMES

TECHNICAL FIELD

The present invention relates to an encoding apparatus/decoding apparatus and encoding method/decoding method used in a communication system in which a signal is encoded and transmitted, and received and decoded.

BACKGROUND ART

When a speech/audio signal is transmitted in a mobile communication system or a packet communication system typified by Internet communication, compression/encoding technology is often used in order to increase speech/audio signal transmission efficiency. Also, in recent years, a scalable encoding/decoding method has been developed that enables a good-quality decoded signal to be obtained from part of encoded information even if a transmission error occurs during transmission.

One above-described compression/encoding technology is a time-domain predictive encoding technology that increases compress ion efficiency by using the temporal correlation of a speech signal and/or audio signal (hereinafter referred to as "speech/audio signal"). For example, in Patent Document 1, a current-frame signal is predicted from a past-frame signal, and the predictive encoding method is switched according to the prediction error. Also, in Non-patent Document 1, a technology is described whereby a predictive encoding method is switched according to the degree of change in the time domain of a speech parameter such as LSF (Line Spectral Frequency) and the frame error occurrence state.

Patent Document 1: Japanese Patent Application Laid-Open No. HEI 8-211900

Non-patent Document 1: Thomas Eriksson, Jan Linden, and Jan Skoglund, "Exploiting Inter-frame Correlation In Spectral Quantization," "Acoustics, Speech, and Signal Processing," 1996. ICASSP-96. Conference Proceedings, 7-10 May 1996 Page(s): 765-768 vol. 2

DISCLOSURE OF INVENTION

Problems to be Solved by the Invention

However, with any of the above technologies, predictive encoding is performed based on a time domain parameter on a frame-by-frame basis, and predictive encoding based on a non-time domain parameter such as a frequency domain parameter is not mentioned. If a predictive encoding method based on a time domain parameter such as described above is simply applied to frequency domain parameter encoding, there is no problem if a quantization target band is the same in a past frame and current frame, but if the quantization target band is different in a past frame and current frame, encoding error and decoded signal audio quality degradation increases greatly, and a speech/audio signal may not be able to be decoded.

It is an object of the present invention to provide an encoding apparatus and so forth capable of reducing the encoded information amount of a speech/audio signal, and also capable of reducing speech/audio signal encoding error and decoded signal audio quality degradation, when a frequency component of a different band is made a quantization target in each frame.

Means for Solving the Problems

An encoding apparatus of the present invention employs a configuration having: a transform section that transforms an input signal to the frequency domain to obtain a frequency domain parameter; a selection section that selects a quantization target band from among a plurality of subbands obtained by dividing the frequency domain, and generates band information indicating the quantization target band; a shape quantization section that quantizes the shape of the frequency domain parameter in the quantization target band; and a gain quantization section that encodes gain of a frequency domain parameter in the quantization target band to obtain gain encoded information.

A decoding apparatus of the present invention employs a configuration having: a receiving section that receives information indicating a quantization target band selected from among a plurality of subbands obtained by dividing a frequency domain of an input signal; a shape dequantization section that decodes shape encoded information in which the shape of a frequency domain parameter in the quantization target band is quantized, to generate a decoded shape; a gain dequantization section that decodes gain encoded information in which gain of a frequency domain parameter in the quantization target band is encoded, to generate decoded gain, and decodes a frequency parameter using the decoded shape and the decoded gain to generate a decoded frequency domain parameter; and a time domain transform section that transforms the decoded frequency domain parameter to the time domain to obtain a time domain decoded signal.

An encoding method of the present invention has: a step of transforming an input signal to the frequency domain to obtain a frequency domain parameter; a step of selecting a quantization target band from among a plurality of subbands obtained by dividing the frequency domain, and generating band information indicating the quantization target band; and a step of quantizing the shape of the frequency domain parameter in the quantization target band to obtain shape encoded information; and encoding gain of a frequency domain parameter in the quantization target band, to obtain gain encoded information.

A decoding method of the present invention has: a step of receiving information indicating a quantization target band selected from among a plurality of subbands obtained by dividing a frequency domain of an input signal; a step of decoding shape encoded information in which the shape of a frequency domain parameter in the quantization target band is quantized, to generate a decoded shape; a step of decoding gain encoded information in which gain of a frequency domain parameter in the quantization target band is quantized, to generate decoded gain, and decoding a frequency domain parameter using the decoded shape and the decoded gain to generate a decoded frequency domain parameter; and a step of transforming the decoded frequency domain parameter to the time domain to obtain a time domain decoded signal.

Advantageous Effect of the Invention

The present invention reduces the encoded information amount of a speech/audio signal or the like, and also can prevent sharp quality degradation of a decoded signal, decoded speech, and so forth, and can reduce encoding error of a speech/audio signal or the like and decoded signal quality degradation.

BEST MODE FOR CARRYING OUT THE INVENTION

As an overview of an example of the present invention, in quantization of a frequency component of a different band in each frame, if the number of subbands common to a past-frame quantization target band and current-frame quantization target band is determined to be greater than or equal to a predetermined value, predictive encoding is performed on a frequency domain parameter, and if the number of common subbands is determined to be less than the predetermined value, a frequency domain parameter is encoded directly. By this means, the encoded information amount of a speech/audio signal or the like is reduced, and also sharp quality degradation of a decoded signal, decoded speech, and so forth, can be prevented, and encoding error of a speech/audio signal or the like and decoded signal quality degradation—and decoded speech audio quality degradation, in particular—can be reduced.

Embodiments of the present invention will now be described in detail with reference to the accompanying drawings. In the following descriptions, a speech encoding apparatus and speech decoding apparatus are used as examples of an encoding apparatus and decoding apparatus of the present invention.

(Embodiment 1)

Figure 1:
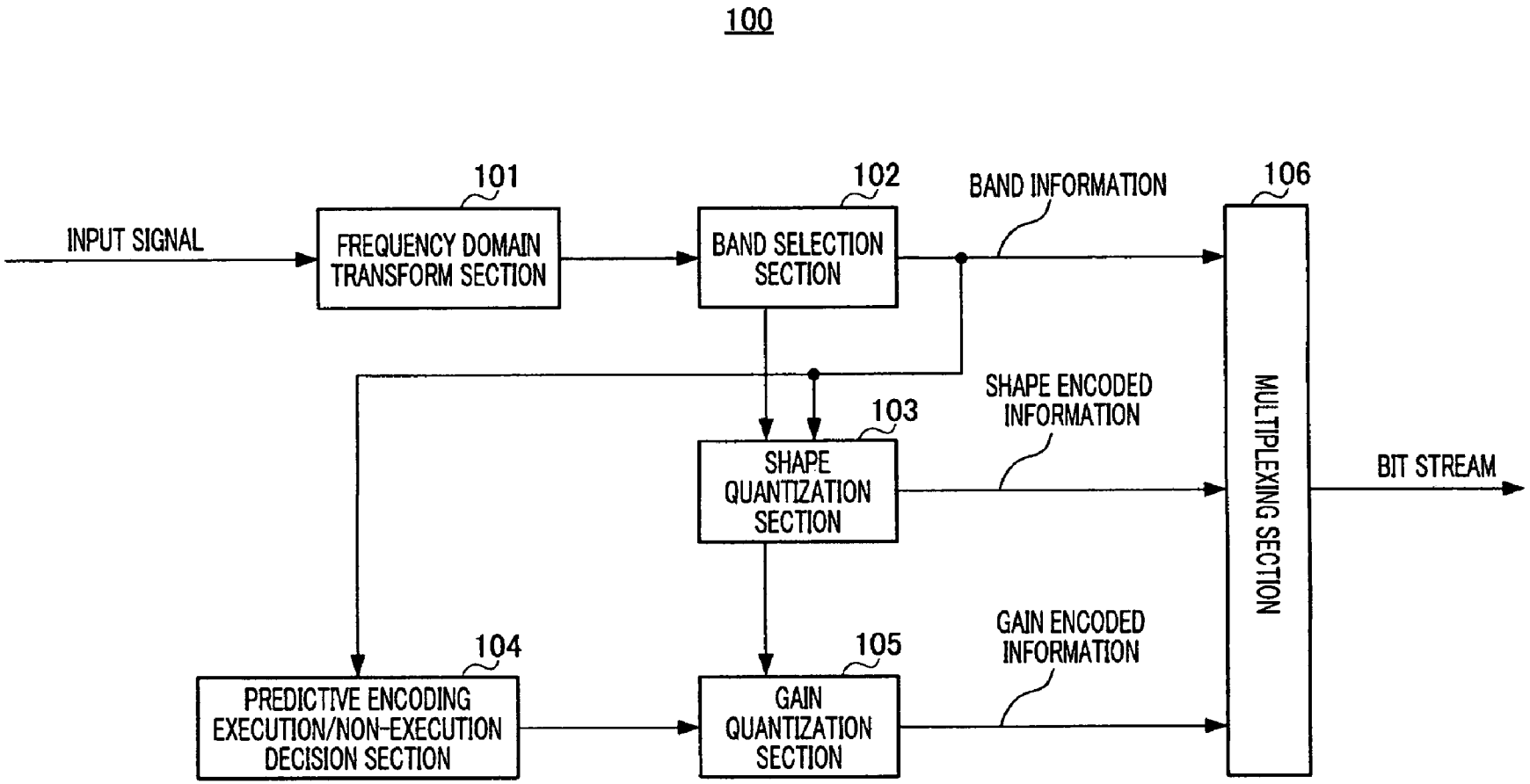
FIG. 1 is a block diagram showing the main configuration of a speech encoding apparatus according to Embodiment 1 of the present invention.

FIG. 1 is a block diagram showing the main configuration of speech encoding apparatus 100 according to Embodiment 1 of the present invention.

In this figure, speech encoding apparatus 100 is equipped with frequency domain transform section 101, band selection section 102, shape quantization section 103, predictive encoding execution/non-execution decision section 104, gain quantization section 105, and multiplexing section 106.

Frequency domain transform section 101 performs a Modified Discrete Cosine Transform (MDCT) using an input signal, to calculate an MDCT coefficient, which is a frequency domain parameter, and outputs this to band selection section 102.

Band selection section 102 divides the MDCT coefficient input from frequency domain transform section 101 into a plurality of subbands, selects a band as a quantization target band from the plurality of subbands, and outputs band information indicating the selected band to shape quantization section 103, predictive encoding execution/non-execution decision section 104, and multiplexing section 106. In addition, band selection section 102 outputs the MDCT coefficient to shape quantization section 103. MDCT coefficient input to shape quantization section 103 may also be performed directly from frequency domain transform section 101 separately from input from frequency domain transform section 101 to band selection section 102.

Shape quantization section 103 performs shape quantization using an MDCT coefficient corresponding to a band indicated by band information input from band selection section 102 from among MDCT coefficients input from band selection section 102, and outputs obtained shape encoded information to multiplexing section 106. In addition, shape quantization section 103 finds a shape quantization ideal gain value, and outputs the obtained ideal gain value to gain quantization section 105.

Predictive encoding execution/non-execution decision section 104 finds a number of subbands common to a current-frame quantization target band and a past-frame quantization target band using the band information input from band selection section 102. Then predictive encoding execution/non-execution decision section 104 determines that predictive encoding is to be performed on the MDCT coefficient of the quantization target band indicated by the band information if the number of common subbands is greater than or equal to a predetermined value, or determines that predictive encoding is not to be performed on the MDCT coefficient of the quantization target band indicated by the band information if the number of common subbands is less than the predetermined value. Predictive encoding execution/non-execution decision section 104 outputs the result of this determination to gain quantization section 105.

If the determination result input from predictive encoding execution/non-execution decision section 104 indicates that predictive encoding is to be performed, gain quantization section 105 performs predictive encoding of current-frame quantization target band gain using a past-frame quantization gain value stored in an internal buffer and an internal gain codebook, to obtain gain encoded information. On the other hand, if the determination result input from predictive encoding execution/non-execution decision section 104 indicates that predictive encoding is not to be performed, gain quantization section 105 obtains gain encoded information by directly quantizing the ideal gain value input from shape quantization section 103. Gain quantization section 105 outputs the obtained gain encoded information to multiplexing section 106.

Multiplexing section 106 multiplexes band information input from band selection section 102, shape encoded information input from shape quantization section 103, and gain encoded information input from gain quantization section 105, and transmits the obtained bit stream to a speech decoding apparatus.

Speech encoding apparatus 100 having a configuration such as described above separates an input signal into sections of N samples (where N is a natural number), and performs encoding on a frame-by-frame basis with N samples as one frame. The operation of each section of speech encoding apparatus 100 is described in detail below. In the following description, an input signal of a frame that is an encoding target is represented by $x_n$ (where n=0, 1, . . . , N−1). Here, n indicates the index of each sample in a frame that is an encoding target.

Frequency domain transform section 101 has N internal buffers, and first initializes each buffer using a value of 0 in accordance with Equation (1) below.

$$buf_n = 0 \ (n=0,1,\ldots,N-1) \qquad \text{(Equation 1)}$$

In this equation, $buf_n$ (n=0, . . . , N−1) indicates the (n+1)'th of N buffers in frequency domain transform section 101.

Next, frequency domain transform section 101 finds MDCT coefficient $X_k$ by performing a modified discrete cosine transform (MDCT) of input signal $x_n$ in accordance with Equation (2) below $$X_k = \frac{2}{N}\sum_{n=0}^{2N-1} x'_n \cos\left[\frac{(2n+1+N)(2k+1)\pi}{4N}\right] \qquad \text{(Equation 2)}$$

$$(k = 0, \ldots, N-1)$$

In this equation, k indicates the index of each sample in one frame, and $x'_n$ is a vector linking input signal $x_n$ and $buf_n$ in accordance with Equation (3) below.

$$x'_n = \begin{cases} buf_n & (n = 0, \ldots N-1) \\ x_{n-N} & (n = N, \ldots 2N-1) \end{cases} \qquad \text{(Equation 3)}$$

Next, frequency domain transform section 101 updates $buf_n$ (n=0, . . . , N−1) as shown in Equation (4) below.

$$buf_n = x_n \ (n=0, \ldots N-1) \qquad \text{(Equation 4)}$$

Then frequency domain transform section 101 outputs found MDCT coefficient $X_k$ to band selection section 102.

Band selection section 102 first divides MDCT coefficient $X_k$ into a plurality of subbands. Here, a description will be given taking a case in which MDCT coefficient $X_k$ is divided equally into J subbands (where J is a natural number) as an example. Then band selection section 102 selects L consecutive subbands (where L is a natural number) from among the J subbands, and obtains M kinds of subband groups (where M is a natural number). Below, these M kinds of subband groups are called regions.

Figure 2:
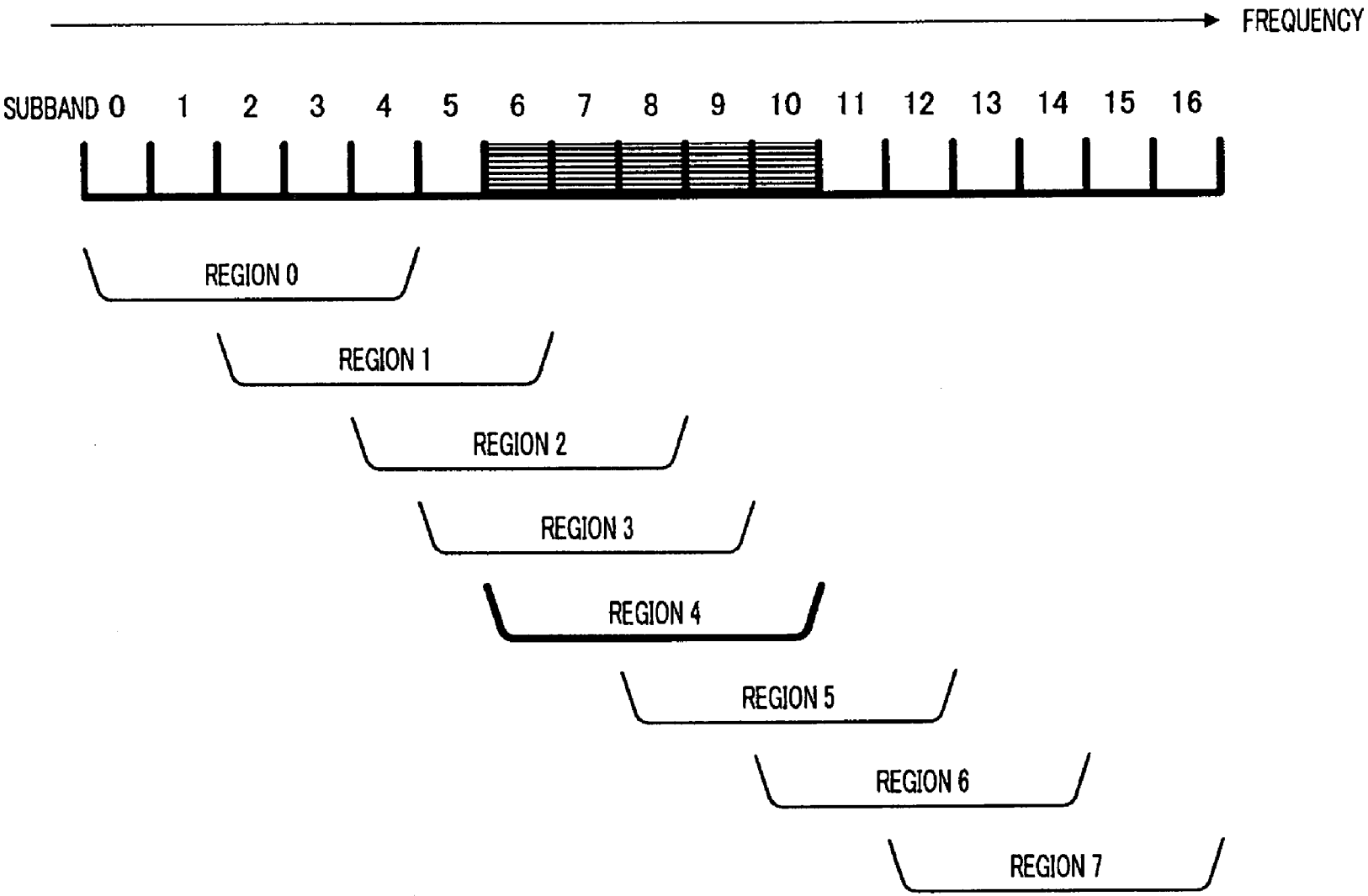
FIG. 2 is a drawing showing an example of the configuration of regions obtained by a band selection section according to Embodiment 1 of the present invention.

FIG. 2 is a drawing showing an example of the configuration of regions obtained by band selection section 102.

In this figure, the number of subbands is 17 (J=17), the number of kinds of regions is eight (M=8), and each region is composed of five consecutive subbands (L=5). Of these, for example, region 4 is composed of subbands 6 through 10.

Next, band selection section 102 calculates average energy E(m) of each of the M kinds of regions in accordance with Equation (5) below.

$$E(m) = \frac{\sum_{j=S(m)}^{S(m)+L-1} \sum_{k=B(j)}^{B(j)+W(j)} (X_k)^2}{L} \ (m = 0, \ldots, M-1) \qquad \text{(Equation 5)}$$

In this equation, j indicates the index of each of J subbands, m indicates the index of each of M kinds of regions, S(m) indicates the minimum value among the indices of L subbands composing region m, B (j) indicates the minimum value among the indices of a plurality of MDCT coefficients composing subband j, and W (j) indicates the bandwidth of subband j. In the following description, a case in which the bandwidths of the J subbands are all equal—that is, a case in which W(j) is a constant—will be described as an example.

Next, band selection section 102 selects a region—for example, a band composed of subbands j" through j"+L−1 for which average energy E(m) is a maximum as a band that is a quantization target (a quantization target band), and outputs index m_max indicating this region as band information to shape quantization section 103, predictive encoding execution/non-execution decision section 104, and multiplexing section 106. Band selection section 102 also outputs MDCT coefficient $X_k$ to shape quantization section 103. In the following description, the band indices indicating a quantization target band selected by band selection section 102 are assumed to be j" through j"+L−1.

Shape quantization section 103 performs shape quantization on a subband-by-subband basis on an MDCT coefficient corresponding to the band indicated by band information m_max input from band selection section 102. Specifically, shape quantization section 103 searches an internal shape codebook composed of quantity SQ of shape code vectors for each of L subbands, and finds the index of a shape code vector for which the result of Equation (6) below is a maximum.

$$\text{Shape_q}(i) = \frac{\left\{\sum_{k=0}^{W(j)} (X_{k+B(j)} \cdot SC_k^i)\right\}^2}{\sum_{k=0}^{W(j)} SC_k^i \cdot SC_k^i} \quad \text{(Equation 6)}$$

$$(j = j'', \ldots, j'' + L - 1, i = 0, \ldots, SQ - 1)$$

In this equation, $SC^i_k$ indicates a shape code vector composing a shape codebook, i indicates a shape code vector index, and k indicates the index of a shape code vector element.

Shape quantization section 103 outputs shape code vector index S_max for which the result of Equation (6) above is a maximum to multiplexing section 106 as shape encoded information. Shape quantization section 103 also calculates ideal gain value Gain_i(j) in accordance with Equation (7) below, and outputs this to gain quantization section 105.

$$\text{Gain_i}(j) = \frac{\sum_{k=0}^{W(j)} \left(X_{k+B(j)} \cdot SC_k^{S_max}\right)}{\sum_{k=0}^{W(j)} SC_{k+B(j)}^{S_max} \cdot SC_{k+B(j)}^{S_max}} \quad \text{(Equation 7)}$$

$$(j = j'', \ldots, j'' + L - 1)$$

Predictive encoding execution/non-execution decision section 104 has an internal buffer that stores band information m_max input from band selection section 102 in a past frame. Here, a case will be described by way of example in which predictive encoding execution/non-execution decision section 104 has an internal buffer that stores band information m_max for the past three frames. Predictive encoding execution/non-execution decision section 104 first finds a number of subbands common to a past-frame quantization target band and current-frame quantization target band using band information m_max input from band selection section 102 in a past frame and band information m_max input from band selection section 102 in the current frame. Then predictive encoding execution/non-execution decision section 104 determines that predictive encoding is to be performed if the number of common subbands is greater than or equal to a predetermined value, or determines that predictive encoding is not to be performed if the number of common subbands is less than the predetermined value. Specifically, L subbands indicated by band information m_max input from band selection section 102 one frame back in time are compared with L subbands indicated by band information m_max input from band selection section 102 in the current frame, and it is determined that predictive encoding is to be performed if the number of common subbands is P or more, or it is determined that predictive encoding is not to be performed if the number of common subbands is less than P. Predictive encoding execution/non-execution decision section 104 outputs the result of this determination to gain quantization section 105. Then predictive encoding execution/non-execution decision section 104 updates the internal buffer storing band information using band information m_max input from band selection section 102 in the current frame.

Gain quantization section 105 has an internal buffer that stores a quantization gain value obtained in a past frame. If a determination result input from predictive encoding execution/non-execution decision section 104 indicates that predictive encoding is to be performed, gain quantization section 105 performs quantization by predicting a current-frame gain value using past-frame quantization gain value $C^t_j$ stored in the internal buffer. Specifically, gain quantization section 105 searches an internal gain codebook composed of quantity GQ of gain code vectors for each of L subbands, and finds an index of a gain code vector for which the result of Equation (8) below is a minimum.

$$\text{Gain_q}(i) = \sum_{j=0}^{L-1} \left\{\text{Gain_i}(j + j'') - \sum_{t=1}^{3} \left(\alpha_t \cdot C^t_{j+j''}\right) - \alpha_0 \cdot GC^i_j\right\}^2 \quad \text{(Equation 8)}$$

$$(i = 0, \ldots, GQ - 1)$$

In this equation, $GC^i_j$ indicates a gain code vector composing a gain codebook, i indicates a gain code vector index, and j indicates an index of a gain code vector element. For example, if the number of subbands composing a region is five (L=5), j has a value of 0 to 4. Here, $C^t_j$ indicates a gain value of t frames before in time, so that when t=1, for example, $C^t_j$ indicates a gain value of one frame before in time. Also, α is a 4th-order linear prediction coefficient stored in gain quantization section 105. Gain quantization section 105 treats L subbands within one region as an L-dimensional vector, and performs vector quantization.

Gain quantization section 105 outputs gain code vector index G_min for which the result of Equation (8) above is a minimum to multiplexing section 106 as gain encoded information. If there is no gain value of a subband corresponding to a past frame in the internal buffer, gain quantization section 105 substitutes the gain value of the nearest subband in frequency in the internal buffer in Equation (8) above.

On the other hand, if the determination result input from predictive encoding execution/non-execution decision section 104 indicates that predictive encoding is not to be performed, gain quantization section 105 directly quantizes ideal gain value Gain_i (j) input from shape quantization section 103 in accordance with Equation (9) below. Here, gain quantization section 105 treats an ideal gain value as an L-dimensional vector, and performs vector quantization.

$$\text{Gain_q}(i) = \sum_{j=0}^{L-1} \{\text{Gain_i}(j + j'') - GC^i_j\}^2 \quad \text{(Equation 9)}$$

$$(i = 0, \ldots, GQ - 1)$$

Here, a codebook index that makes Equation (9) above a minimum is denoted by G_min.

Gain quantization section 105 outputs G_min to multiplexing section 106 as gain encoded information. Gain quantization section 105 also updates the internal buffer in accordance with Equation (10) below using gain encoded information G_min and quantization gain value $C^t_j$ obtained in the current frame.

$$\begin{cases} C^3_{j+j''} = C^2_{j+j''} \\ C^2_{j+j''} = C^1_{j+j''} \quad (j = 0, \ldots, L-1) \\ C^1_{j+j''} = GC_j^{G_min} \end{cases} \quad \text{(Equation 10)}$$

Multiplexing section 106 multiplexes band information m_max input from band selection section 102, shape encoded information S_max input from shape quantization section 103, and gain encoded information G_min input from gain quantization section 105, and transmits the obtained bit stream to a speech decoding apparatus.

Figure 3:
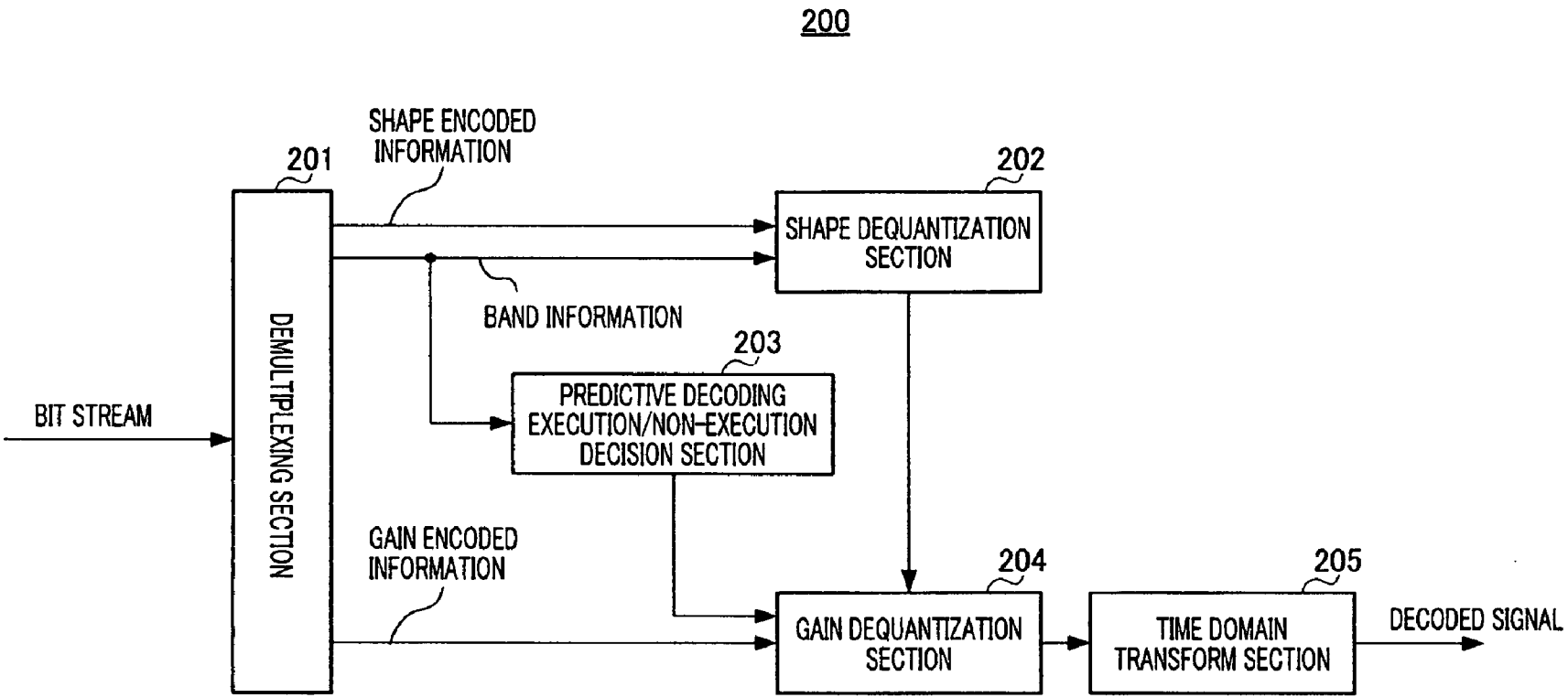
FIG. 3 is a block diagram showing the main configuration of a speech decoding apparatus according to Embodiment 1 of the present invention.

FIG. 3 is a block diagram showing the main configuration of speech decoding apparatus 200 according to this embodiment.

In this figure, speech decoding apparatus 200 is equipped with demultiplexing section 201, shape dequantization section 202, predictive decoding execution/non-execution decision section 203, gain dequantization section 204, and time domain transform section 205.

Demultiplexing section 201 demultiplexes band information, shape encoded information, and gain encoded information from a bit stream transmitted from speech encoding apparatus 100, outputs the obtained band information to shape dequantization section 202 and predictive decoding execution/non-execution decision section 203, outputs the obtained shape encoded information to shape dequantization section 202, and outputs the obtained gain encoded information to gain dequantization section 204.

Shape dequantization section 202 finds the shape value of an MDCT coefficient corresponding to a quantization target band indicated by band information input from demultiplexing section 201 by performing dequantization of shape encoded information input from demultiplexing section 201, and outputs the found shape value to gain dequantization section 204.

Predictive decoding execution/non-execution decision section 203 finds a number of subbands common to a current-frame quantization target band and a past-frame quantization target band using the band information input from demultiplexing section 201. Then predictive decoding execution/non-execution decision section 203 determines that predictive decoding is to be performed on the MDCT coefficient of the quantization target band indicated by the band information if the number of common subbands is greater than or equal to a predetermined value, or determines that predictive decoding is not to be performed on the MDCT coefficient of the quantization target band indicated by the band information if the number of common subbands is less than the predetermined value. Predictive decoding execution/non-execution decision section 203 outputs the result of this determination to gain dequantization section 204.

If the determination result input from predictive decoding execution/non-execution decision section 203 indicates that predictive decoding is to be performed, gain dequantization section 204 performs predictive decoding on gain encoded information input from demultiplexing section 201 using a past-frame gain value stored in an internal buffer and an internal gain codebook, to obtain a gain value. On the other hand, if the determination result input from predictive decoding execution/non-execution decision section 203 indicates that predictive decoding is not to be performed, gain dequantization section 204 obtains a gain value by directly performing dequantization of gain encoded information input from demultiplexing section 201 using the internal gain codebook. Gain dequantization section 204 outputs the obtained gain value to time domain transform section 205. Gain dequantization section 204 also finds an MDCT coefficient of the quantization target band using the obtained gain value and a shape value input from shape dequantization section 202, and outputs this to time domain transform section 205 as a decoded MDCT coefficient.

Time domain transform section 205 performs an Inverse Modified Discrete Cosine Transform (IMDCT) on the decoded MDCT coefficient input from gain dequantization section 204 to generate a time domain signal, and outputs this as a decoded signal.

Speech decoding apparatus 200 having a configuration such as described above performs the following operations.

Demultiplexing section 201 demultiplexes band information m_max, shape encoded information S_max, and gain encoded information G_min from a bit stream transmitted from speech encoding apparatus 100, outputs obtained band information m_max to shape dequantization section 202 and predictive decoding execution/non-execution decision section 203, outputs obtained shape encoded information S_max to shape dequantization section 202, and outputs obtained gain encoded information G_min to gain dequantization section 204.

Shape dequantization section 202 has an internal shape codebook similar to the shape codebook with which shape quantization section 103 of speech encoding apparatus 100 is provided, and searches for a shape code vector for which shape encoded information S_max input from demultiplexing section 201 is an index. Shape dequantization section 202 outputs a searched code vector to gain dequantization section 204 as the shape value of an MDCT coefficient of a quantization target band indicated by band information m_max input from demultiplexing section 201. Here, a shape code vector searched as a shape value is denoted by Shape_q(k) (k=B(j"), . . . , B(j"+L)−1).

Predictive decoding execution/non-execution decision section 203 has an internal buffer that stores band information m_max input from demultiplexing section 201 in a past frame. Here, a case will be described by way of example in which predictive decoding execution/non-execution decision section 203 has an internal buffer that stores band information m_max for the past three frames. Predictive decoding execution/non-execution decision section 203 first finds a number of subbands common to a past-frame quantization target band and current-frame quantization target band using band information m_max input from demultiplexing section 201 in a past frame and band information m_max input from demultiplexing section 201 in the current frame. Then predictive decoding execution/non-execution decision section 203 determines that predictive decoding is to be performed if the number of common subbands is greater than or equal to a predetermined value, or determines that predictive decoding is not to be performed if the number of common subbands is less than the predetermined value. Specifically, predictive decoding execution/non-execution decision section 203 compares L subbands indicated by band information m_max input from demultiplexing section 201 one frame back in time with L subbands indicated by band information m_max input from demultiplexing section 201 in the current frame, and determines that predictive decoding is to be performed if the number of common subbands is P or more, or determines that predictive decoding is not to be performed if the number of common subbands is less than P. Predictive decoding execution/non-execution decision section 203 outputs the result of this determination to gain dequantization section 204. Then predictive decoding execution/non-execution decision section 203 updates the internal buffer storing band information using band information m_max input from demultiplexing section 201 in the current frame.

Gain dequantization section 204 has an internal buffer that stores a gain value obtained in a past frame. If a determination result input from predictive decoding execution/non-execution decision section 203 indicates that predictive decoding is to be performed, gain dequantization section 204 performs dequantization by predicting a current-frame gain value using a past-frame gain value stored in the internal buffer. Specifically, gain dequantization section 204 has the same kind of internal gain codebook as gain quantization section 105 of speech encoding apparatus 100, and obtains gain value Gain_q' by performing gain dequantization in accordance with Equation (11) below. Here, $C''^{t}_{j}$ indicates a gain value of t frames before in time, so that when t=1, for example, $C''^{t}_{j}$ indicates a gain value of one frame before in time. Also, α is a 4th-order linear prediction coefficient stored in gain dequantization section 204. Gain dequantization section 204 treats L subbands within one region as an L-dimensional vector, and performs vector dequantization.

$$\text{Gain_q}'(j+j'') = \sum_{t=1}^{3}\left(\alpha_t \cdot C''^{t}_{j+j''}\right) + \alpha_0 \cdot GC_j^{G_min} \quad (j = 0, \ldots, L-1) \qquad \text{(Equation 11)}$$

If there is no gain value of a subband corresponding to a past frame in the internal buffer, gain dequantization section 204 substitutes the gain value of the nearest subband in frequency in the internal buffer in Equation (11) above.

On the other hand, if the determination result input from predictive decoding execution/non-execution decision section 203 indicates that predictive decoding is not to be performed, gain dequantization section 204 performs dequantization of a gain value in accordance with Equation (12) below using the above-described gain codebook. Here, a gain value is treated as an L-dimensional vector, and vector dequantization is performed. That is to say, when predictive decoding is not performed, gain code vector $GC_j^{G_min}$ corresponding to gain encoded information G_min is taken directly as a gain value.

$$\text{Gain_}q'(j+j'') = GC_j^{G_min} \ (j=0, \ldots L-1) \qquad \text{(Equation 12)}$$

Next, gain dequantization section 204 calculates a decoded MDCT coefficient in accordance with Equation (13) below using a gain value obtained by current-frame dequantization and a shape value input from shape dequantization section 202, and updates the internal buffer in accordance with Equation (14) below. Here, a calculated decoded MDCT coefficient is denoted by $X''_k$. Also, in MDCT coefficient dequantization, if k is present within B(j") through B(j"+1)−1, gain value Gain_q'(j) takes the value of Gain_q'(j").

$$X''_k = \text{Gain_q}'(j) \cdot \text{Shape_q}'(k) \quad \begin{pmatrix} k = B(j''), \ldots, B(j''+L)-1 \\ j = j'', \ldots, j''+L-1 \end{pmatrix} \qquad \text{(Equation 13)}$$

$$\begin{cases} C''^{3}_{j} = C''^{2}_{j} \\ C''^{2}_{j} = C''^{1}_{j} \qquad (j = j'', \ldots, j''+L-1) \\ C''^{1}_{j} = \text{Gain_q}'(j) \end{cases} \qquad \text{(Equation 14)}$$

Gain dequantization section 204 outputs decoded MDCT coefficient $X''_k$ calculated in accordance with Equation (13) above to time domain transform section 205.

Time domain transform section 205 first initializes internal buffer $buf'_k$ to a value of zero in accordance with Equation (15) below.

$$buf'_k = 0 \ (k=0, \ldots, N-1) \qquad \text{(Equation 15)}$$

Then time domain transform section 205 finds decoded signal $Y_n$ in accordance with Equation (16) below using decoded MDCT coefficient $X''_k$ input from gain dequantization section 204.

$$Y_n = \frac{2}{N}\sum_{n=0}^{2N-1} X2''_k \cos\left[\frac{(2n+1+N)(2k+1)\pi}{4N}\right] \quad (n = 0, \ldots, N-1) \qquad \text{(Equation 16)}$$

In this equation, $X2''_k$ is a vector linking decoded MDCT coefficient $X''_k$ and buffer $buf'_k$.

$$X2''_k = \begin{cases} buf'_k & (k = 0, \ldots N-1) \\ X''_k & (k = N, \ldots 2N-1) \end{cases} \qquad \text{(Equation 17)}$$

Next, time domain transform section 205 updates buffer $buf'_k$ in accordance with Equation (18) below.

$$buf'_k = X''_k \ (k=0, \ldots N-1) \qquad \text{(Equation 18)}$$

Time domain transform section 205 outputs obtained decoded signal $Y_n$ as an output signal.

Thus, according to this embodiment, a high-energy band is selected in each frame as a quantization target band and a frequency domain parameter is quantized, enabling bias to be created in quantized gain value distribution, and vector quantization performance to be improved.

Also, according to this embodiment, in frequency domain parameter quantization of a different quantization target band of each frame, predictive encoding is performed on a frequency domain parameter if the number of subbands common to a past-frame quantization target band and current-frame quantization target band is determined to be greater than or equal to a predetermined value, and a frequency domain parameter is encoded directly if the number of common subbands is determined to be less than the predetermined value. Consequently, the encoded information amount in speech encoding is reduced, and also sharp speech quality degradation can be prevented, and speech/audio signal encoding error and decoded signal audio quality degradation can be reduced.

Furthermore, according to this embodiment, on the encoding side a quantization target band can be decided, and frequency domain parameter quantization performed, in region units each composed of a plurality of subbands, and information as to a frequency domain parameter of which region has become a quantization target can be transmitted to the decoding side. Consequently, quantization efficiency can be improved and the encoded information amount transmitted to the decoding side can be further reduced as compared with deciding whether or not predictive encoding is to be used on a subband-by-subband basis and transmitting information as to which subband has become a quantization target to the decoding side.

In this embodiment, a case has been described by way of example in which gain quantization is performed in region units each composed of a plurality of subbands, but the present invention is not limited to this, and a quantization target may also be selected on a subband-by-subband basis—that is, determination of whether or not predictive quantization is to be carried out may also be performed on a subband-by-subband basis.

In this embodiment, a case has been described by way of example in which the gain predictive quantization method is to perform linear prediction in the time domain for gain of the same frequency band, but the present invention is not limited to this, and linear prediction may also be performed in the time domain for gain of different frequency bands.

In this embodiment, a case has been described in which an ordinary speech/audio signal is taken as an example of a signal that becomes a quantization target, but the present invention is not limited to this, and an excitation signal obtained by processing a speech/audio signal by means of an LPC (Linear Prediction Coefficient) inverse filter may also be used as a quantization target.

In this embodiment, a case has been described by way of example in which a region for which the magnitude of individual region energy—that is, perceptual significance—is greatest is selected as a reference for selecting a quantization target band, but the present invention is not limited to this, and in addition to perceptual significance, frequency correlation with a band selected in a past frame may also be taken into consideration at the same time. That is to say, if candidate bands exist for which the number of subbands common to a quantization target band selected in the past is greater than or equal to a predetermined value and energy is greater than or equal to a predetermined value, the band with the highest energy among the above candidate bands may be selected as the quantization target band, and if no such candidate bands exist, the band with the highest energy among all frequency bands may be selected as the quantization target band. For example, if a subband common to the highest-energy region and a band selected in a past frame does not exist, the number of subbands common to the second-highest-energy region and a band selected in a past frame is greater than or equal to a predetermined threshold value, and the energy of the second-highest-energy region is greater than or equal to a predetermined threshold value, the second-highest-energy region is selected rather than the highest-energy region. Also, a band selection section according to this embodiment selects a region closest to a quantization target band selected in the past from among regions whose energy is greater than or equal to a predetermined value as a quantization target band.

In this embodiment, MDCT coefficient quantization may be performed after interpolation is performed using a past frame. For example, a case will be described with reference to FIG. 2 in which a past-frame quantization target band is region 3 (that is, subbands 5 through 9), a current-frame quantization target band is region 4 (that is, subbands 6 through 10), and current-frame predictive encoding is performed using a past-frame quantization result. In such a case, predictive encoding is performed on current-frame subbands 6 through 9 using past-frame subbands 6 through 9, and for current-frame subband 10, past-frame subband 10 is interpolated using past-frame subbands 6 through 9, and then predictive encoding is performed using past-frame subband 10 obtained by interpolation.

In this embodiment, a case has been described by way of example in which quantization is performed using the same codebook irrespective of whether or not predictive encoding is performed, but the present invention is not limited to this, and different codebooks may also be used according to whether predictive encoding is performed or is not performed in gain quantization and in shape quantization.

In this embodiment, a case has been described by way of example in which all subband widths are the same, but the present invention is not limited to this, and individual subband widths may also differ.

In this embodiment, a case has been described by way of example in which the same codebook is used for all subbands in gain quantization and in shape quantization, but the present invention is not limited to this, and different codebooks may also be used on a subband-by-subband basis in gain quantization and in shape quantization.

In this embodiment, a case has been described by way of example in which consecutive subbands are selected as a quantization target band, but the present invention is not limited to this, and a nonconsecutive plurality of subbands may also be selected as a quantization target band. In such a case, speech encoding efficiency can be further improved by interpolating an unselected subband value using adjacent subband values.

Figure 4:
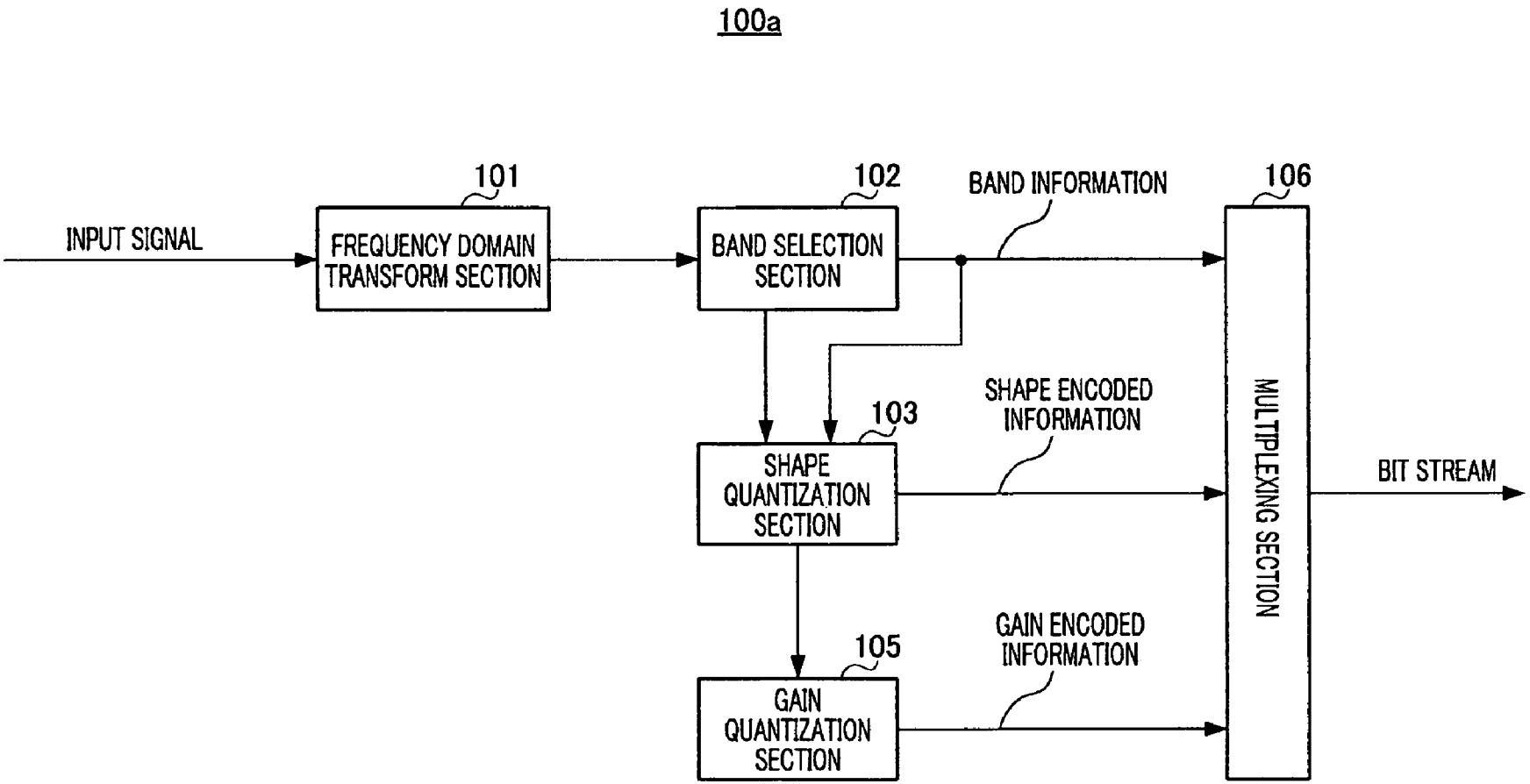
FIG. 4 is a block diagram showing the main configuration of a variation of a speech encoding apparatus according to Embodiment 1 of the present invention.
Figure 5:
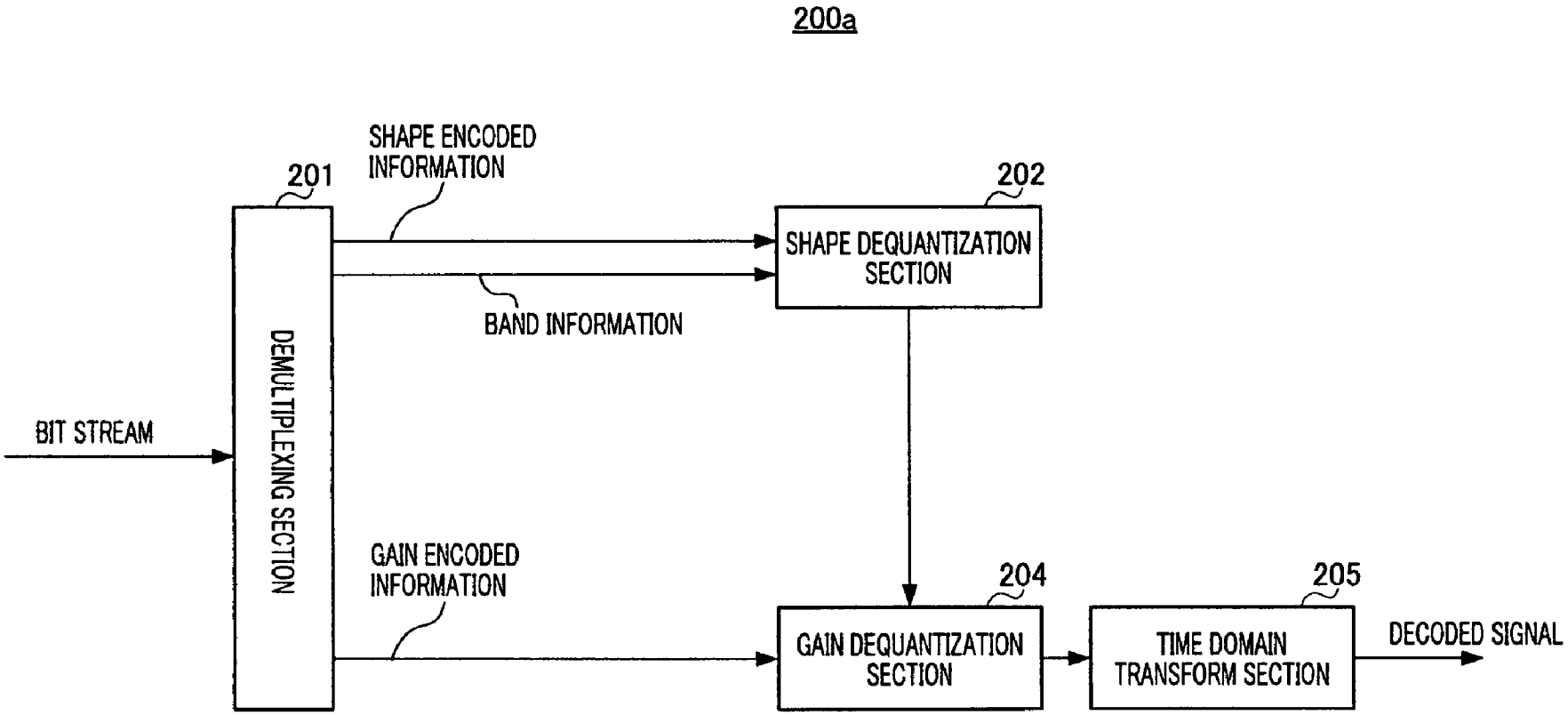
FIG. 5 is a block diagram showing the main configuration of a variation of a speech decoding apparatus according to Embodiment 1 of the present invention.

In this embodiment, a case has been described by way of example in which speech encoding apparatus 100 is equipped with predictive encoding execution/non-execution decision section 104, but a speech encoding apparatus according to the present invention is not limited to this, and may also have a configuration in which predictive encoding execution/non-execution decision section 104 is not provided and predictive quantization is not always performed by gain quantization section 105, as illustrated by speech encoding apparatus 100*a* shown in FIG. 4. In this case, as shown in FIG. 4, speech encoding apparatus 100*a* is equipped with frequency domain transform section 101, band selection section 102, shape quantization section 103, gain quantization section 105, and multiplexing section 106. FIG. 5 is a block diagram showing the configuration of speech decoding apparatus 200*a* corresponding to speech encoding apparatus 100*a*, speech decoding apparatus 200*a* being equipped with demultiplexing section 201, shape dequantization section 202, gain dequantization section 204, and time domain transform section 205. In such a case, speech encoding apparatus 100*a* performs partial selection of a band to be quantized from among all bands, further divides the selected band into a plurality of subbands, and quantizes the gain of each subband. By this means, quantization can be performed at a lower bit rate than with a method whereby components of all bands are quantized, and encoding efficiency can be improved. Also, encoding efficiency can be further improved by quantizing a gain vector using gain correlation in the frequency domain.

A speech encoding apparatus according to the present invention may also have a configuration in which predictive encoding execution/non-execution decision section 104 is not provided and predictive quantization is always performed by gain quantization section 105, as illustrated by speech encoding apparatus 100*a* shown in FIG. 4. The configuration of speech decoding apparatus 200*a* corresponding to this kind of speech encoding apparatus 100*a* is as shown in FIG. 5. In such a case, speech encoding apparatus 100*a* performs partial selection of a band to be quantized from among all bands, further divides the selected band into a plurality of subbands, and performs gain quantization for each subband. By this means, quantization can be performed at a lower bit rate than with a method whereby components of all bands are quantized, and encoding efficiency can be improved. Also, encoding efficiency can be further improved by predictive quantizing a gain vector using gain correlation in the time domain.

In this embodiment, a case has been described by way of example in which the method of selecting a quantization target band in a band selection section is to select the region with the highest energy in all bands, but the present invention is not limited to this, and selection may also be performed using information of a band selected in a temporally preceding frame in addition to the above criterion. For example, a possible method is to select a region to be quantized after performing multiplication by a weight such that a region that includes a band in the vicinity of a band selected in a temporally preceding frame becomes more prone to selection. Also, if there are a plurality of layers in which a band to be quantized is selected, a band quantized in an upper layer may be selected using information of a band selected in a lower layer. For example, a possible method is to select a region to be quantized after performing multiplication by a weight such that a region that includes a band in the vicinity of a band selected in a lower layer becomes more prone to selection.

In this embodiment, a case has been described by way of example in which the method of selecting a quantization target band is to select the region with the highest energy in all bands, but the present invention is not limited to this, and a certain band may also be preliminarily selected beforehand, after which a quantization target band is finally selected in the preliminarily selected band. In such a case, a preliminarily selected band may be decided according to the input signal sampling rate, coding bit rate, or the like. For example, one method is to select a low band preliminarily when the bit rate or sampling rate is low.

For example, it is possible for a method to be employed in band selection section 102 whereby a region to be quantized is decided by calculating region energy after limiting selectable regions to low-band regions from among all selectable region candidates. As an example of this, a possible method is to perform limiting to five candidates from the low-band side from among the total of eight candidate regions shown in FIG. 2, and select the region with the highest energy among these. Alternatively, band selection section 102 may compare energies after multiplying energy by a weight so that a lower-area region becomes proportionally more prone to selection. Another possibility is for band selection section 102 to select a fixed low-band-side subband. A feature of a speech signal is that the harmonics structure becomes proportionally stronger toward the low-band side, as a result of which a strong peak is present on the low-band side. As this strong peak is difficult to mask, it is prone to be perceived as noise. Here, by increasing the likelihood of selection toward the low-band side rather than simply selecting a region based on energy magnitude, the possibility of a region that includes a strong peak being selected is increased, and a sense of noise is reduced as a result. Thus, the quality of a decoded signal can be improved by limiting selected regions to the low-band side, or performing multiplication by a weight such that the likelihood of selection increases toward the low-band side, in this way.

A speech encoding apparatus according to the present invention has been described in terms of a configuration whereby shape (shape information) quantization is first performed on a component of a band to be quantized, followed by gain (gain information) quantization, but the present invention is not limited to this, and a configuration may also be used whereby gain quantization is performed first, followed by shape quantization.

(Embodiment 2)

Figure 6:
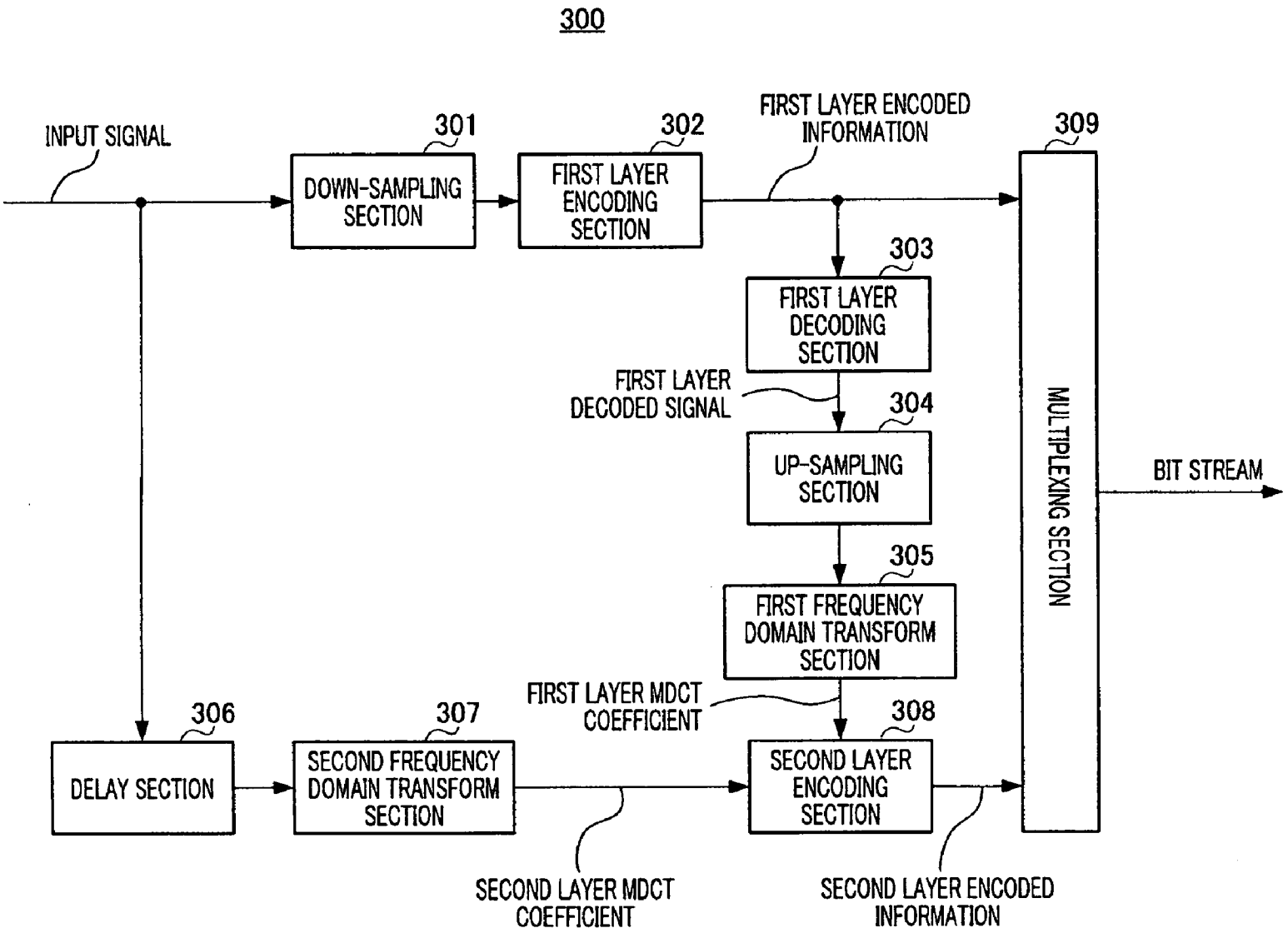
FIG. 6 is a block diagram showing the main configuration of a speech encoding apparatus according to Embodiment 2 of the present invention.

FIG. 6 is a block diagram showing the main configuration of speech encoding apparatus 300 according to Embodiment 2 of the present invention.

In this figure, speech encoding apparatus 300 is equipped with down-sampling section 301, first layer encoding section 302, first layer decoding section 303, up-sampling section 304, first frequency domain transform section 305, delay section 306, second frequency domain transform section 307, second layer encoding section 308, and multiplexing section 309, and has a scalable configuration comprising two layers. In the first layer, a CELP (Code Excited Linear Prediction) speech encoding method is applied, and in the second layer, the speech encoding method described in Embodiment 1 of the present invention is applied.

Down-sampling section 301 performs down-sampling processing on an input speech/audio signal, to convert the speech/audio signal sampling rate from Rate 1 to Rate (where Rate 1>Rate 2), and outputs this signal to first layer encoding section 302.

First layer encoding section 302 performs CELP speech encoding on the post-down-sampling speech/audio signal input from down-sampling section 301, and outputs obtained first layer encoded information to first layer decoding section 303 and multiplexing section 309. Specifically, first layer encoding section 302 encodes a speech signal comprising vocal tract information and excitation information by finding an LPC parameter for the vocal tract information, and for the excitation information, performs encoding by finding an index that identifies which previously stored speech model is to be used—that is, an index that identifies which excitation vector of an adaptive codebook and fixed codebook is to be generated.

First layer decoding section 303 performs CELP speech decoding on first layer encoded information input from first layer encoding section 302, and outputs an obtained first layer decoded signal to up-sampling section 304.

Up-sampling section 304 performs up-sampling processing on the first layer decoded signal input from first layer decoding section 303, to convert the first layer decoded signal sampling rate from Rate 2 to Rate 1, and outputs this signal to first frequency domain transform section 305.

First frequency domain transform section 305 performs an MDCT on the post-up-sampling first layer decoded signal input from up-sampling section 304, and outputs a first layer MDCT coefficient obtained as a frequency domain parameter to second layer encoding section 308. The actual transform method used in first frequency domain transform section 305 is similar to the transform method used in frequency domain transform section 101 of speech encoding apparatus 100 according to Embodiment 1 of the present invention, and therefore a description thereof is omitted here.

Delay section 306 outputs a delayed speech/audio signal to second frequency domain transform section 307 by outputting an input speech/audio signal after storing that input signal in an internal buffer for a predetermined time. The predetermined delay time here is a time that takes account of algorithm delay that arises in down-sampling section 301, first layer encoding section 302, first layer decoding section 303, up-sampling section 304, first frequency domain transform section 305, and second frequency domain transform section 307.

Second frequency domain transform section 307 performs an MDCT on the delayed speech/audio signal input from delay section 306, and outputs a second layer MDCT coefficient obtained as a frequency domain parameter to second layer encoding section 308. The actual transform method used in second frequency domain transform section 307 is similar to the transform method used in frequency domain transform section 101 of speech encoding apparatus 100 according to Embodiment 1 of the present invention, and therefore a description thereof is omitted here.

Second layer encoding section 308 performs second layer encoding using the first layer MDCT coefficient input from first frequency domain transform section 305 and the second layer MDCT coefficient input from second frequency domain transform section 307, and outputs obtained second layer encoded information to multiplexing section 309. The main internal configuration and actual operation of second layer encoding section 308 will be described later herein.

Multiplexing section 309 multiplexes first layer encoded information input from first layer encoding section 302 and second layer encoded information input from second layer encoding section 308, and transmits the obtained bit stream to a speech decoding apparatus.

Figure 7:
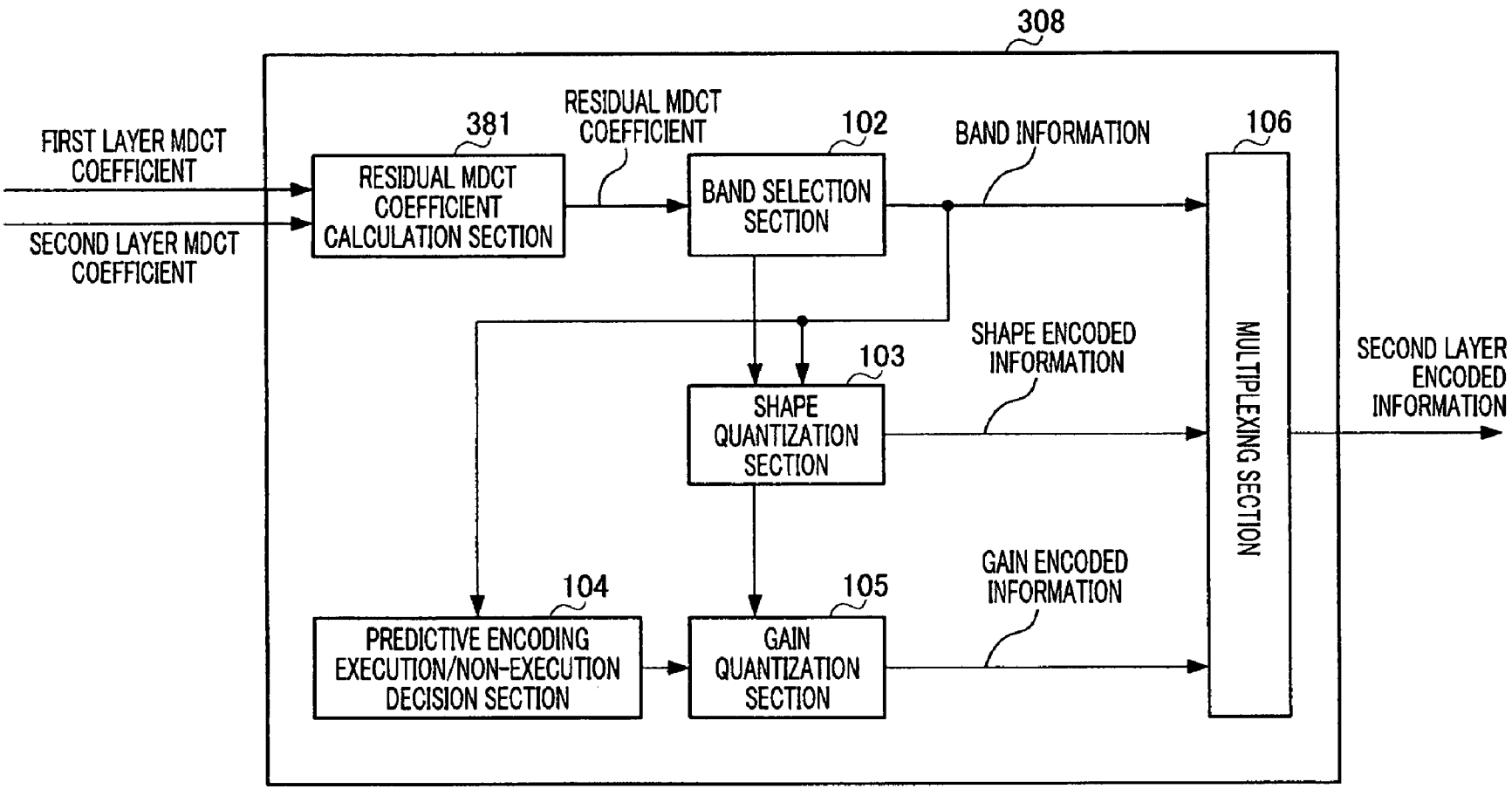
FIG. 7 is a block diagram showing the main configuration of the interior of a second layer encoding section according to Embodiment 2 of the present invention.

FIG. 7 is a block diagram showing the main configuration of the interior of second layer encoding section 308. Second layer encoding section 308 has a similar basic configuration to that of speech encoding apparatus 100 according to Embodiment 1 (see FIG. 1), and therefore identical configuration elements are assigned the same reference codes and descriptions thereof are omitted here.

Second layer encoding section 308 differs from speech encoding apparatus 100 in being equipped with residual MDCT coefficient calculation section 381 instead of frequency domain transform section 101. Processing by multiplexing section 106 is similar to processing by multiplexing section 106 of speech encoding apparatus 100, and for the sake of the description, the name of a signal output from multiplexing section 106 according to this embodiment is given as "second layer encoded information".

Band information, shape encoded information, and gain encoded information may also be input directly to multiplexing section 309 and multiplexed with first layer encoded information without passing through multiplexing section 106.

Residual MDCT coefficient calculation section 381 finds a residue of the first layer MDCT coefficient input from first frequency domain transform section 305 and the second layer MDCT coefficient input from second frequency domain transform section 307, and outputs this to band selection section 102 as a residual MDCT coefficient.

Figure 8:
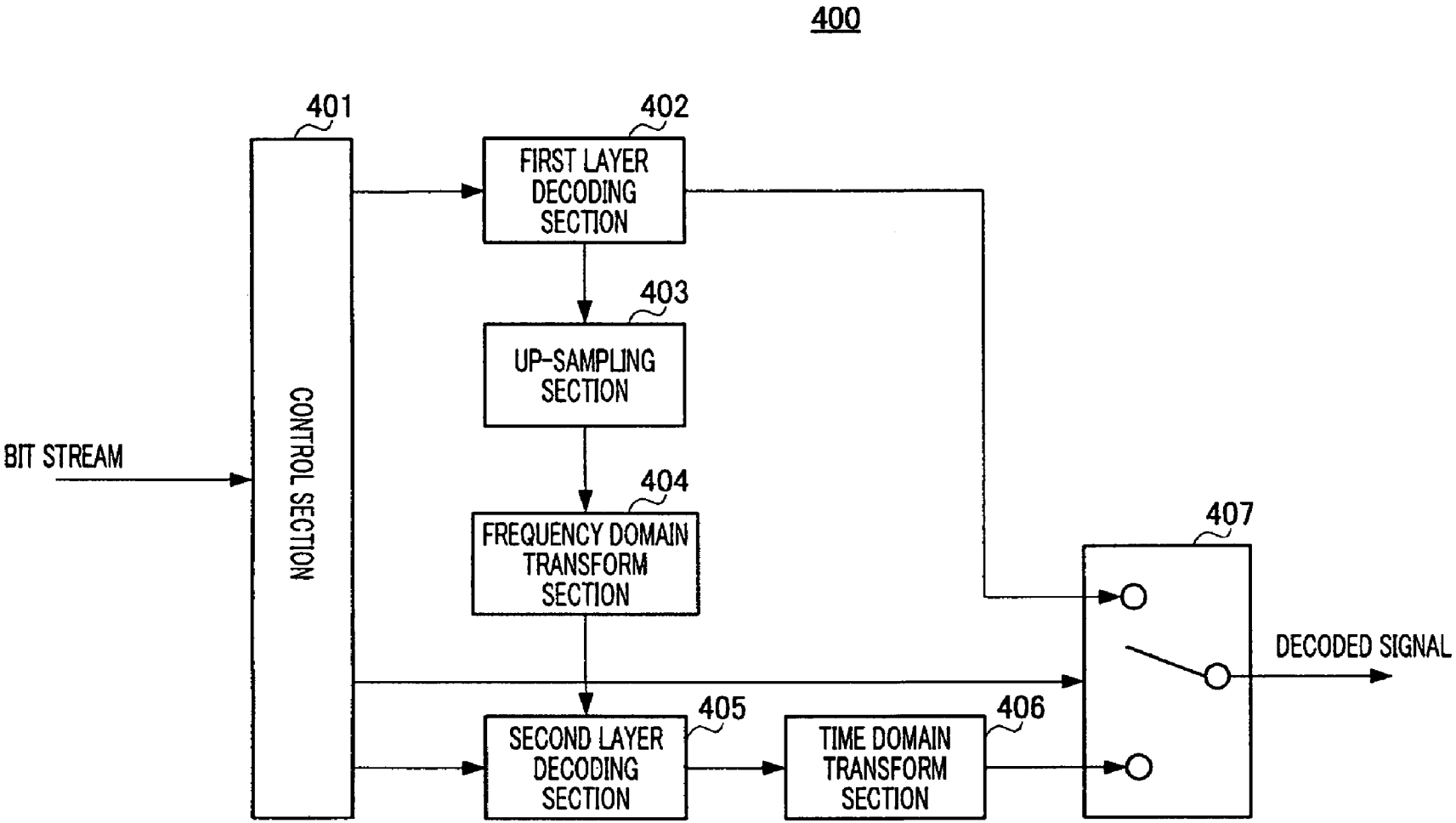
FIG. 8 is a block diagram showing the main configuration of a speech decoding apparatus according to Embodiment 2 of the present invention.

FIG. 8 is a block diagram showing the main configuration of speech decoding apparatus 400 according to Embodiment 2 of the present invention.

In this figure, speech decoding apparatus 400 is equipped with control section 401, first layer decoding section 402, up-sampling section 403, frequency domain transform section 404, second layer decoding section 405, time domain transform section 406, and switch 407.

Control section 401 analyzes configuration elements of a bit stream transmitted from speech encoding apparatus 300, and according to these bit stream configuration elements, adaptively outputs appropriate encoded information to first layer decoding section 402 and second layer decoding section 405, and also outputs control information to switch 407. Specifically, if the bit stream comprises first layer encoded information and second layer encoded information, control section 401 outputs the first layer encoded information to first layer decoding section 402 and outputs the second layer encoded information to second layer decoding section 405, whereas if the bit stream comprises only first layer encoded information, control section 401 outputs this first layer encoded information to first layer decoding section 402.

First layer decoding section 402 performs CELP decoding on first layer encoded information input from control section 401, and outputs the obtained first layer decoded signal to up-sampling section 403 and switch 407.

Up-sampling section 403 performs up-sampling processing on the first layer decoded signal input from first layer decoding section 402, to convert the first layer decoded signal sampling rate from Rate 2 to Rate 1, and outputs this signal to frequency domain transform section 404.

Frequency domain transform section 404 performs an MDCT on the post-up-sampling first layer decoded signal input from up-sampling section 403, and outputs a first layer decoded MDCT coefficient obtained as a frequency domain parameter to second layer decoding section 405. The actual transform method used in frequency domain transform section 404 is similar to the transform method used in frequency domain transform section 101 of speech encoding apparatus 100 according to Embodiment 1, and therefore a description thereof is omitted here.

Second layer decoding section 405 performs gain dequantization and shape dequantization using the second layer encoded information input from control section 401 and the first layer decoded MDCT coefficient input from frequency domain transform section 404, to obtain a second layer decoded MDCT coefficient. Second layer decoding section 405 adds together the obtained second layer decoded MDCT coefficient and first layer decoded MDCT coefficient, and outputs the obtained addition result to time domain transform section 406 as an addition MDCT coefficient. The main internal configuration and actual operation of second layer decoding section 405 will be described later herein.

Time domain transform section 406 performs an IMDCT on the addition MDCT coefficient input from second layer decoding section 405, and outputs a second layer decoded signal obtained as a time domain component to switch 407.

Based on control information input from control section 401, if the bit stream input to speech decoding apparatus 400 comprises first layer encoded information and second layer encoded information, switch 407 outputs the second layer decoded signal input from time domain transform section 406 as an output signal, whereas if the bit stream comprises only first layer encoded information, switch 407 outputs the first layer decoded signal input from first layer decoding section 402 as an output signal.

Figure 9:
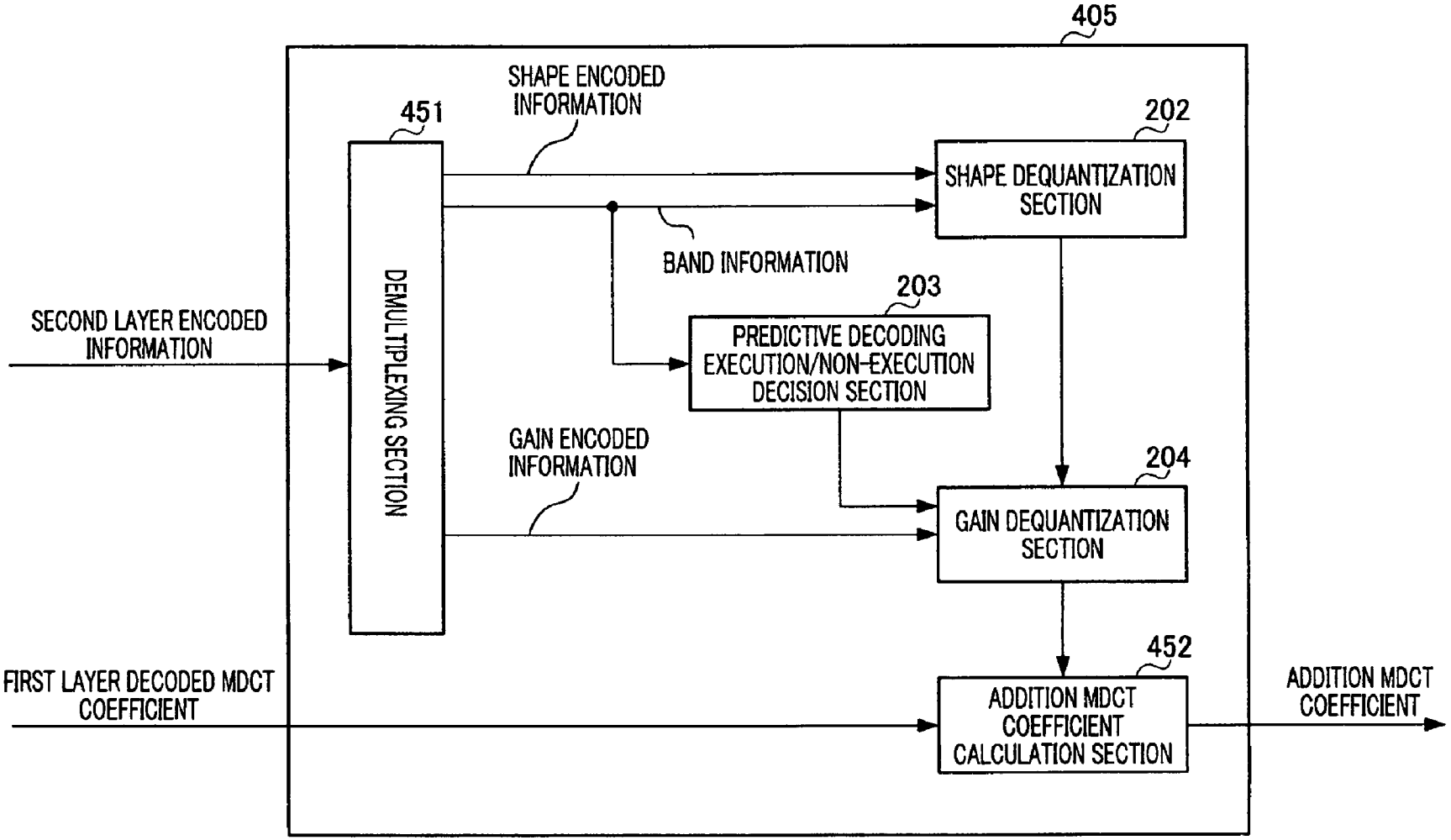
FIG. 9 is a block diagram showing the main configuration of the interior of a second layer decoding section according to Embodiment 2 of the present invention.

FIG. 9 is a block diagram showing the main configuration of the interior of second layer decoding section 405. Second layer decoding section 405 has a similar basic configuration to that of speech decoding apparatus 200 according to Embodiment 1 (see FIG. 3), and therefore identical configuration elements are assigned the same reference codes and descriptions thereof are omitted here.

Second layer decoding section 405 differs from speech decoding apparatus 200 in being further equipped with addition MDCT coefficient calculation section 452. Also, processing differs in part between demultiplexing section 451 of second layer decoding section 405 and demultiplexing section 201 of speech decoding apparatus 200, and a different reference code is assigned to indicate this.

Demultiplexing section 451 demultiplexes band information, shape encoded information, and gain encoded information from second layer encoded information input from control section 401, and outputs the obtained band information to shape dequantization section 202 and predictive decoding execution/non-execution decision section 203, the obtained shape encoded information to shape dequantization section 202, and the obtained gain encoded information to gain dequantization section 204.

Addition MDCT coefficient calculation section 452 adds together the first layer decoded MDCT coefficient input from frequency domain transform section 404 and the second layer decoded MDCT coefficient input from gain dequantization section 204, and outputs the obtained addition result to time domain transform section 406 as an addition MDCT coefficient.

Thus, according to this embodiment, when a frequency component of a different band is made a quantization target in each frame, non-temporal parameter predictive encoding is performed adaptively in addition to applying scalable encoding, thereby enabling the encoded information amount in speech encoding to be reduced, and speech/audio signal encoding error and decoded signal audio quality degradation to be reduced.

In this embodiment, a case has been described by way of example in which second layer encoding section 308 takes a difference component of a first layer MDCT coefficient and second layer MDCT coefficient as an encoding target, but the present invention is not limited to this, and second layer encoding section 308 may also take a difference component of a first layer MDCT coefficient and second layer MDCT coefficient as an encoding target for a band of a predetermined frequency or below, or may take an input signal MDCT coefficient itself as an encoding target for a band higher than a predetermined frequency. That is to say, switching may be performed between use or non-use of a difference component according to the band.

In this embodiment, a case has been described by way of example in which the method of selecting a second layer encoding quantization target band is to select the region for which the energy of a residual component of a first layer MDCT coefficient and second layer MDCT coefficient is highest, but the present invention is not limited to this, and the region for which the first layer MDCT coefficient energy is highest may also be selected. For example, the energy of each first layer MDCT coefficient subband may be calculated, after which the energies of each subband are added together on a region-by-region basis, and the region for which energy is highest is selected as a second layer encoding quantization target band. On the decoding apparatus side, the region for which energy is highest among the regions of the first layer decoded MDCT coefficient obtained by first layer decoding is selected as a second layer decoding dequantization target band. By this means the coding bit rate can be reduced, since band information relating to a second layer encoding quantization band is not transmitted from the encoding apparatus side.

In this embodiment, a case has been described by way of example in which second layer encoding section 308 selects and performs quantization on a quantization target band for a residual component of a first layer MDCT coefficient and second layer MDCT coefficient, but the present invention is not limited to this, and second layer encoding section 308 may also predict a second layer MDCT coefficient from a first layer MDCT coefficient, and select and perform quantization on a quantization target band for a residual component of that predicted MDCT coefficient and an actual second layer MDCT coefficient. This enables encoding efficiency to be further improved by utilizing a correlation between a first layer MDCT coefficient and second layer MDCT coefficient.

(Embodiment 3)

Figure 10:
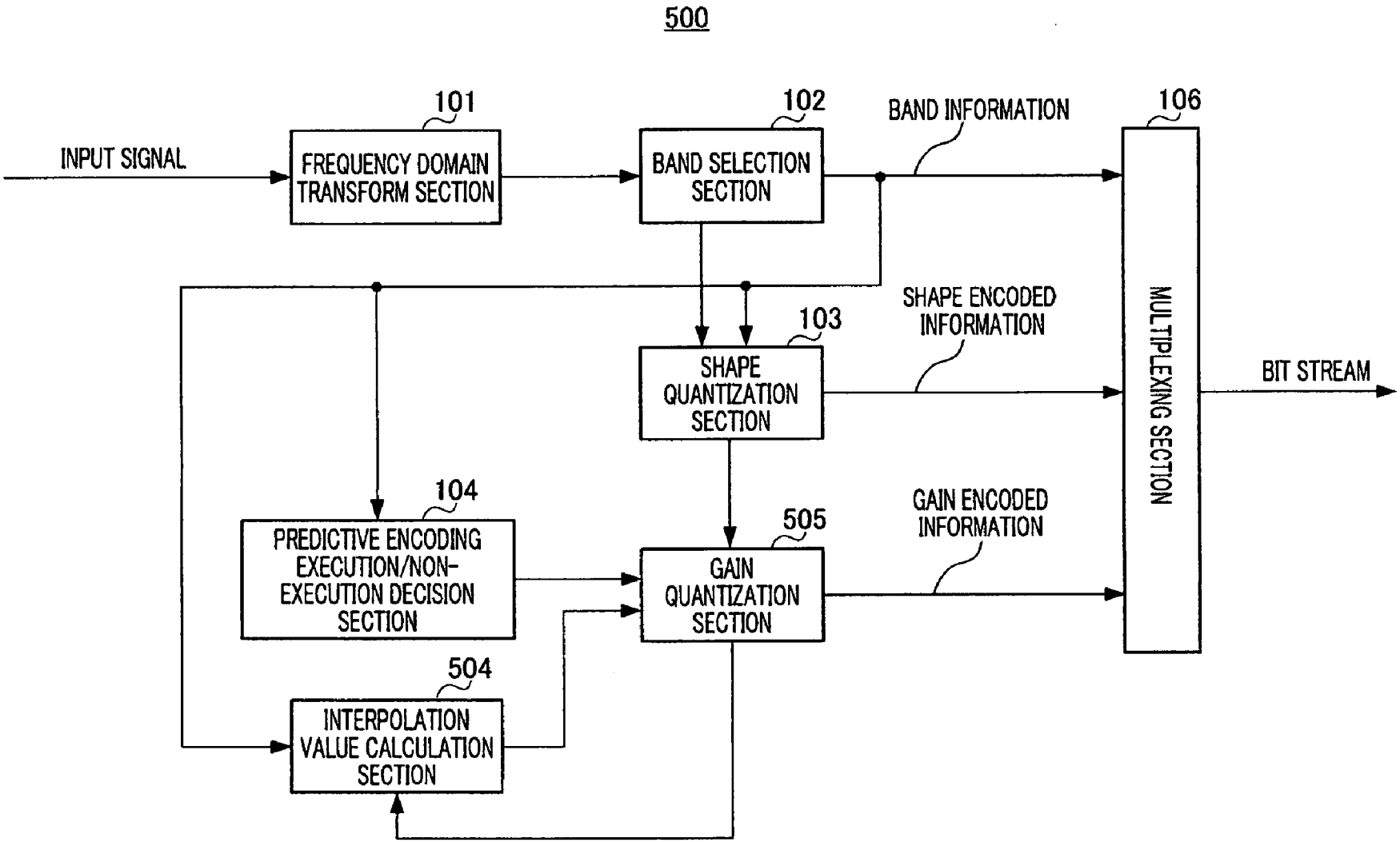
FIG. 10 is a block diagram showing the main configuration of a speech encoding apparatus according to Embodiment 3 of the present invention.

FIG. 10 is a block diagram showing the main configuration of speech encoding apparatus 500 according to Embodiment 3 of the present invention. Speech encoding apparatus 500 has a similar basic configuration to that of speech encoding apparatus 100 shown in FIG. 1, and therefore identical configuration elements are assigned the same reference codes and descriptions thereof are omitted here.

Speech encoding apparatus 500 differs from speech encoding apparatus 100 in being further equipped with interpolation value calculation section 504. Also, processing differs in part between gain quantization section 505 of speech encoding apparatus 500 and gain quantization section 105 of speech encoding apparatus 100, and a different reference code is assigned to indicate this.

Interpolation value calculation section 504 has an internal buffer that stores band information indicating a quantization target band of a past frame. Using a quantization gain value of a quantization target band of a past frame read from gain quantization section 505, interpolation value calculation section 504 interpolates a gain value of a band that was not quantized in a past frame among current-frame quantization target bands indicated by band information input from band selection section 102. Interpolation value calculation section 504 outputs an obtained gain interpolation value to gain quantization section 505.

Gain quantization section 505 differs from gain quantization section 105 of speech encoding apparatus 100 in using a gain interpolation value input from interpolation value calculation section 504 in addition to a past-frame quantization gain value stored in an internal buffer and an internal gain codebook when performing predictive encoding.

The gain value interpolation method used by interpolation value calculation section 504 will now be described in detail.

Interpolation value calculation section 504 has an internal buffer that stores band information m_max input from band selection section 102 in a past frame. Here, a case will be described by way of example in which an internal buffer is provided that stores band information m_max for the past three frames.

Interpolation value calculation section 504 first calculates a gain value of other than a band indicated by band information m_max for the past three frames by performing linear interpolation. An interpolation value is calculated in accordance with Equation (19) for a gain value of a lower band than the band indicated by band information m_max, and an interpolation value is calculated in accordance with Equation (20) for a gain value of a higher band than the band indicated by band information m_max.

$$\beta_0 \cdot q_0 + \beta_1 \cdot q_1 + \beta_2 \cdot q_2 + \beta_3 \cdot g = 0 \quad \text{(Equation 19)}$$

$$\beta_0' \cdot q_0 + \beta_1' \cdot q_1 + \beta_2' \cdot q_2 + \beta_3' \cdot g = 0 \quad \text{(Equation 20)}$$

In Equation (19) and Equation (20), $\beta_i$ indicates an interpolation coefficient, $q_i$ indicates a gain value of a quantization target band indicated by band information m_max of a past frame, and g indicates a gain interpolation value of an unquantized band adjacent to a quantization target band indicated by band information m_max of a past frame. Here, a lower value of i indicates a proportionally lower-frequency band, and in Equation (19) g indicates a gain interpolation value of an adjacent band on the high-band side of a quantization target band indicated by band information m_max of a past frame, while in Equation (20) g indicates a gain interpolation value of an adjacent band on the low-band side of a quantization target band indicated by band information m_max of a past frame. For interpolation coefficient $\beta_i$, a value is assumed to be used that has been found beforehand statistically so as to satisfy Equation (19) and Equation (20). Here, a case is described in which different interpolation coefficients $\beta_i$ are used in Equation (19) and Equation (20), but a similar set of prediction coefficients $\alpha_i$ may also be used in Equation (19) and Equation (20).

As shown in Equation (19) and Equation (20), it is possible to interpolate a gain value of one band on the high-band side or the low-band side adjacent to a quantization target band indicated by past-frame band information m_max of a past frame in interpolation value calculation section 504. Interpolation value calculation section 504 successively interpolates gain values of adjacent unquantized bands by repeating the operations in Equation (19) and Equation (20) using the results obtained from Equation (19) and Equation (20).

In this way, interpolation value calculation section 504 interpolates gain values of bands other than a band indicated by band information m_max of the past three frames among current-frame quantization target bands indicated by band information input from band selection section 102, using quantized gain values of the past three frames read from gain quantization section 505.

Next, a predictive encoding operation in gain quantization section 505 will be described.

Gain quantization section 505 performs quantization by predicting a current-frame gain value using a stored past-frame quantization gain value, again interpolation value input from interpolation value calculation section 504, and an internal gain codebook. Specifically, gain quantization section 505 searches an internal gain codebook composed of quantity GQ of gain code vectors for each of L subbands, and finds an index of a gain code vector for which the result of Equation (21) below is a minimum.

$$\text{Gain_q}(i) = \sum_{j=0}^{L-1}\left\{\text{Gain_i}(j+j'') - \sum_{t=1}^{3}\left(\alpha_t \cdot C^t_{j+j''}\right) - \alpha_0 \cdot GC^i_j\right\}^2 \quad (i = 0, \ldots, GQ-1) \tag{Equation 21}$$

In Equation (21), $GC^i_j$ indicates again code vector composing a gain codebook, i indicates a gain code vector index, and j indicates an index of a gain code vector element. Here, $C^t_j$ indicates a quantization gain value of t frames before in time, so that when t=1, for example, $C^t_j$ indicates a quantization gain value of one frame before in time. Also, $\alpha$ is a 4th-order linear prediction coefficient stored in gain quantization section 505. A gain interpolation value calculated in accordance with Equation (19) and Equation (20) by interpolation value calculation section 504 is used as a gain value of a band not selected as a quantization target band in the past three frames. Gain quantization section 505 treats L subbands within one region as an L-dimensional vector, and performs vector quantization.

Gain quantization section 505 outputs gain code vector index G_min for which the result of Equation (21) above is a minimum to multiplexing section 106 as gain encoded information. Gain quantization section 505 also updates the internal buffer in accordance with Equation (22) below using gain encoded information G_min and quantization gain value $C^t_j$ obtained in the current frame.

$$\begin{cases} C^3_{j+j''} = C^2_{j+j''} \\ C^2_{j+j''} = C^1_{j+j''} \quad (j = 0, \ldots, L-1) \\ C^1_{j+j''} = GC^{G_min}_j \end{cases} \tag{Equation 22}$$

Figure 11:
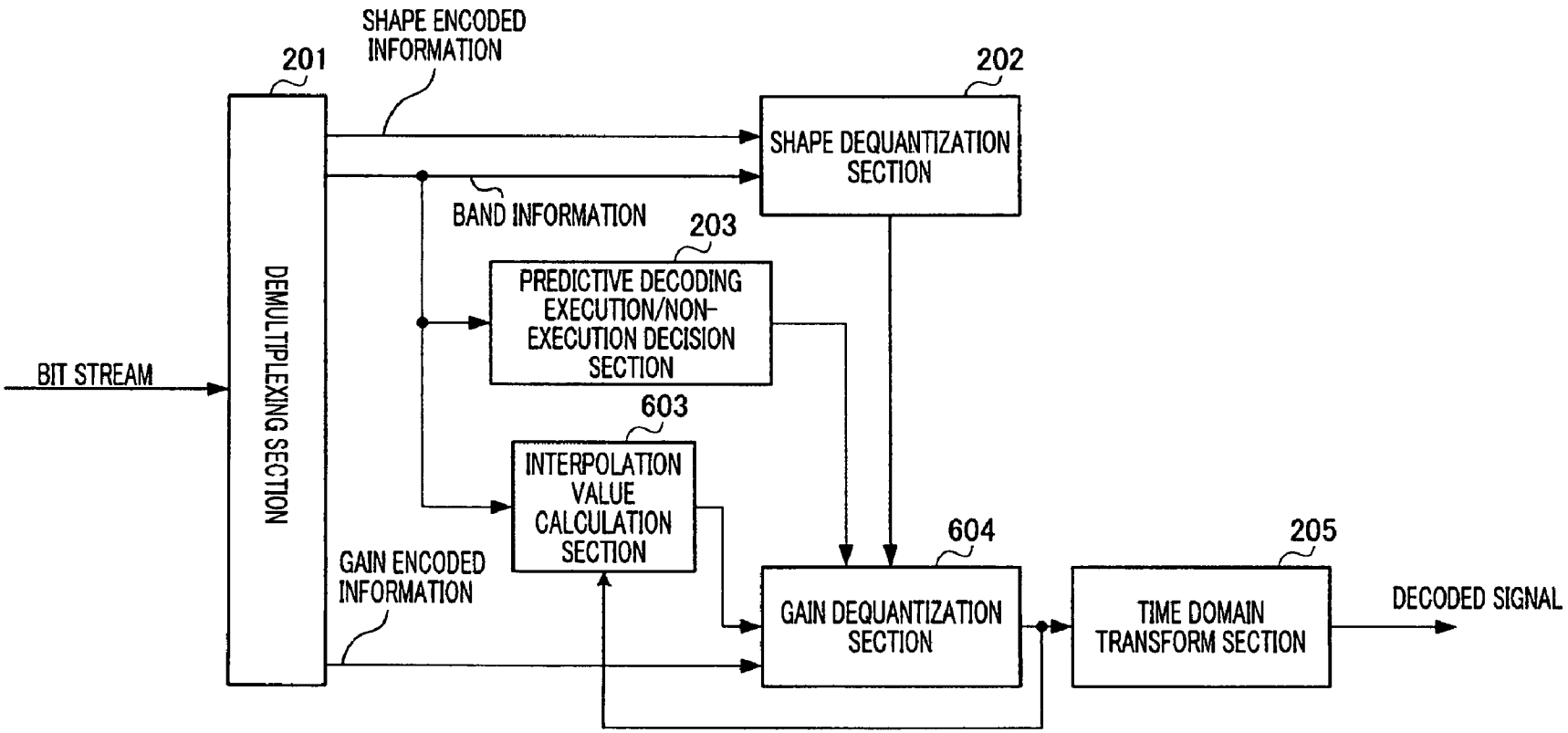
FIG. 11 is a block diagram showing the main configuration of a speech decoding apparatus according to Embodiment 3 of the present invention.

FIG. 11 is a block diagram showing the main configuration of speech decoding apparatus 600 according to Embodiment 3 of the present invention. Speech decoding apparatus 600 has a similar basic configuration to that of speech decoding apparatus 200 shown in FIG. 3, and therefore identical configuration elements are assigned the same reference codes and descriptions thereof are omitted here.

Speech decoding apparatus 600 differs from speech decoding apparatus 200 in being further equipped with interpolation value calculation section 603. Also, processing differs in part between gain dequantization section 604 of speech decoding apparatus 600 and gain dequantization section 204 of speech decoding apparatus 200, and a different reference code is assigned to indicate this.

Interpolation value calculation section 603 has an internal buffer that stores band information indicating band information dequantized in a past frame. Using a gain value of a band dequantized in a past frame read from gain dequantization section 604, interpolation value calculation section 603 interpolates a gain value of a band that was not dequantized in a past frame among current-frame quantization target bands indicated by band information input from demultiplexing section 201. Interpolation value calculation section 603 outputs an obtained gain interpolation value to gain dequantization section 604.

Gain dequantization section 604 differs from gain dequantization section 204 of speech decoding apparatus 200 in using a gain interpolation value input from interpolation value calculation section 603 in addition to a stored past-frame dequantized gain value and an internal gain codebook when performing predictive encoding.

The gain value interpolation method used by interpolation value calculation section 603 is similar to the gain value interpolation method used by interpolation value calculation section 504, and therefore a detailed description thereof is omitted here.

Next, a predictive decoding operation in gain dequantization section 604 will be described.

Gain dequantization section 604 performs dequantization by predicting a current-frame gain value using a stored gain value dequantized in a past frame, an interpolation gain value input from interpolation value calculation section 603, and an internal gain codebook. Specifically, gain dequantization section 604 obtains gain value Gain_q' by performing gain dequantization in accordance with Equation (23) below.

$$\text{Gain_q}'(j+j'') = \sum_{t=1}^{3}\left(\alpha_t \cdot C''^t_{j+j''}\right) + \alpha_0 \cdot GC^{G_min}_j \quad (j = 0, \ldots, L-1) \tag{Equation 23}$$

In Equation (23), $C''^t_j$ indicates a gain value of t frames before in time, so that when t=1, for example, $C''^t_j$ indicates a gain value of one frame before. Also, $\alpha$ is a 4th-order linear prediction coefficient stored in gain dequantization section 604. Again interpolation value calculated by interpolation value calculation section 603 is used as a gain value of a band not selected as a quantization target in the past three frames.

Gain dequantization section 604 treats L subbands within one region as an L-dimensional vector, and performs vector dequantization.

Next, gain dequantization section 604 calculates a decoded MDCT coefficient in accordance with Equation (24) below using a gain value obtained by current-frame dequantization and a shape value input from shape dequantization section 202, and updates the internal buffer in accordance with Equation (25) below. Here, a calculated decoded MDCT coefficient is denoted by $X''_k$. Also, in MDCT coefficient dequantization, if k is present within B(j") through B(j"+1)−1, gain value Gain_q' (j) takes the value of Gain_q' (j").

$$X''_k = \text{Gain_q}'(j)\cdot\text{Shape_q}'(k)\begin{pmatrix} k = B(j''), \ldots, B(j''+1)-1 \\ j = j'', \ldots, j''+L-1 \end{pmatrix} \quad \text{(Equation 24)}$$

$$\begin{cases} C''^3_j = C''^2_j \\ C''^2_j = C''^1_j \qquad (j = j'', \ldots, j''+L-1) \\ C''^1_j = \text{Gain_q}''(j) \end{cases} \quad \text{(Equation 25)}$$

Thus, according to this embodiment, when performing frequency domain parameter quantization of a different quantization target band of each frame, values of adjacent unquantized bands are successively interpolated from a quantized value in a past frame, and predictive quantization is performed using an interpolation value. Consequently, the encoding precision of speech encoding can be further improved.

In this embodiment, a case has been described by way of example in which a fixed interpolation coefficient β found beforehand is used when calculating a gain interpolation value, but the present invention is not limited to this, and interpolation may also be performed after adjusting previously found interpolation coefficient β. For example, a predict ion coefficient may be adjusted according to the distribution of gain of a band quantized in each frame. Specifically, it is possible to improve the encoding precision of speech encoding by performing adjustment so that a prediction coefficient is weakened and the weight of current-frame gain is increased when variation in gain quantized in each frame is large.

In this embodiment, a case has been described by way of example in which a consecutive plurality of bands (one region) comprising a band quantized in each frame is made a target, but the present invention is not limited to this, and a plurality of regions may also be made a quantization target. In such a case, it is possible to improve the encoding precision of speech encoding by employing a method whereby linear prediction of end values of the respective regions is performed for a band between selected regions in addition to the interpolation method according to Equation (19) and Equation (20).

(Embodiment 4)

Figure 12:
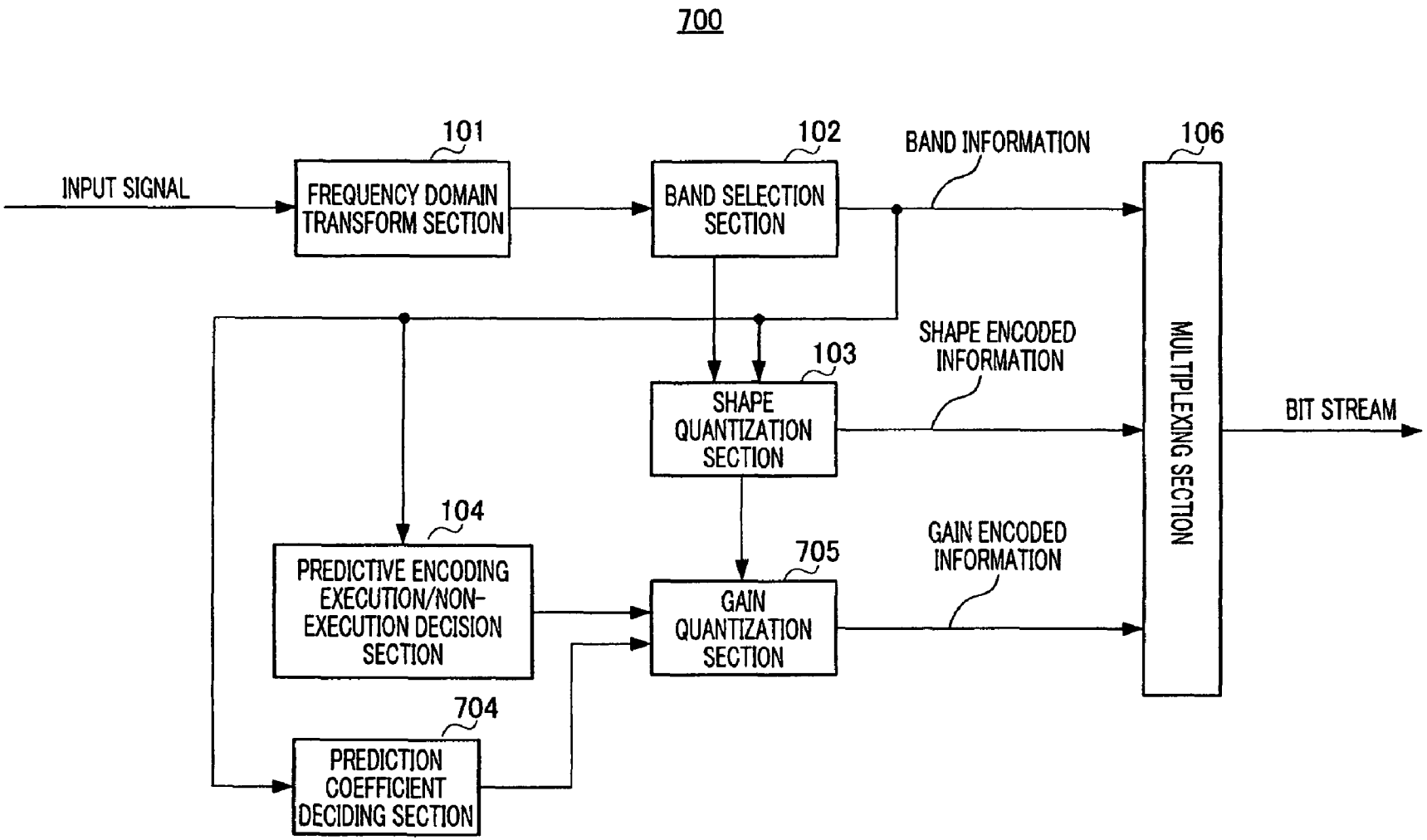
FIG. 12 is a block diagram showing the main configuration of a speech encoding apparatus according to Embodiment 4 of the present invention.

FIG. 12 is a block diagram showing the main configuration of speech encoding apparatus 700 according to Embodiment 4 of the present invention. Speech encoding apparatus 700 has a similar basic configuration to that of speech encoding apparatus 100 shown in FIG. 1, and therefore identical configuration elements are assigned the same reference codes and descriptions thereof are omitted here.

Speech encoding apparatus 700 differs from speech encoding apparatus 100 in being further equipped with prediction coefficient deciding section 704. Also, processing differs in part between gain quantization section 705 of speech encoding apparatus 700 and gain quantization section 105 of speech encoding apparatus 100, and a different reference code is assigned to indicate this.

Prediction coefficient deciding section 704 has an internal buffer that stores band information indicating a quantization target band of a past frame, decides a prediction coefficient to be used in gain quantization section 705 quantization based on past-frame band information, and outputs a decided prediction coefficient to gain quantization section 705.

Gain quantization section 705 differs from gain quantization section 105 of speech encoding apparatus 100 in using a prediction coefficient input from prediction coefficient deciding section 704 instead of a prediction coefficient' decided beforehand when performing predictive encoding.

A prediction coefficient deciding operation in prediction coefficient deciding section 704 will now be described.

Prediction coefficient deciding section 704 has an internal buffer that stores band information m_max input from band selection section 102 in a past frame. Here, a case will be described by way of example in which an internal buffer is provided that stores band information m_max for the past three frames.

Using band information m_max stored in the internal buffer and band information m_max input from band selection section 102 in the current frame, prediction coefficient deciding section 704 finds a number of subbands common to a current-frame quantization target band and past-frame quantization target band. Prediction coefficient deciding section 704 decides prediction coefficients to be set A and outputs this to gain quantization section 705 if the number of common subbands is greater than or equal to a predetermined value, or decides prediction coefficients to be set B and outputs this to gain quantization section 705 if the number of common subbands is less than the predetermined value. Here, prediction coefficient set A is a parameter set that emphasizes a past-frame value more, and makes the weight of a past-frame gain value larger, than in the case of prediction coefficient set B. For example, in the case of 4th-order prediction coefficients, it is possible for set A to be decided as (αa0=0.60, αa1=0.25, αa2=0.10, αa3=0.05), and for set B to be decided as (αb0=0.80, αb1=0.10, αb2=0.05, αb3=0.05).

Then prediction coefficient deciding section 704 updates the internal buffer using band information m_max input from band selection section 102 in the current frame.

Next, a predictive encoding operation in gain quantization section 705 will be described.

Gain quantization section 705 has an internal buffer that stores a quantization gain value obtained in a past frame. Gain quantization section 705 performs quantization by predicting a current-frame gain value using a prediction coefficient input from prediction coefficient deciding section 704 and past-frame quantization gain value $C'_j$ stored in the internal buffer. Specifically, gain quantization section 705 searches an internal gain codebook composed of quantity GQ of gain code vectors for each of L subbands, and finds an index of a gain code vector for which the result of Equation (26) below is a minimum if a prediction coefficient is set A, or finds an index of a gain code vector for which the result of Equation (27) below is a minimum if a prediction coefficient is set B.

$$\text{Gain_q}(i) = \sum_{j=0}^{L-1}\left\{\text{Gain_i}(j+j'') - \sum_{t=1}^{3}\left(\alpha a_t \cdot C^t_{j+j''}\right) - \alpha a_0 \cdot GC^i_j\right\}^2 \quad (i = 0, \ldots, GQ-1) \tag{Equation 26}$$

$$\text{Gain_q}(i) = \sum_{j=0}^{L-1}\left\{\text{Gain_i}(j+j'') - \sum_{t=1}^{3}\left(\alpha b_t \cdot C^t_{j+j''}\right) - \alpha b_0 \cdot GC^i_j\right\}^2 \quad (i = 0, \ldots, GQ-1) \tag{Equation 27}$$

In Equation (26) and Equation (27), $GC^i_j$ indicates a gain code vector composing a gain codebook, i indicates a gain code vector index, and j indicates an index of a gain code vector element. Here, $C^t_j$ indicates a gain value of t frames before in time, so that when t=1, for example, $C^t_j$ indicates a gain value of one frame before in time. Also, α is a 4th-order linear prediction coefficient stored in gain quantization section 705. Gain quantization section 705 treats L subbands within one region as an L-dimensional vector, and performs vector quantization. If there is no gain value of a subband corresponding to a past frame in the internal buffer, gain quantization section 705 substitutes the gain value of the nearest subband in frequency in the internal buffer in Equation (26) or Equation (27) above.

Figure 13:
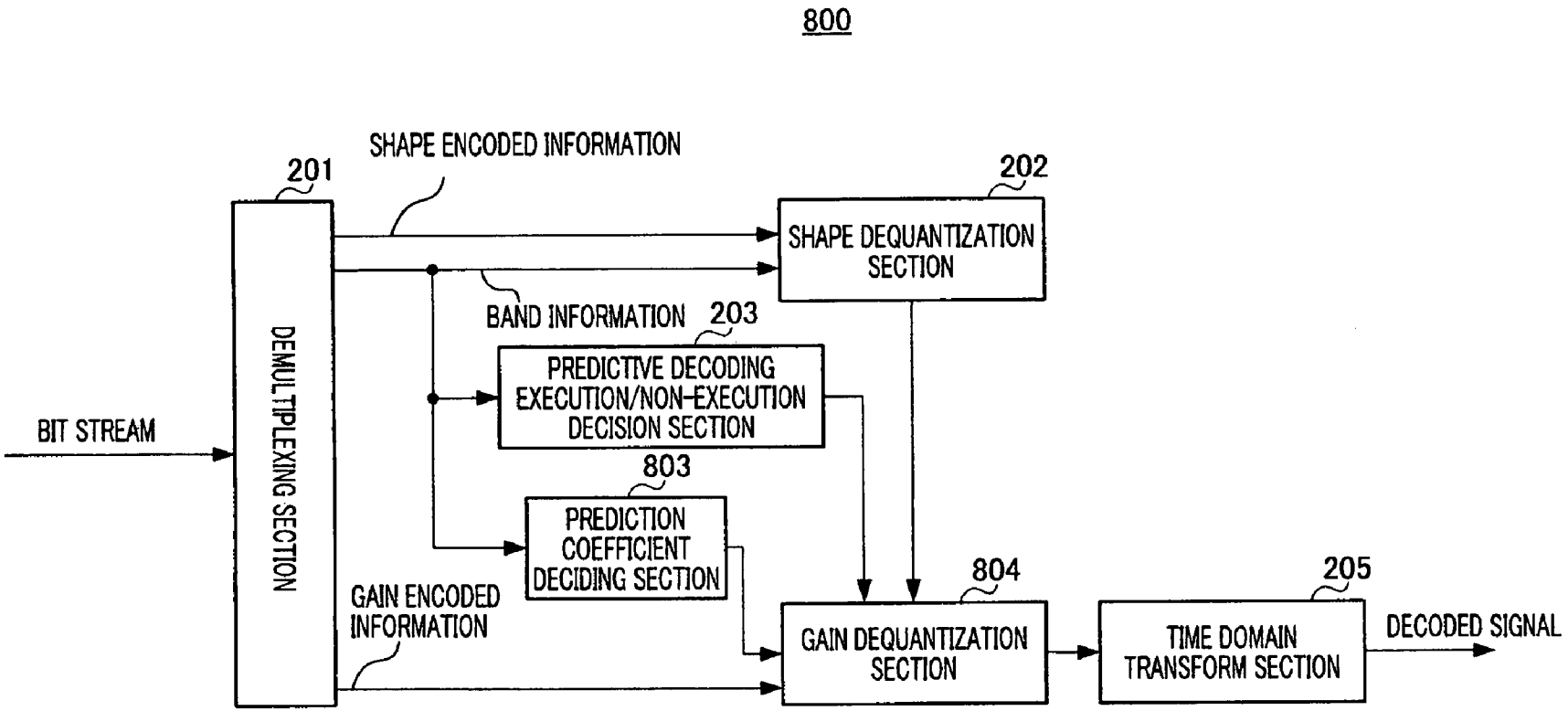
FIG. 13 is a block diagram showing the main configuration of a speech decoding apparatus according to Embodiment 4 of the present invention.

FIG. 13 is a block diagram showing the main configuration of speech decoding apparatus 800 according to Embodiment 4 of the present invention. Speech decoding apparatus 800 has a similar basic configuration to that of speech decoding apparatus 200 shown in FIG. 3, and therefore identical configuration elements are assigned the same reference codes and descriptions thereof are omitted here.

Speech decoding apparatus 800 differs from speech decoding apparatus 200 in being further equipped with prediction coefficient deciding section 803. Also, processing differs in part between gain dequantization section 804 of speech decoding apparatus 800 and gain dequantization section 204 of speech decoding apparatus 200, and a different reference code is assigned to indicate this.

Prediction coefficient deciding section 803 has an internal buffer that stores band information input from demultiplexing section 201 in a past frame, decides a predict ion coefficient to be used in gain dequantization section 804 quantization based on past-frame band information, and outputs a decided prediction coefficient to gain dequantization section 804.

Gain dequantization section 804 differs from gain dequantization section 204 of speech decoding apparatus 200 in using a prediction coefficient input from prediction coefficient deciding section 803 instead of a prediction coefficient decided beforehand when performing predictive decoding.

The prediction coefficient deciding method used by prediction coefficient deciding section 803 is similar to the prediction coefficient deciding method used by prediction coefficient deciding section 704 of speech encoding apparatus 700, and therefore a detailed description of the operation of prediction coefficient deciding section 803 operation is omitted here.

Next, a predictive decoding operation in gain dequantization section 804 will be described.

Gain dequantization section 804 has an internal buffer that stores a gain value obtained in a past frame. Gain dequantization section 804 performs dequantization by predicting a current-frame gain value using a prediction coefficient input from predict ion coefficient deciding section 803 and a past-frame gain value stored in the internal buffer. Specifically, gain dequantization section 804 has the same kind of internal gain codebook as gain quantization section 705 of speech encoding apparatus 700, and obtains gain value Gain_q' by performing gain dequantization in accordance with Equation (28) below if a prediction coefficient input from prediction coefficient deciding section 803 is set A, or in accordance with Equation (29) below if the prediction coefficient is set B.

$$\text{Gain_q}'(j+j'') = \sum_{t=1}^{3}\left(\alpha a_t \cdot C''^t_{j+j''}\right) + \alpha a_0 \cdot GC^{G_min}_j \quad (j = 0, \ldots, L-1) \tag{Equation 28}$$

$$\text{Gain_q}'(j+j'') = \sum_{t=1}^{3}\left(\alpha b_t \cdot C''^t_{j+j''}\right) + \alpha b_0 \cdot GC^{G_min}_j \quad (j = 0, \ldots, L-1) \tag{Equation 29}$$

In Equation (28) and Equation (29), $C''^t_j$ indicates a gain value of t frames before in time, so that when t=1, for example, $C''^t_j$ indicates a gain value of one frame before. Also, $\alpha a_i$ and $\alpha b_i$ indicate prediction coefficient set A and set B input from prediction coefficient deciding section 803. Gain dequantization section 804 treats L subbands within one region as an L-dimensional vector, and performs vector dequantization.

Thus, according to this embodiment, when performing frequency domain parameter quantization of a different quantization target band of each frame, predictive encoding is performed by selecting, from a plurality of prediction coefficient sets, a prediction coefficient set that makes the weight of a past-frame gain value proportionally larger the greater the number of subbands common to a past-frame quantization target band and current-frame quantization target band. Consequently, the encoding precision of speech encoding can be further improved.

In this embodiment, a case has been described by way of example in which two kinds of prediction coefficient sets are provided beforehand, and a prediction coefficient used in predictive encoding is switched according to the number of subbands common to a past-frame quantization target band and current-frame quantization target band, but the present invention is not limited to this, and three or more kinds of prediction coefficient sets may also be provided beforehand.

In this embodiment, a case has been described by way of example in which, if a quantization target band in the current frame has not been quantized in a past frame, the value of the closest band in a past frame is substituted, but the present invention is not limited to this, and if a quantization target band value in the current frame has not been quantized in a past frame, predictive encoding may also be performed by taking the relevant past-frame prediction coefficient as zero, adding a prediction coefficient of that frame to a current-frame prediction coefficient, calculating a new prediction coefficient set, and using those prediction coefficients. By this means, the effect of predictive encoding can be switched more flexibly, and the encoding precision of speech encoding can be further improved.

(Embodiment 5)

Figure 14:
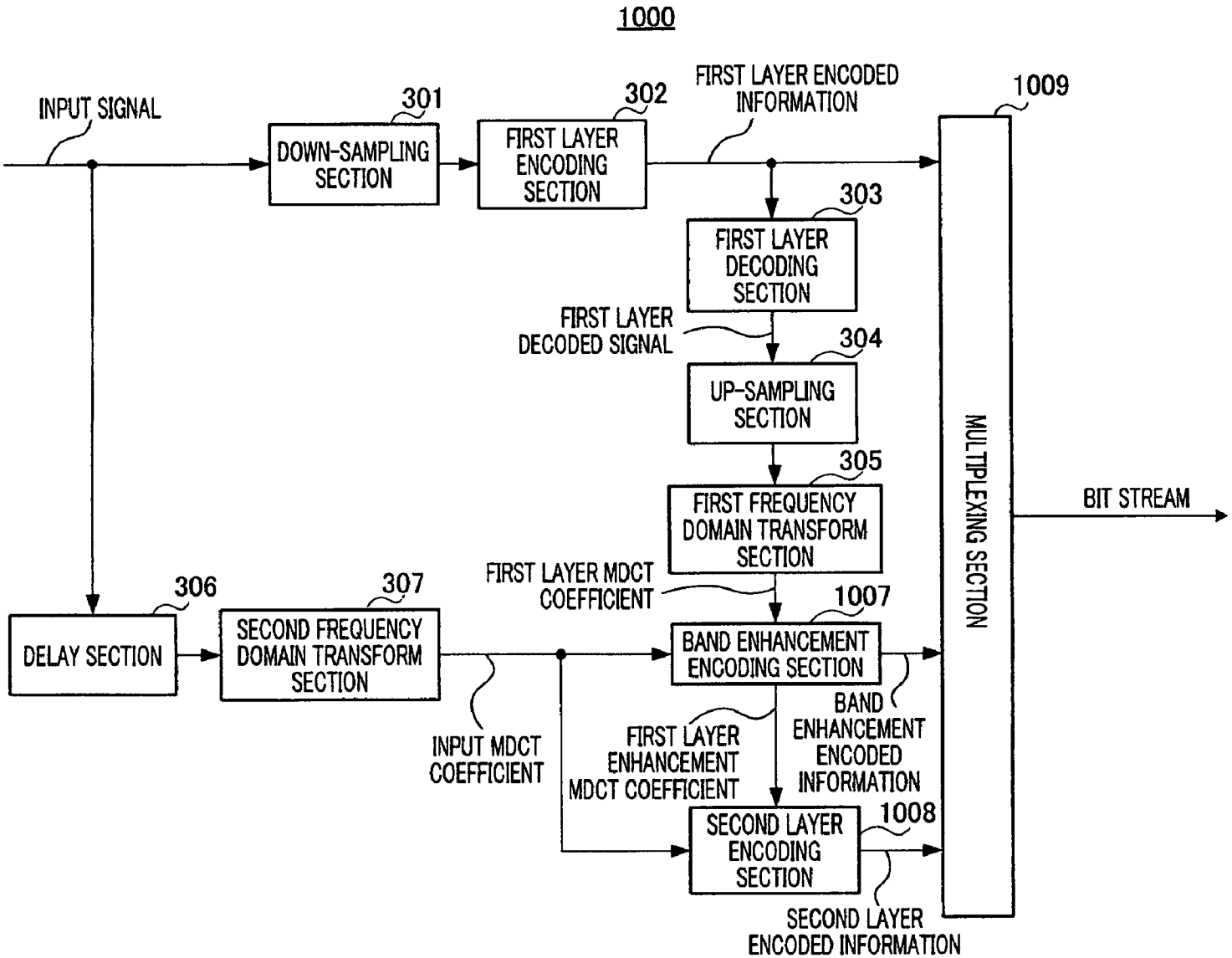
FIG. 14 is a block diagram showing the main configuration of a speech encoding apparatus according to Embodiment 5 of the present invention.

FIG. 14 is a block diagram showing the main configuration of speech encoding apparatus 1000 according to Embodiment 5 of the present invention. Speech encoding apparatus 1000 has a similar basic configuration to that of speech encoding apparatus 300 shown in FIG. 6, and therefore identical configuration elements are assigned the same reference codes and descriptions thereof are omitted here.

Speech encoding apparatus 1000 differs from speech encoding apparatus 300 in being further equipped with band enhancement encoding section 1007. Also, processing differs in part between second layer encoding section 1008 and multiplexing section 1009 of speech encoding apparatus 1000 and second layer encoding section 308 and multiplexing section 309 of speech encoding apparatus 300, and different reference codes are assigned to indicate this.

Band enhancement encoding section 1007 performs band enhancement encoding using a first layer MDCT coefficient input from first frequency domain transform section 305 and an input MDCT coefficient input from second frequency domain transform section 307, and outputs obtained band enhancement encoded information to multiplexing section 1009.

Multiplexing section 1009 differs from multiplexing section 309 only in also multiplexing band enhancement encoded information in addition to first layer encoded information and second layer encoded information.

Figure 15:
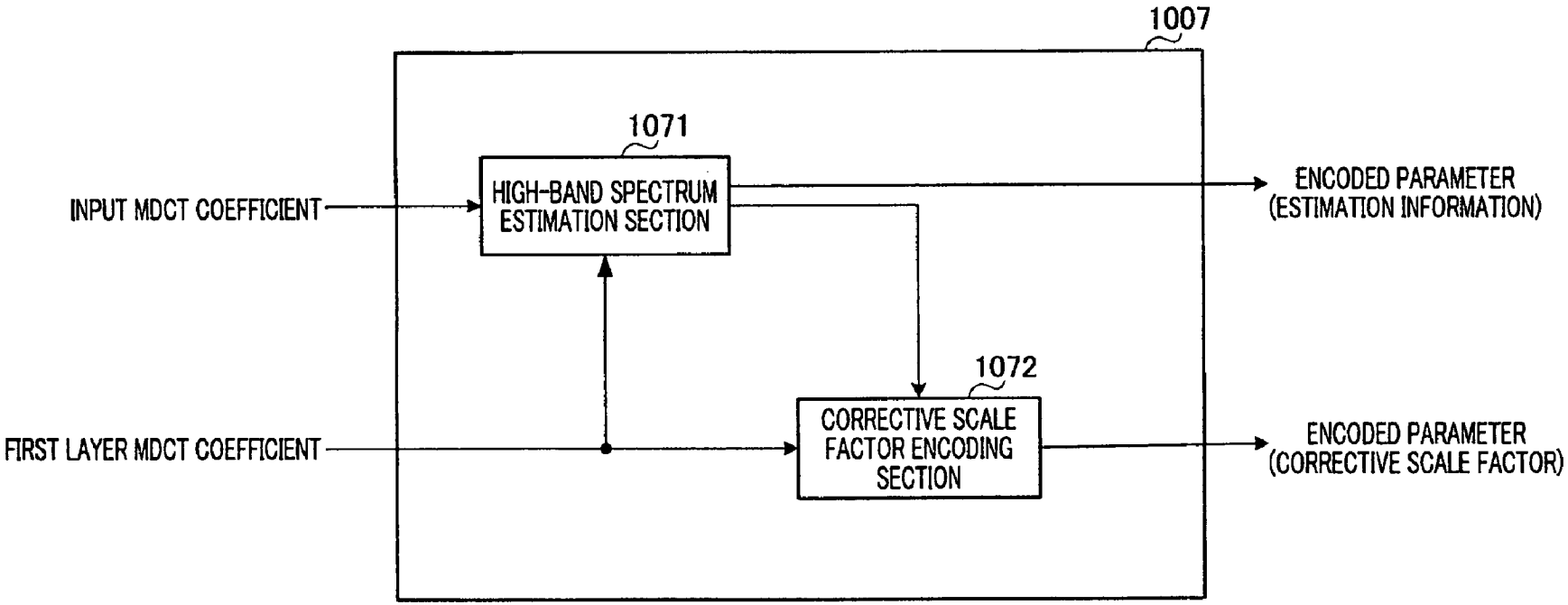
FIG. 15 is a block diagram showing the main configuration of the interior of a band enhancement encoding section according to Embodiment 5 of the present invention.

FIG. 15 is a block diagram showing the main configuration of the interior of band enhancement encoding section 1007.

In FIG. 15, band enhancement encoding section 1007 is equipped with high-band spectrum estimation section 1071 and corrective scale factor encoding section 1072.

High-band spectrum estimation section 1071 estimates a high-band spectrum of signal bands FL through FH using a low-band spectrum of signal bands 0 through FL of an input MDCT coefficient input from second frequency domain transform section 307, to obtain an estimated spectrum. The estimated spectrum derivation method is to find an estimated spectrum such that the degree of similarity with the high-band spectrum becomes a maximum by transforming the low-band spectrum based on this low-band spectrum. High-band spectrum estimation section 1071 encodes information relating to this estimated spectrum (estimation information), outputs an obtained encoding parameter, and also provides the estimated spectrum itself to corrective scale factor encoding section 1072.

In the following description, an estimated spectrum output from high-band spectrum estimation section 1071 is called a first spectrum, and a first layer MDCT coefficient (high-band spectrum) output from first frequency domain transform section 305 is called a second spectrum.

The above-described kinds of spectra and corresponding signal bands can be summarized as follows.

| | |
|---|---|
| Narrowband spectrum (low-band spectrum) | 0 through FL |
| Wideband spectrum | 0 through FH |
| First spectrum (estimated spectrum) | FL through FH |
| Second spectrum (high-band spectrum) | FL through FH |

Corrective scale factor encoding section 1072 corrects a first spectrum scale factor so that the first spectrum scale factor approaches a second spectrum scale factor, and encodes and outputs information relating to this corrective scale factor.

Band enhancement encoded information output from band enhancement encoding section 1007 to multiplexing section 1009 includes an estimation information encoding parameter output from high-band spectrum estimation section 1071 and a corrective scale factor encoding parameter output from corrective scale factor encoding section 1072.

Figure 16:
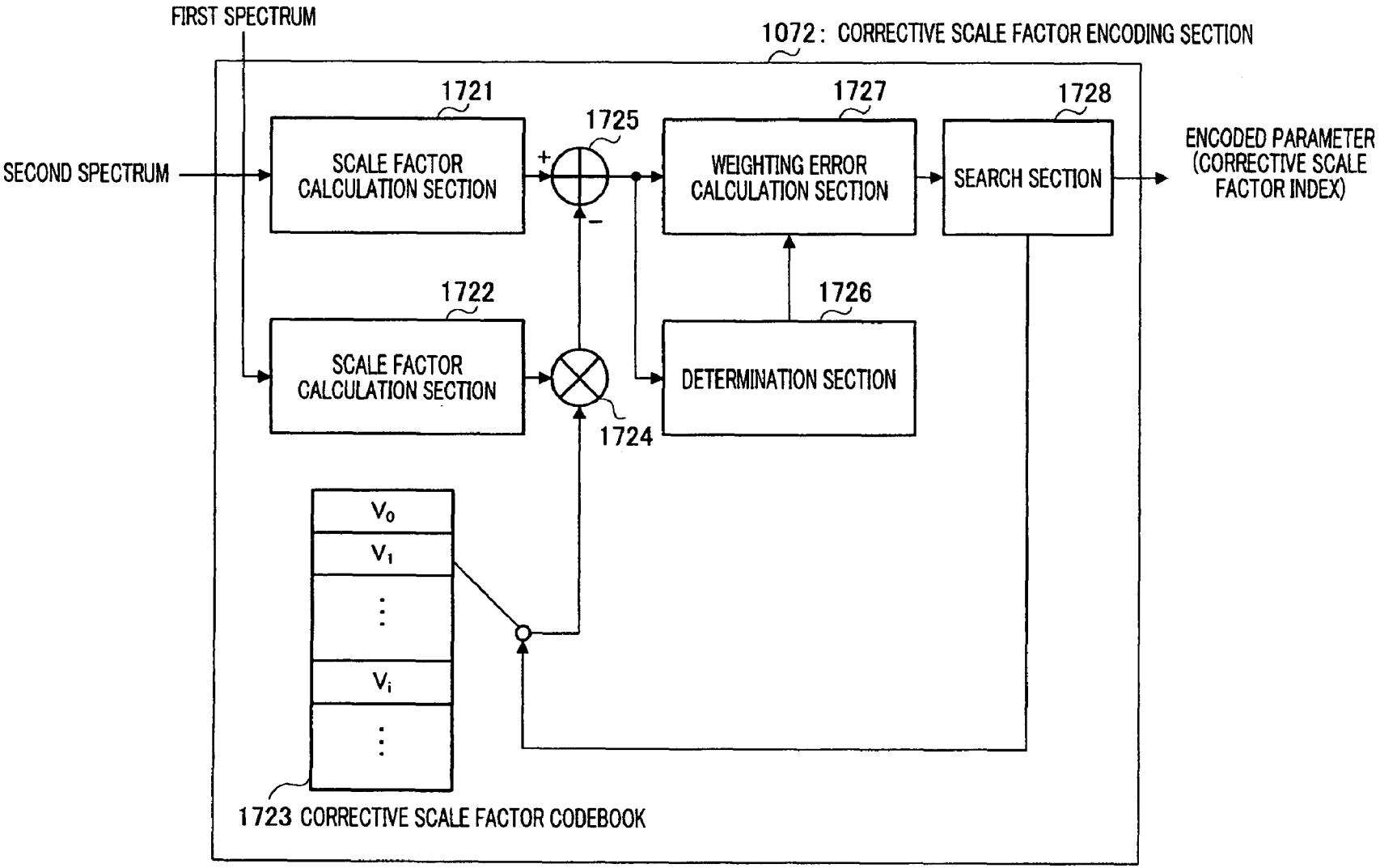
FIG. 16 is a block diagram showing the main configuration of the interior of a corrective scale factor encoding section according to Embodiment 5 of the present invention.

FIG. 16 is a block diagram showing the main configuration of the interior of corrective scale factor encoding section 1072.

Corrective scale factor encoding section 1072 is equipped with scale factor calculation sections 1721 and 1722, corrective scale factor codebook 1723, multiplier 1724, subtracter 1725, determination section 1726, weighting error calculation section 1727, and search section 1728. These sections perform the following operations.

Scale factor calculation section 1721 divides input second spectrum signal bands FL through FH into a plurality of subbands, finds the size of a spectrum included in each subband, and outputs this to subtracter 1725. Specifically, division into subbands is performed associated with a critical band, and division is performed into equal intervals on the Bark scale. Also, scale factor calculation section 1721 finds the average amplitude of spectra included in the subbands, and takes this as second scale factor SF2($k$) $\{0 \leqq k < NB\}$, where NB represents the number of subbands. A maximum amplitude value or the like may be used instead of an average amplitude.

Scale factor calculation section 1722 divides input first spectrum signal bands FL through FH into a plurality of subbands, calculates first scale factor SF1($k$) $\{0 \leqq k < NB\}$ of the subbands, and outputs this to multiplier 1724. As with scale factor calculation section 1721, a maximum amplitude value or the like may be used instead of an average amplitude.

In the subsequent processing, parameters in the plurality of subbands are integrated into one vector value. For example, quantity NB of scale factors are represented as one vector. A description will be given taking a case in which each processing operation is performed for each of these vectors—that is, a case in which vector quantization is performed—as an example.

Corrective scale factor codebook 1723 stores a plurality of corrective scale factor candidates, and sequentially outputs one of the stored corrective scale factor candidates to multiplier 1724 in accordance with a directive from search section 1728. The plurality of corrective scale factor candidates stored in corrective scale factor codebook 1723 are represented by a vector.

Multiplier 1724 multiplies a first scale factor output from scale factor calculation section 1722 by a corrective scale factor candidate output from corrective scale factor codebook 1723, and provides the multiplication result to subtracter 1725.

Subtracter 1725 subtracts multiplier 1724 output—that is, the product of the first scale factor and corrective scale factor—from the second scale factor output from scale factor calculation section 1721, and provides an error signal thereby obtained to weighting error calculation section 1727 and determination section 1726.

Determination section 1726 decides a weighting vector to be provided to weighting error calculation section 1727 based on the sign of the error signal provided from subtracter 1725. Specifically, error signal d(k) provided from subtracter 1725 is represented by Equation (30) below.

$$d(k)=SF2(k)-v_i(k)\cdot SF1(k)\ (0 \leqq k < NB) \quad \text{(Equation 30)}$$

Here, $v_i$ (k) represents an i'th corrective scale factor candidate. Determination section 1726 checks the sign of d(k), selects $w_{pos}$ as a weight if d(k) is positive, or selects $w_{neg}$ as a weight if d (k) is negative, and outputs weighting vector w(k) composed of these to weighting error calculation section 1727. These weights have the relative size relationship shown in Equation (31) below.

$$0<w_{pos}<w_{neg} \quad \text{(Equation 31)}$$

For example, if number of subbands NB=4, and the signs of d(k) are {+, −, −, +}, weighting vector w(k) output to weighting error calculation section 1727 is represented by w(k)= $\{w_{pos}, w_{neg}, w_{neg}, w_{pos}\}$.

Weighting error calculation section 1727 first calculates the square of the error signal provided from subtracter 1725, and then multiplies weighting vector w(k) provided from determination section 1726 by the square of the error signal to calculate weighted square error E, and provides the result of this calculation to search section 1728. Here, weighted square error E is represented as shown in Equation (32) below.

$$E = \sum_{k=0}^{NB-1} w(k) \cdot d(k)^2 \quad \text{(Equation 32)}$$

Search section 1728 controls corrective scale factor codebook 1723 and sequentially outputs stored corrective scale factor candidates, and by means of closed loop processing finds a corrective scale factor candidate for which weighted square error E output from weighting error calculation section 1727 is a minimum. Search section 1728 outputs index iopt of the found corrective scale factor candidate as an encoding parameter.

When a weight used when calculating weighted square error E is set according to the sign of an error signal and the kind of relationship shown in Equation (30) applies to that weight, as described above, the following kind of effect is obtained. Namely, a case in which error signal d(k) is positive is a case in which a decoded value generated on the decoding side (in terms of the encoding side, a value obtained by multiplying a first scale factor by a corrective scale factor) is smaller than a second scale factor, which is the target value. Also, a case in which error signal d(k) is negative is a case in which a decoded value generated on the decoding side is greater than a second scale factor, which is the target value. Therefore, by setting a weight when error signal d(k) is positive so as to be smaller than a weight when error signal d(k) is negative, when square error values are of the same order a corrective scale factor candidate that generates a decoded value smaller than a second scale factor becomes prone to be selected.

The following kind of improvement effect is obtained by band enhancement encoding section 1007 processing. For example, when a high-band spectrum is estimated using a low-band spectrum, as in this embodiment, a lower bit rate can generally be achieved. However, while a lower bit rate can be achieved, the precision of an estimated spectrum—that is, the similarity between an estimated spectrum and high-band spectrum—cannot be said to be sufficiently high, as described above. In such a case, if a scale factor decoded value becomes greater than a target value, and a post-quantization scale factor operates in the direction of strengthening an estimated spectrum, the low precision of the estimated spectrum tends to be perceptible to the human ear as quality degradation. Conversely, when a scale factor decoded value becomes smaller than a target value, and a post-quantization scale factor operates in the direction of attenuating this estimated spectrum, low precision of the estimated spectrum ceases to be noticeable, and an effect of improving the audio quality of the decoded signal is obtained. This tendency has also been confirmed in a computer simulation.

Figure 17:
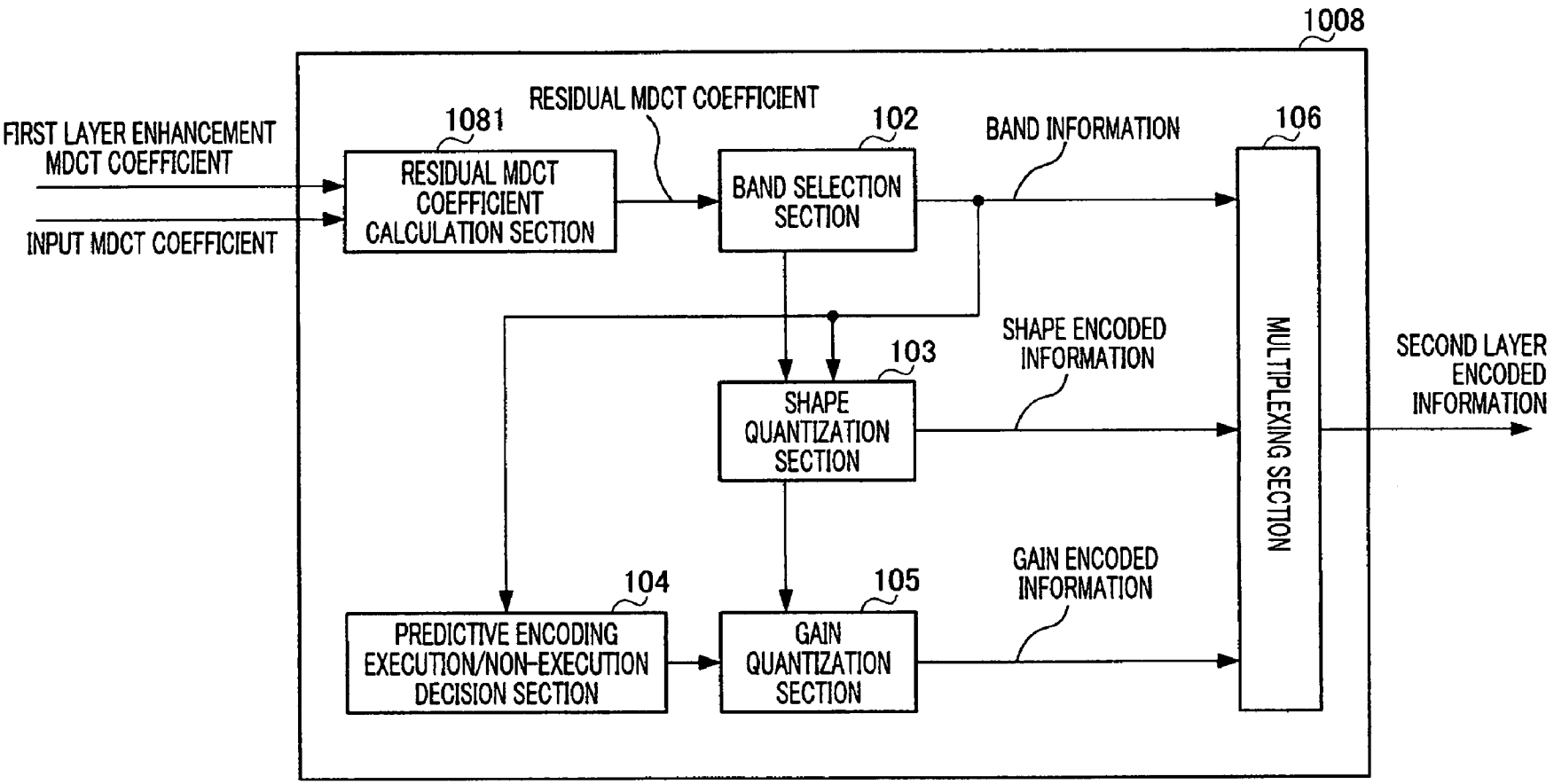
FIG. 17 is a block diagram showing the main configuration of the interior of a second layer encoding section according to Embodiment 5 of the present invention.

FIG. 17 is a block diagram showing the main configuration of the interior of second layer encoding section 1008. Second layer encoding section 1008 has a similar basic configuration to that of second layer encoding section 308 shown in see FIG. 7, and therefore identical configuration elements are assigned the same reference codes and descriptions thereof are omitted here. Processing differs in part between residual MDCT coefficient calculation section 1081 of second layer encoding section 1008 and residual MDCT coefficient calculation section 381 of second layer encoding section 308, and a different reference code is assigned to indicate this.

Residual MDCT coefficient calculation section 1081 calculates a residual MDCT that is to be a quantization target in the second layer encoding section from an input input MDCT coefficient and first layer enhancement MDCT coefficient. Residual MDCT coefficient calculation section 1081 differs from residual MDCT coefficient calculation section 381 according to Embodiment 2 in taking a residue of the input MDCT coefficient and first layer enhancement MDCT coefficient as a residual MDCT coefficient for a band not enhanced by band enhancement encoding section 1007 and taking an input MDCT coefficient itself, rather than a residue, as a residual MDCT coefficient for a band enhanced by band enhancement encoding section 1007.

Figure 18:
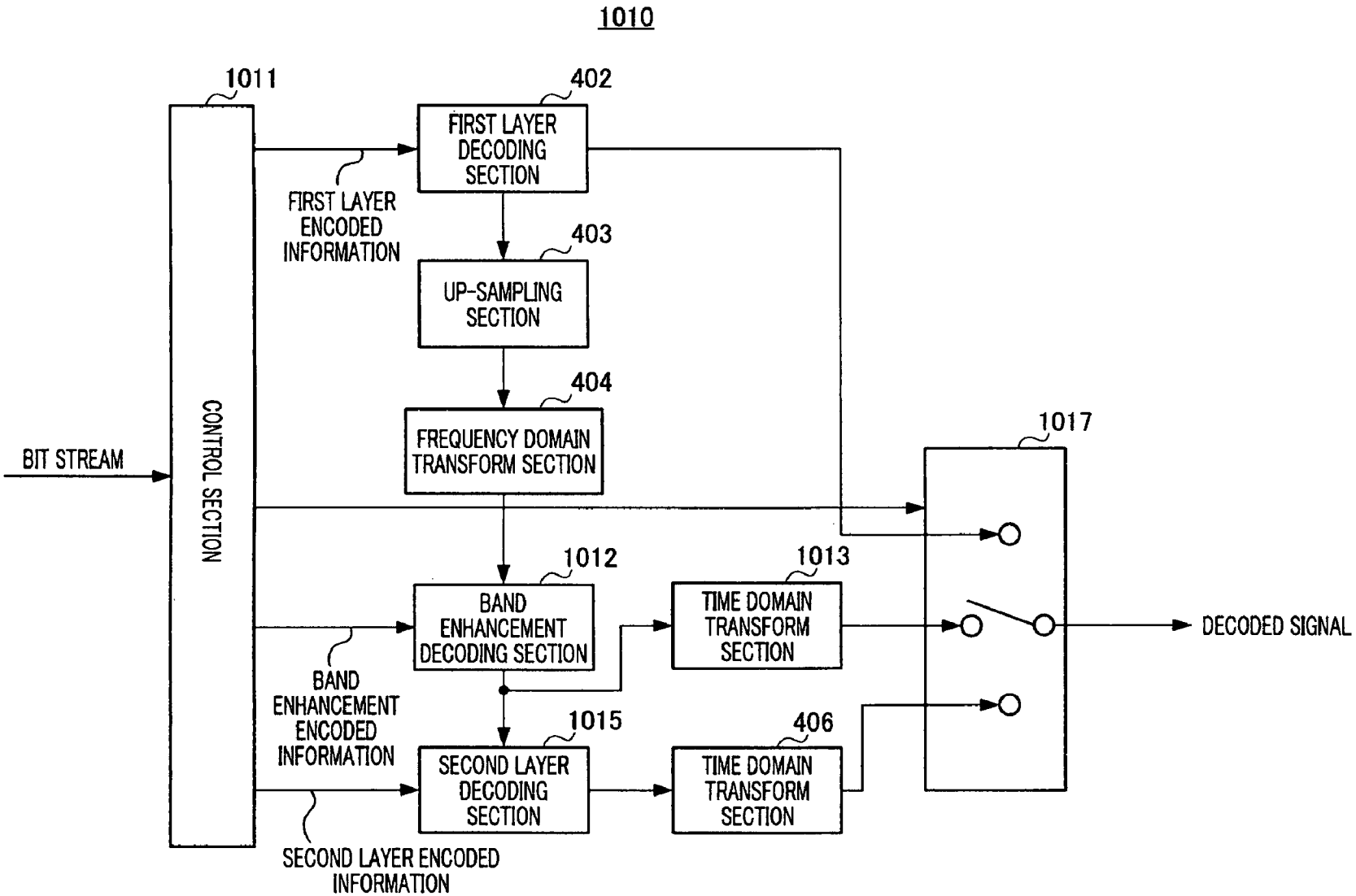
FIG. 18 is a block diagram showing the main configuration of a speech decoding apparatus according to Embodiment 5 of the present invention.

FIG. 18 is a block diagram showing the main configuration of speech decoding apparatus 1010 according to Embodiment 5 of the present invention. Speech decoding apparatus 1010 has a similar basic configuration to that of speech decoding apparatus 400 shown in FIG. 8, and therefore identical configuration elements are assigned the same reference codes and descriptions thereof are omitted here.

Speech decoding apparatus 1010 differs from speech decoding apparatus 400 in being further equipped with band enhancement decoding section 1012 and time domain transform section 1013. Also, processing differs in part between control section 1011, second layer decoding section 1015, and switch 1017 of speech decoding apparatus 1010 and control section 401, second layer decoding section 405, and switch 407 of speech decoding apparatus 400, and different reference codes are assigned to indicate this.

Control section 1011 analyzes configuration elements of a bit stream transmitted from speech encoding apparatus 1000, and according to these bit stream configuration elements, adaptively outputs appropriate encoded information to first layer decoding section 402, band enhancement decoding section 1012, and second layer decoding section 1015, and also outputs control information to switch 1017. Specifically, if the bit stream comprises first layer encoded information, band enhancement encoded information, and second layer encoded information, control section 1011 outputs the first layer encoded information to first layer decoding section 402, outputs the band enhancement encoded information to band enhancement decoding section 1012, and outputs the second layer encoded information to second layer decoding section 1015. If the bit stream comprises only first layer encoded information and band enhancement encoded information, control section 1011 outputs the first layer encoded information to first layer decoding section 402, and outputs the band enhancement encoded information to band enhancement decoding section 1012. If the bit stream comprises only first layer encoded information, control section 1011 outputs this first layer encoded information to first layer decoding section 402. Also, control section 1011 outputs control information that controls switch 1017 to switch 1017.

Band enhancement decoding section 1012 performs band enhancement processing using band enhancement encoded information input from control section 1011 and a first layer decoded MDCT coefficient input from frequency domain transform section 404, to obtain a first layer enhancement MDCT coefficient. Then band enhancement decoding section 1012 outputs the obtained first layer enhancement MDCT coefficient to time domain transform section 1013 and second layer decoding section 1015. The main internal configuration and actual operation of band enhancement decoding section 1012 will be described later herein.

Time domain transform section 1013 performs an IMDCT on the first layer enhancement MDCT coefficient input from band enhancement decoding section 1012, and outputs a first layer enhancement decoded signal obtained as a time domain component to switch 1017.

Second layer decoding section 1015 performs gain dequantization and shape dequantization using the second layer encoded information input from control section 1011 and the first layer enhancement MDCT coefficient input from band enhancement decoding section 1012, to obtain a second layer decoded MDCT coefficient. Second layer decoding section 1015 adds together the obtained second layer decoded MDCT coefficient and first layer decoded MDCT coefficient, and outputs the obtained addition result to time domain transform section 406 as an addition MDCT coefficient. The main internal configuration and actual operation of second layer decoding section 1015 will be described later herein.

Based on control information input from control section 1011, if the bit stream input to speech decoding apparatus 1010 comprises first layer encoded information, band enhancement encoded information, and second layer encoded information, switch 1017 outputs the second layer decoded signal input from time domain transform section 406 as an output signal. If the bit stream comprises only first layer encoded information and band enhancement encoded information, switch 1017 outputs the first layer enhancement decoded signal input from time domain transform section 1013 as an output signal. If the bit stream comprises only first layer encoded information, switch 1017 outputs the first layer decoded signal input from first layer decoding section 402 as an output signal.

Figure 19:
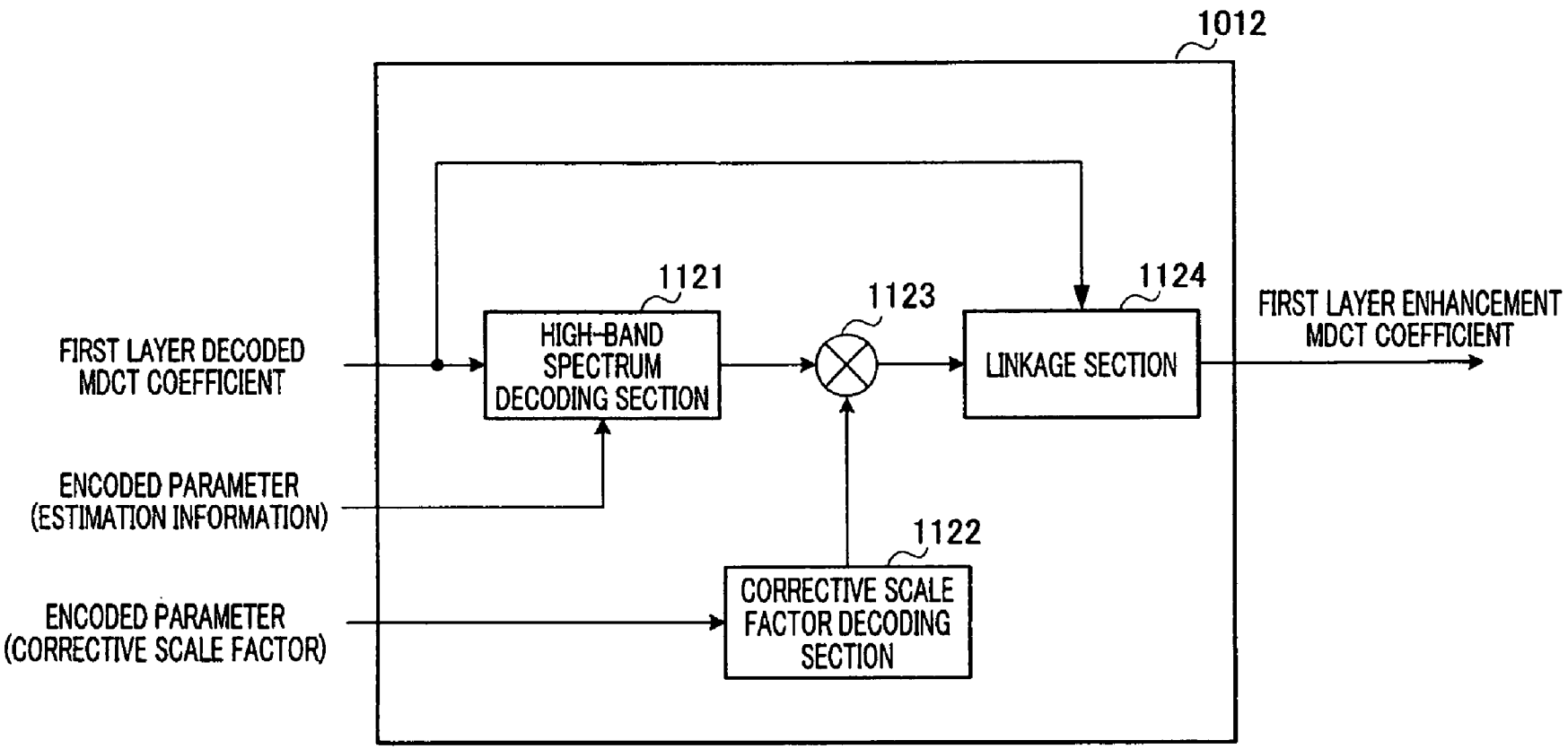
FIG. 19 is a block diagram showing the main configuration of the interior of a band enhancement decoding section according to Embodiment 5 of the present invention.

FIG. 19 is a block diagram showing the main configuration of the interior of band enhancement decoding section 1012. Band enhancement decoding section 1012 comprises high-band spectrum decoding section 1121, corrective scale factor decoding section 1122, multiplier 1123, and linkage section 1124.

High-band spectrum decoding section 1121 decodes an estimated spectrum (fine spectrum) of bands FL through FH using an estimation information encoding parameter and first spectrum included in band enhancement encoded information input from control section 1011. The obtained estimated spectrum is provided to multiplier 1123.

Corrective scale factor decoding section 1122 decodes a corrective scale factor using a corrective scale factor encoding parameter included in band enhancement encoded information input from control section 1011. Specifically, corrective scale factor decoding section 1122 references an internal corrective scale factor codebook (not shown) and outputs a corresponding corrective scale factor to multiplier 1123.

Multiplier 1123 multiplies the estimated spectrum output from high-band spectrum decoding section 1121 by the corrective scale factor output from corrective scale factor decoding section 1122, and outputs the multiplication result to linkage section 1124.

Linkage section 1124 links the first spectrum and the estimated spectrum output from multiplier 1123 in the frequency domain, to generate a wideband decoded spectrum of signal bands 0 through FH, and outputs this to time domain transform section 1013 as a first layer enhancement MDCT coefficient.

By means of band enhancement decoding section 1012, when an input signal is transformed to a frequency-domain coefficient and a scale factor is quantized in upper layer frequency-domain encoding, scale factor quantization is performed using a weighted distortion scale such that a quantization candidate for which the scale factor becomes small becomes prone to be selected. That is, a quantization candidate whereby the scale factor after quantization is smaller than the scale factor before quantization, are more likely to be selected. Thus, degradation of perceptual subjective quality can be suppressed even when the number of bits allocated to scale factor quantization is insufficient.

Figure 20:
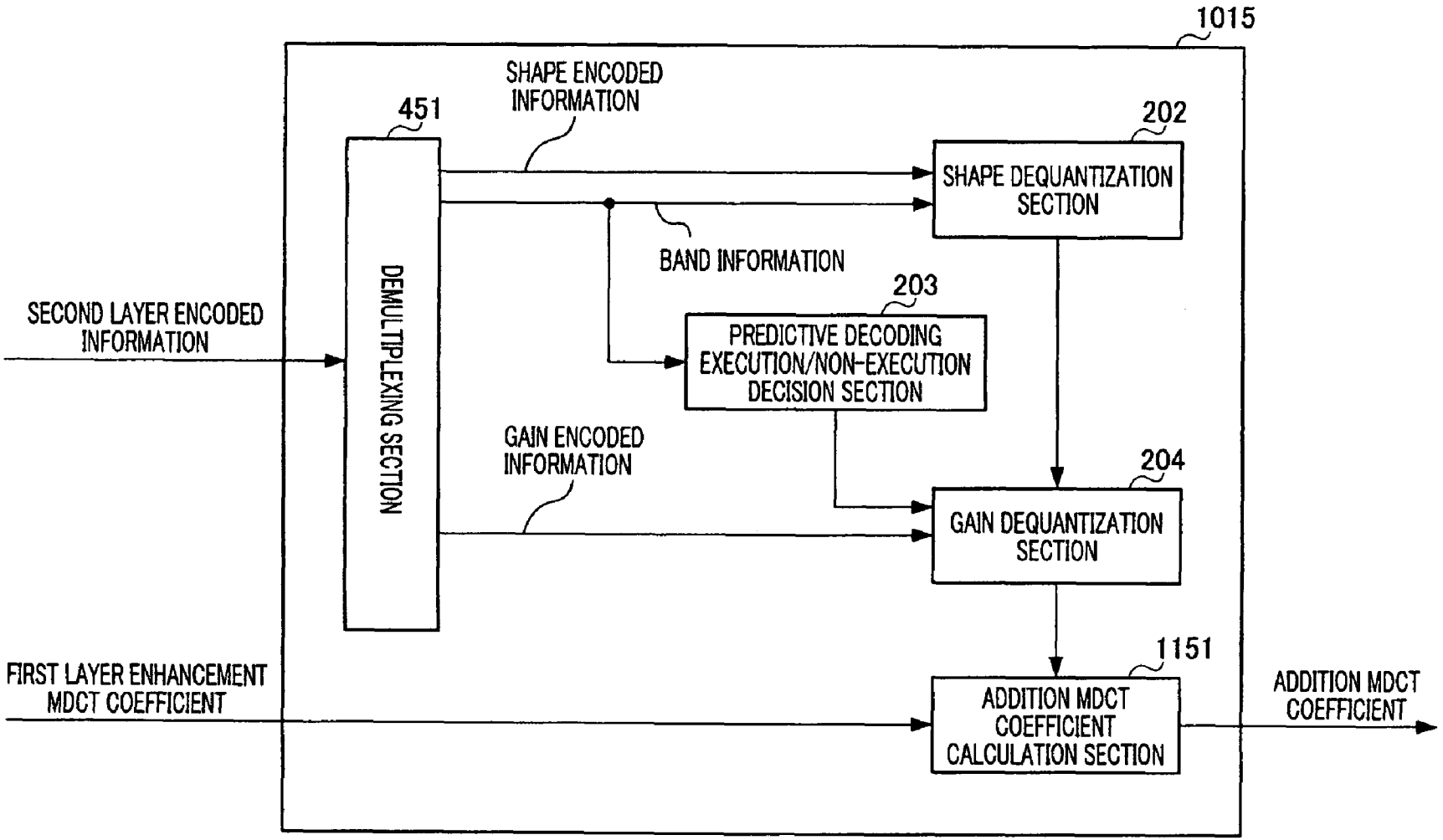
FIG. 20 is a block diagram showing the main configuration of the interior of a second layer decoding section according to Embodiment 5 of the present invention.

FIG. 20 is a block diagram showing the main configuration of the interior of second layer decoding section 1015. Second layer decoding section 1015 has a similar basic configuration to that of second layer decoding section 405 shown in FIG. 9, and therefore identical configuration elements are assigned the same reference codes and descriptions thereof are omitted here.

Processing differs in part between addition MDCT coefficient calculation section 1151 of second layer decoding section 1015 and addition MDCT coefficient calculation section 452 of second layer decoding section 405, and a different reference code is assigned to indicate this.

Addition MDCT coefficient calculation section 1151 has a first layer enhancement MDCT coefficient as input from band enhancement decoding section 1012, and a second layer decoded MDCT coefficient as input from gain dequantization section 204. Addition MDCT coefficient calculation section 1151 adds together the first layer decoded MDCT coefficient and the second layer decoded MDCT coefficient, and outputs an addition MDCT coefficient. For a band-enhanced band, the first layer enhancement MDCT coefficient value is added as zero in addition MDCT coefficient calculation section 1151. That is to say, for a band-enhanced band, the second layer decoded MDCT coefficient value is taken as the addition MDCT coefficient value.

Thus, according to this embodiment, when a frequency component of a different band is made a quantization target in each frame, non-temporal parameter predictive encoding is performed adaptively in addition to applying scalable encoding using band enhancement technology. Consequently, the encoded information amount in speech encoding can be reduced, and speech/audio signal encoding error and decoded signal audio quality degradation can be further reduced.

Also, since a residue is not calculated for a component of a band enhanced by a band enhancement encoding method, the energy of a quantization target component does not increase in an upper layer, and quantization efficiency can be improved.

In this embodiment, a case has been described by way of example in which a method is applied whereby band enhancement encoded information is calculated in an encoding apparatus using the correlation between a low-band component decoded by a first layer decoding section and a high-band component of an input signal, but the present invention is not limited to this, and can also be similarly applied to a configuration that employs a method whereby band enhancement encoded information is not calculated, and pseudo-generation of a high band is performed by means of a noise component, as with AMR-WB (Adaptive MultiRate-Wideband).

Alternatively, a band selection method of the present invention can be similarly applied to the band enhancement encoding method described in this example, or a scalable encoding/decoding method that does not employ a high-band component generation method also used in AMR-WB.

(Embodiment 6)

Figure 21:
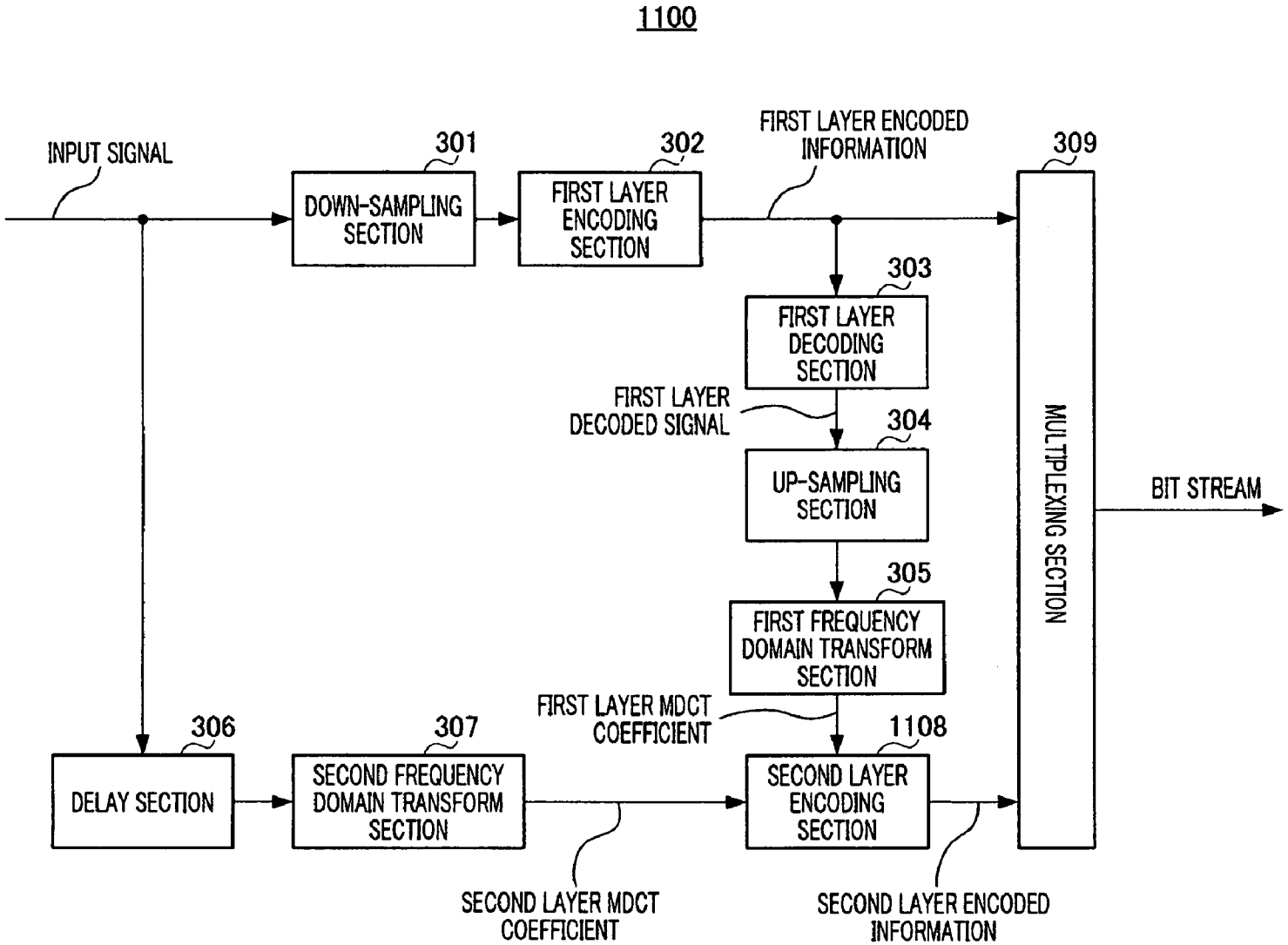
FIG. 21 is a block diagram showing the main configuration of a speech encoding apparatus according to Embodiment 6 of the present invention.

FIG. 21 is a block diagram showing the main configuration of speech encoding apparatus 1100 according to Embodiment 6 of the present invention.

In this figure, speech encoding apparatus 1100 is equipped with down-sampling section 301, first layer encoding section 302, first layer decoding section 303, up-sampling section 304, first frequency domain trans form section 305, delay section 306, second frequency domain transform section 307, second layer encoding section 1108, and multiplexing section 309, and has a scalable configuration comprising two layers. In the first layer, a CELP speech encoding method is applied, and in the second layer, the speech encoding method described in Embodiment 1 of the present invention is applied.

With the exception of second layer encoding section 1108, configuration elements in speech encoding apparatus 1100 shown in FIG. 21 are identical to the configuration elements of speech encoding apparatus 300 shown in FIG. 6, and therefore identical configuration elements are assigned the same reference codes and descriptions thereof are omitted here.

Figure 22:
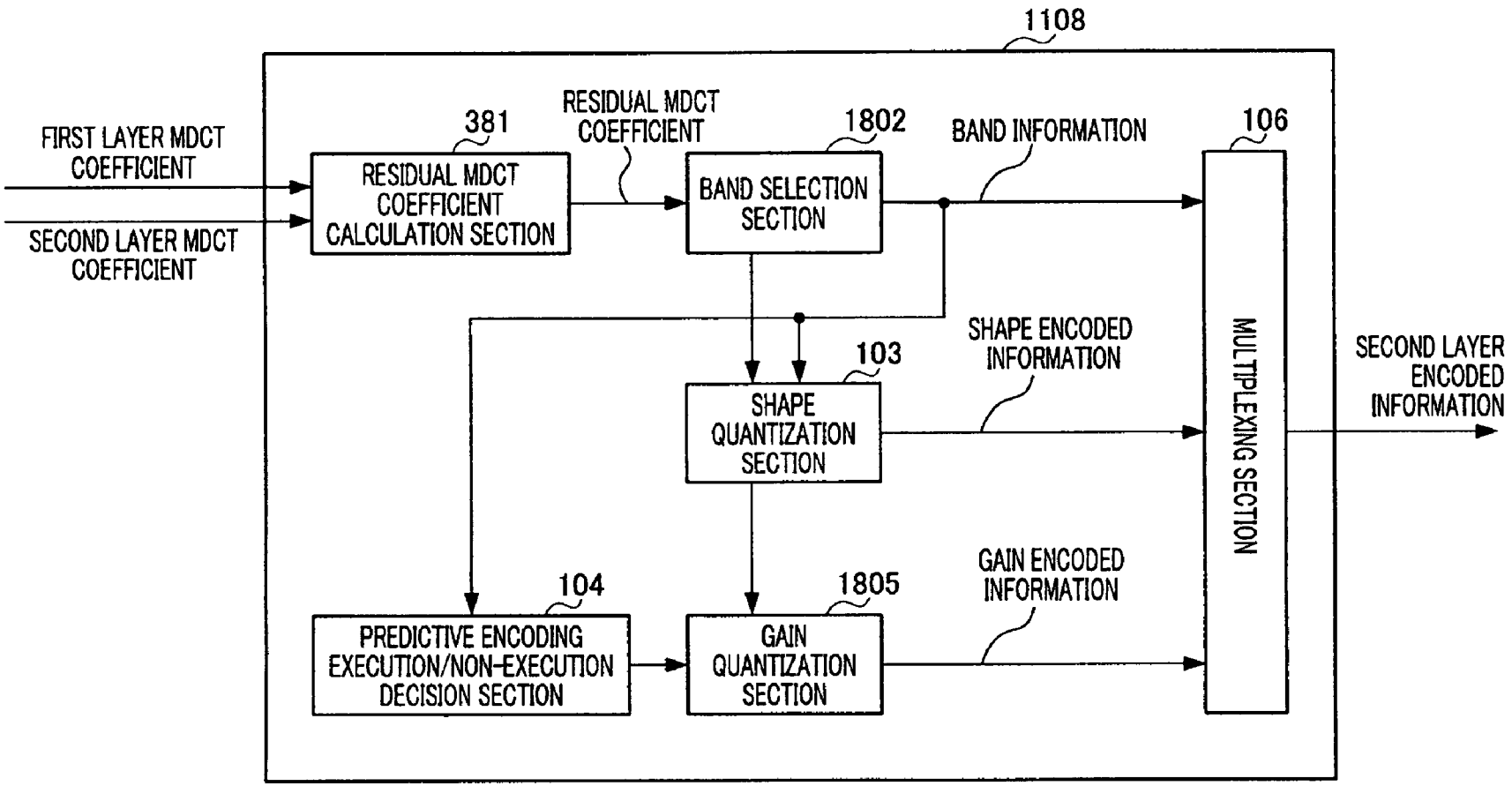
FIG. 22 is a block diagram showing the main configuration of the interior of a second layer encoding section according to Embodiment 6 of the present invention.

FIG. 22 is a block diagram showing the main configuration of the interior of second layer encoding section 1108. Second layer encoding section 1108 mainly comprises residual MDCT coefficient calculation section 381, band selection section 1802, shape quantization section 103, predictive encoding execution/non-execution decision section 104, gain quantization section 1805, and multiplexing section 106. With the exception of band selection section 1802 and gain quantization section 1805, configuration elements in second layer encoding section 1108 are identical to the configuration elements of second layer encoding section 308 shown in FIG. 7, and therefore identical configuration elements are assigned the same reference codes and descriptions thereof are omitted here.

Band selection section 1802 first divides MDCT coefficient $X_k$ into a plurality of subbands. Here, a description will be given taking a case in which MDCT coefficient $X_k$ is divided equally into J subbands (where J is a natural number) as an example. Then band selection section 1802 selects L subbands (where L is a natural number) from among the J subbands, and obtains M kinds of regions (where M is a natural number).

Figure 23:
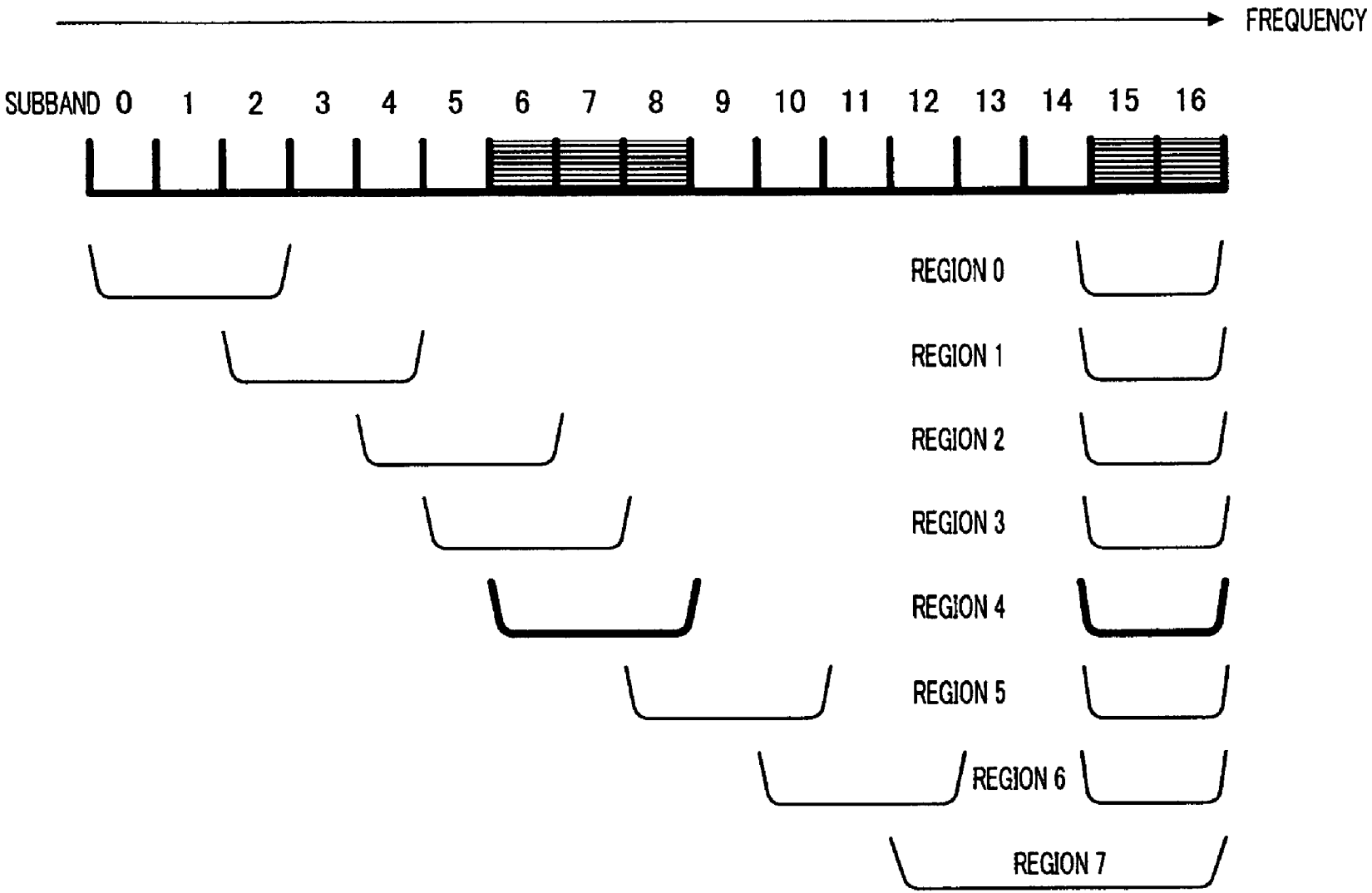
FIG. 23 is a drawing showing an example of the configuration of regions obtained by a band selection section according to Embodiment 6 of the present invention.

FIG. 23 is a drawing showing an example of the configuration of regions obtained by band selection section 1802.

In this figure, the number of subbands is 17 (J=17), the number of kinds of regions is eight (M=8), and each region is composed of two subband groups (the number of bands composing these two subband groups being three and two respectively). Of these two subband groups, the subband group comprising two bands located on the high-band side is fixed throughout all frames, the subband indices being, for example, 15 and 16. For example, region 4 is composed of subbands 6 through 8, 15, and 16.

Next, band selection section 1802 calculates average energy E(m) of each of the M kinds of regions in accordance with Equation (33) below.

$$E(m) = \frac{\sum_{j' \in Region(m)} \sum_{k=B(j')}^{B(j')+W(j')} (X_k)^2}{L} \quad (m = 0, \ldots, M-1) \qquad \text{(Equation 33)}$$

In this equation, j' indicates the index of each of J subbands, and m indicates the index of each of M kinds of regions. Region (m) means a collection of indices of L subbands composing region m, and B(j') indicates the minimum value among the indices of a plurality of MDCT coefficients composing subband j'. W(j) indicates the bandwidth of subband j', and in the following description, a case in which the bandwidths of the J subbands are all equal—that is, a case in which W(j') is a constant—will be described as an example.

Next, when a region for which average energy E(m) is a maximum—for example, region m_max is selected, band selection section 1802 selects a band composed of j'∈Region (m_max) subbands as a quantization target band, and outputs index m_max indicating this region as band information to shape quantization section 103, predictive encoding execution/non-execution decision section 104, and multiplexing section 106. Band selection section 1802 also outputs residual MDCT coefficient $X_k$ to shape quantization section 103.

Gain quantization section 1805 has an internal buffer that stores a quantization gain value obtained in a past frame. If a determination result input from predictive encoding execution/non-execution decision section 104 indicates that predictive encoding is to be performed, gain quantization section 1805 performs quantization by predicting a current-frame gain value using past-frame quantization gain value $C^t_{j'}$ stored in the internal buffer. Specifically, gain quantization section 1805 searches an internal gain codebook composed of quantity GQ of gain code vectors for each of L subbands, and finds an index of a gain code vector for which the result of Equation (34) below is a minimum.

$$\text{Gain_q}(i) = \sum_{j' \in Region(m_max)} \left\{ \text{Gain_i}(j') - \sum_{t=1}^{3} \left(\alpha_t \cdot C^t_{j'}\right) - \alpha_0 \cdot GC^i_k \right\}^2 \quad \begin{pmatrix} i = 0, \ldots, GQ-1 \\ k = 0, \ldots, L-1 \end{pmatrix} \qquad \text{(Equation 34)}$$

In this equation, $GC^i_k$ indicates a gain code vector composing a gain codebook, i indicates a gain code vector index, and k indicates an index of a gain code vector element. For example, if the number of subbands composing a region is five (L=5), k has a value of 0 to 4. Here, gains of subbands of a selected region are linked so that subband indices are in ascending order, consecutive gains are treated as one L-dimensional gain code vector, and vector quantization is performed. Therefore, to give a description using FIG. 23, in the case of region 4, gain values of subband indices 6, 7, 8, 15, and 16 are linked and treated as a 5-dimensional gain code vector. Also, $C^t_{j'}$ indicates a gain value of t frames before in time, so that when t=1, for example, $C^t_{j'}$ indicates a gain value of one frame before in time, and α is a 4th-order linear prediction coefficient stored in gain quantization section 1805.

Gain quantization section 1805 outputs gain code vector index G_min for which the result of Equation (34) above is a minimum to multiplexing section 106 as gain encoded information. If there is no gain value of a subband corresponding to a past frame in the internal buffer, gain quantization section 1805 substitutes the gain value of the nearest subband in frequency in the internal buffer in Equation (34) above.

On the other hand, if the determination result input from predictive encoding execution/non-execution decision section 104 indicates that predictive encoding is not to be performed, gain quantization section 1805 directly quantizes ideal gain value Gain_i (j') input from shape quantization section 103 in accordance with Equation (35) below. Here, gain quantization section 1805 treats an ideal gain value as an L-dimensional vector, and performs vector quantization.

$$\text{Gain_q}(i) = \sum_{j' \in Region(m_max)} \{\text{Gain_i}(j') - GC_k^i\}^2 \begin{pmatrix} i = 0, \ldots, GQ-1 \\ k = 0, \ldots, L-1 \end{pmatrix} \quad \text{(Equation 35)}$$

Here, a codebook index that makes Equation (35) above a minimum is denoted by G_min.

Gain quantization section 1805 outputs G_min to multiplexing section 106 as gain encoded information. Gain quantization section 1805 also updates the internal buffer in accordance with Equation (36) below using gain encoded information G_min and quantization gain value $C^t_{j'}$ obtained in the current frame. That is to say, in Equation (36), a $C^1_{j'}$ value is updated with gain code vector $GC^{G_min_j}$ element index j and j' satisfying j'ϵRegion(m_max) respectively associated in ascending order.

$$\begin{cases} C^3_{j'} = C^2_{j'} \\ C^2_{j'} + C^1_{j'} \\ C^1_{j'} = GC_j^{G_min} \end{cases} \begin{pmatrix} j' \in \text{Region(m_max)} \\ j = 0, \ldots, L-1 \end{pmatrix} \quad \text{(Equation 36)}$$

Figure 24:
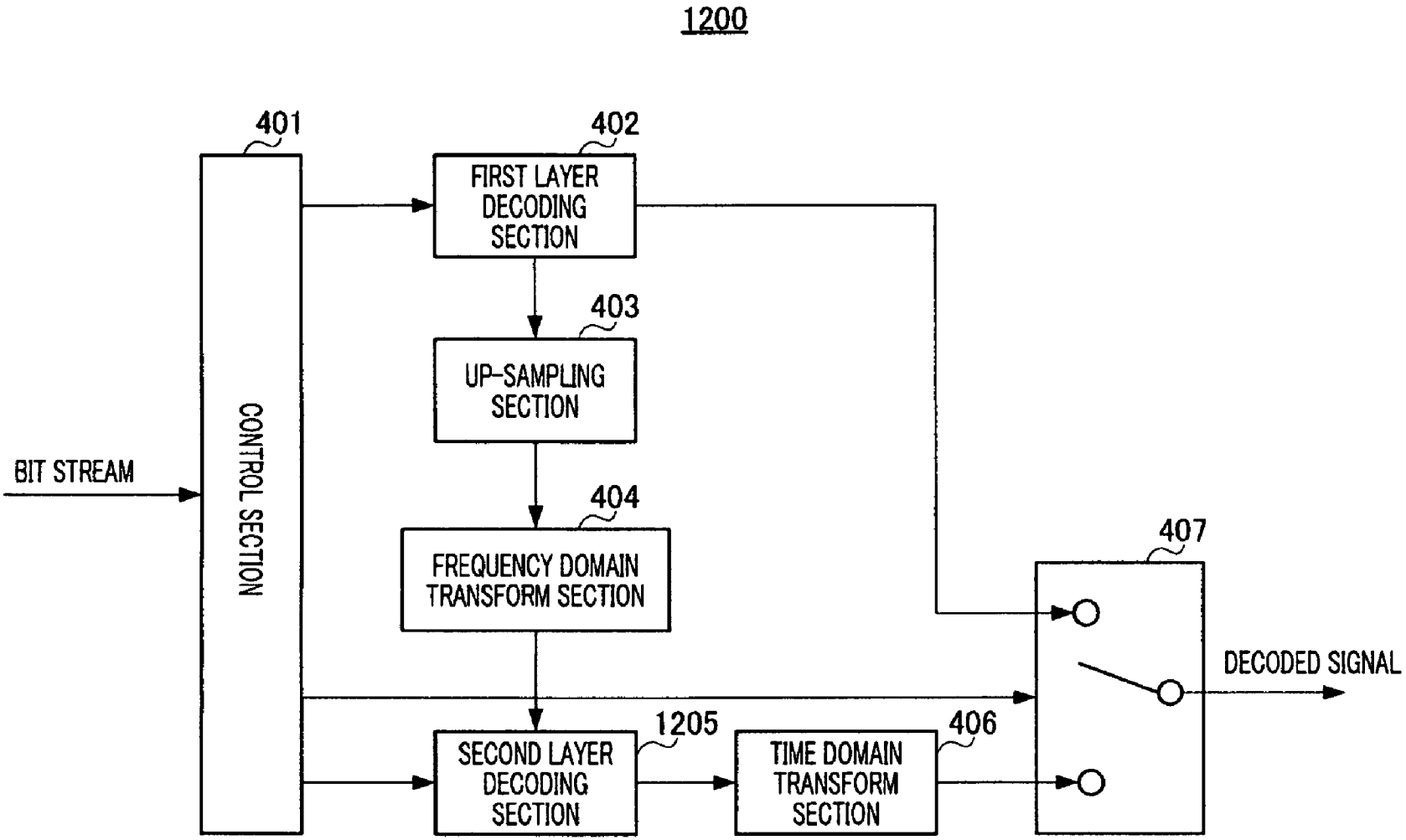
FIG. 24 is a block diagram showing the main configuration of a speech decoding apparatus according to Embodiment 6 of the present invention.

FIG. 24 is a block diagram showing the main configuration of speech decoding apparatus 1200 according to this embodiment.

In this figure, speech decoding apparatus 1200 is equipped with control section 401, first layer decoding section 402, up-sampling section 403, frequency domain transform section 404, second layer decoding section 1205, time domain transform section 406, and switch 407.

With the exception of second layer decoding section 1205, configuration elements in speech decoding apparatus 1200 shown in FIG. 24 are identical to the configuration elements of speech decoding apparatus 400 shown in FIG. 8, and therefore identical configuration elements are assigned the same reference codes and descriptions thereof are omitted here.

Figure 25:
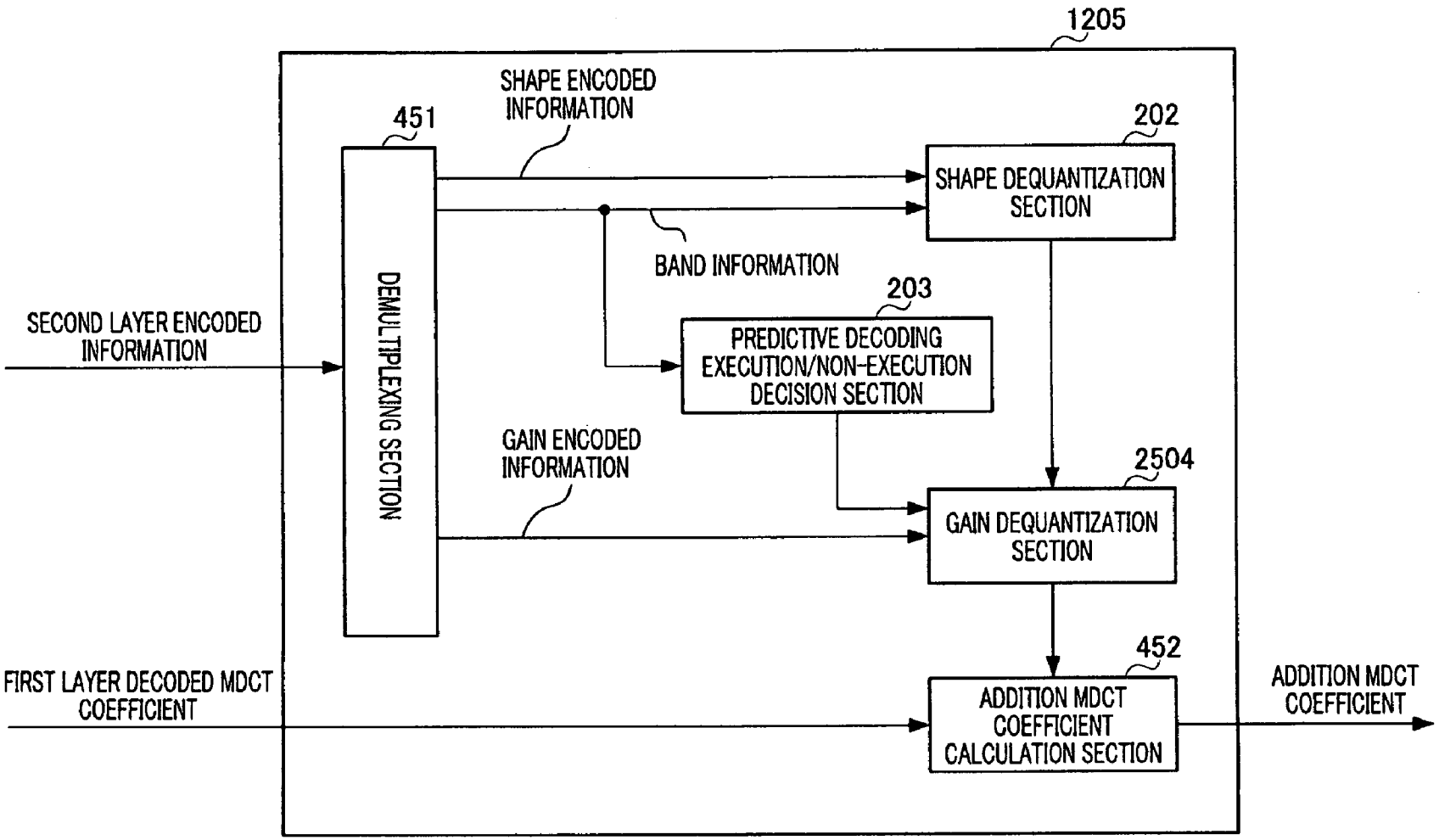
FIG. 25 is a block diagram showing the main configuration of the interior of a second layer decoding section according to Embodiment 6 of the present invention.

FIG. 25 is a block diagram showing the main configuration of the interior of second layer decoding section 1205. Second layer decoding section 1205 mainly comprises demultiplexing section 451, shape dequantization section 202, predictive decoding execution/non-execution decision section 203, gain dequantization section 2504, and addition MDCT coefficient calculation section 452. With the exception of gain dequantization section 2504, configuration elements in second layer decoding section 1205 are identical to the configuration elements of second layer decoding section 405 shown in FIG. 9, and therefore identical configuration elements are assigned the same reference codes and descriptions thereof are omitted here.

Gain dequantization section 2504 has an internal buffer that stores a gain value obtained in a past frame. If a determination result input from predictive decoding execution/non-execution decision section 203 indicates that predictive decoding is to be performed, gain dequantization section 2504 performs dequantization by predicting a current-frame gain value using a past-frame gain value stored in the internal buffer. Specifically, gain dequantization section 2504 has the same kind of internal gain codebook ($GC^{G_min_k}$, where k indicates an element index) as gain quantization section 105 of speech encoding apparatus 100, and obtains gain value Gain_q' by performing gain dequantization in accordance with Equation (37) below. Here, $C''^t_{j'}$ indicates a gain value of t frames before in time, so that when t=1, for example, $C''^t_{j'}$ indicates a gain value of one frame before in time. Also, α is a 4th-order linear prediction coefficient stored in gain dequantization section 2504. Gain dequantization section 2504 treats L subbands within one region as an L-dimensional vector, and performs vector dequantization. That is to say, in Equation (37), a Gain_q'(j') value is calculated with gain code vector $GC^{G_min_k}$ element index k and j' satisfying j'ϵRegion (m_max) respectively associated in ascending order.

$$\text{Gain_q}'(j') = \sum_{t=1}^{3} \left(\alpha_t \cdot C''^t_{j'}\right) + \alpha_0 \cdot GC_k^{G_min} \begin{pmatrix} j' \in \text{Region(m_max)} \\ k = 0, \ldots, L-1 \end{pmatrix} \quad \text{(Equation 37)}$$

If there is no gain value of a subband corresponding to a past frame in the internal buffer, gain dequantization section 2504 substitutes the gain value of the nearest subband in frequency in the internal buffer in Equation (37) above.

On the other hand, if the determination result input from predictive decoding execution/non-execution decision section 203 indicates that predictive decoding is not to be performed, gain dequantization section 2504 performs dequantization of a gain value in accordance with Equation (38) below using the above-described gain codebook. Here, a gain value is treated as an L-dimensional vector, and vector dequantization is performed. That is to say, when predictive decoding is not performed, gain dequantization section 2504 takes gain code vector $GC_k^{G_min}$ corresponding to gain encoded information G_min directly as a gain value. In Equation (38), k and j' are respectively associated in ascending order in the same way as in Equation (37).

$$\text{Gain_q}'(j') = GC_k^{G_min} \begin{pmatrix} j' \in \text{Region(m_max)} \\ k = 0, \ldots, L-1 \end{pmatrix} \quad \text{(Equation 38)}$$

Next, gain dequantization section 2504 calculates a decoded MDCT coefficient in accordance with Equation (39) below using a gain value obtained by current-frame dequantization and a shape value input from shape dequantization section 202, and updates the internal buffer in accordance with Equation (40) below. In Equation (40), a $C''^1_j$ value is updated with j of dequantized gain value Gain_q'(j) and j' satisfying j'ϵRegion(m_max) respectively associated in ascending order. Here, a calculated decoded MDCT coefficient is denoted by $X''_k$. Also, in MDCT coefficient dequantization, if k is present within B(j') through B(j'+1)−1, the gain value takes the value of Gain_q'(j').

$$X''_k = \text{Gain_q}'(j') \cdot \text{Shape_q}'(k) \begin{pmatrix} k = B(j'), \ldots, B(j'+1)-1 \\ j' \in \text{Region(m_max)} \end{pmatrix} \quad \text{(Equation 39)}$$

$$\begin{cases} C''^3_{j'} = C''^2_{j'} \\ C''^2_{j'} + C''^1_{j'} \\ C''^1_{j'} = \text{Gain_q}'(j) \end{cases} \begin{pmatrix} j' \in \text{Region(m_max)} \\ j = 0, \ldots, L-1 \end{pmatrix} \quad \text{(Equation 40)}$$

Gain dequantization section 2504 outputs decoded MDCT coefficient $X''_k$ calculated in accordance with Equation (39) above to addition MDCT coefficient calculation section 452.

Thus, according to this embodiment, as compared with selecting one region composed of adjacent subbands from among all bands as a quantization target band, a plurality of bands for which it is wished to improve audio quality are set beforehand across a wide range, and a nonconsecutive plurality of bands spanning a wide range are selected as quantization target bands. Consequently, both low-band and high-band quality can be improved at the same time.

In this embodiment, the reason for always fixing subbands included in a quantization target band on the high-band side, as shown in FIG. 23, is that encoding distortion is still large for a high band in the first layer of a scalable codec. Therefore, audio quality is improved by also fixedly selecting a high band that has not been encoded with very high precision by the first layer as a quantization target in addition to selecting a low or middle band having perceptual significance to selection as a quantization target in the second layer.

In this embodiment, a case has been described by way of example in which a band that becomes a high-band quantization target is fixed by including the same high-band subbands (specifically, subband indices 15 and 16) throughout all frames, but the present invention is not limited to this, and a band that becomes a high-band quantization target may also be selected from among a plurality of quantization target band candidates for a high-band subband in the same way as for a low-band subband. In such a case, selection may be performed after multiplying by a larger weight the higher the subband area is. It is also possible for bands that become candidates to be changed adaptively according to the input signal sampling rate, coding bit rate, and first layer decoded signal spectral characteristics, or the spectral characteristics of a differential signal for an input signal and first layer decoded signal, or the like. For example, a possible method is to give priority as a quantization target band candidate to a part where the energy distribution of the spectrum (residual MDCT coefficient) of a differential signal for the input signal and first layer decoded signal is high.

In this embodiment, a case has been described by way of example in which a high-band-side subband group composing a region is fixed, and whether or not predictive encoding is to be applied to a gain quantization section is determined according to the number of subbands common to a quantization target band selected in the current frame and a quantization target band selected in a past frame, but the present invention is not limited to this, and predictive encoding may also always be applied to gain of a high-band-side subband group composing a region, with determination of whether or not predictive encoding is to be performed being performed only for a low-band-side subband group. In this case, the number of subbands common to a quantization target band selected in the current frame and a quantization target band selected in a past frame is taken into consideration only for a low-band-side subband group. That is to say, in this case, a quantization vector is quantized after division into a part for which predictive encoding is performed and a part for which predictive encoding is not performed. In this way, since determination of whether or not predictive encoding is necessary for a high-band side fixed subband group composing a region is not performed, and predictive encoding is always performed, gain can be quantized more efficiently.

In this embodiment, a case has been described by way of example in which switching is performed between application and non-application of predictive encoding in a gain quantization section according to the number of subbands common to a quantization target band selected in the current frame and a quantization target band selected one frame back in time, but the present invention is not limited to this, and a number of subbands common to a quantization target band selected in the current frame and a quantization target band selected two or more frames back in time may also be used. In this case, even if the number of subbands common to a quantization target band selected in the current frame and a quantization target band selected one frame back in time is less than or equal to a predetermined value, predictive encoding may be applied in a gain quantization section according to the number of subbands common to a quantization target band selected in the current frame and a quantization target band selected two or more frames back in time.

In this embodiment, a case has been described by way of example in which a region is composed of a low-band-side subband group and a high-band-side subband group, but the present invention is not limited to this, and, for example, a subband group may also be set in a middle band, and a region may be composed of three or more subband groups. the number of subband groups composing a region may also be changed adaptively according to the input signal sampling rate, coding bit rate, and first layer decoded signal spectral characteristics, or the spectral characteristics of a differential signal for an input signal and first layer decoded signal, or the like.

In this embodiment, a case has been described by way of example in which a high-band-side subband group composing a region is fixed throughout all frames, but the present invention is not limited to this, and a low-band-side subband group composing a region may also be fixed throughout all frames. Also, both high-band-side and low-band-side subband groups composing a region may also be fixed throughout all frames, or both high-band-side and low-band-side subband groups may be searched for and selected on a frame-by-frame basis. Moreover, the various above-described methods may be applied to three or more subband groups among subband groups composing a region.

In this embodiment, a case has been described by way of example in which, of subbands composing a region, the number of subbands composing a high-band-side subband group is smaller than the number of subbands composing a low-band-side subband group (the number of high-band-side subband group subbands being two, and the number of low-band-side subband group subbands being three), but the present invention is not limited to this, and the number of subbands composing a high-band-side subband group may also be equal to, or greater than, the number of subbands composing a low-band-side subband group. The number of subbands composing each subband group may also be changed adaptively according to the input signal sampling rate, coding bit rate, first layer decoded signal spectral characteristics, spectral characteristics of a differential signal for an input signal and first layer decoded signal, or the like.

In this embodiment, a case has been described by way of example in which encoding using a CELP encoding method is performed by first layer encoding section 302, but the present invention is not limited to this, and encoding using an encoding method other than CELP (such as transform encoding, for example) may also be performed.

(Embodiment 7)

Figure 26:
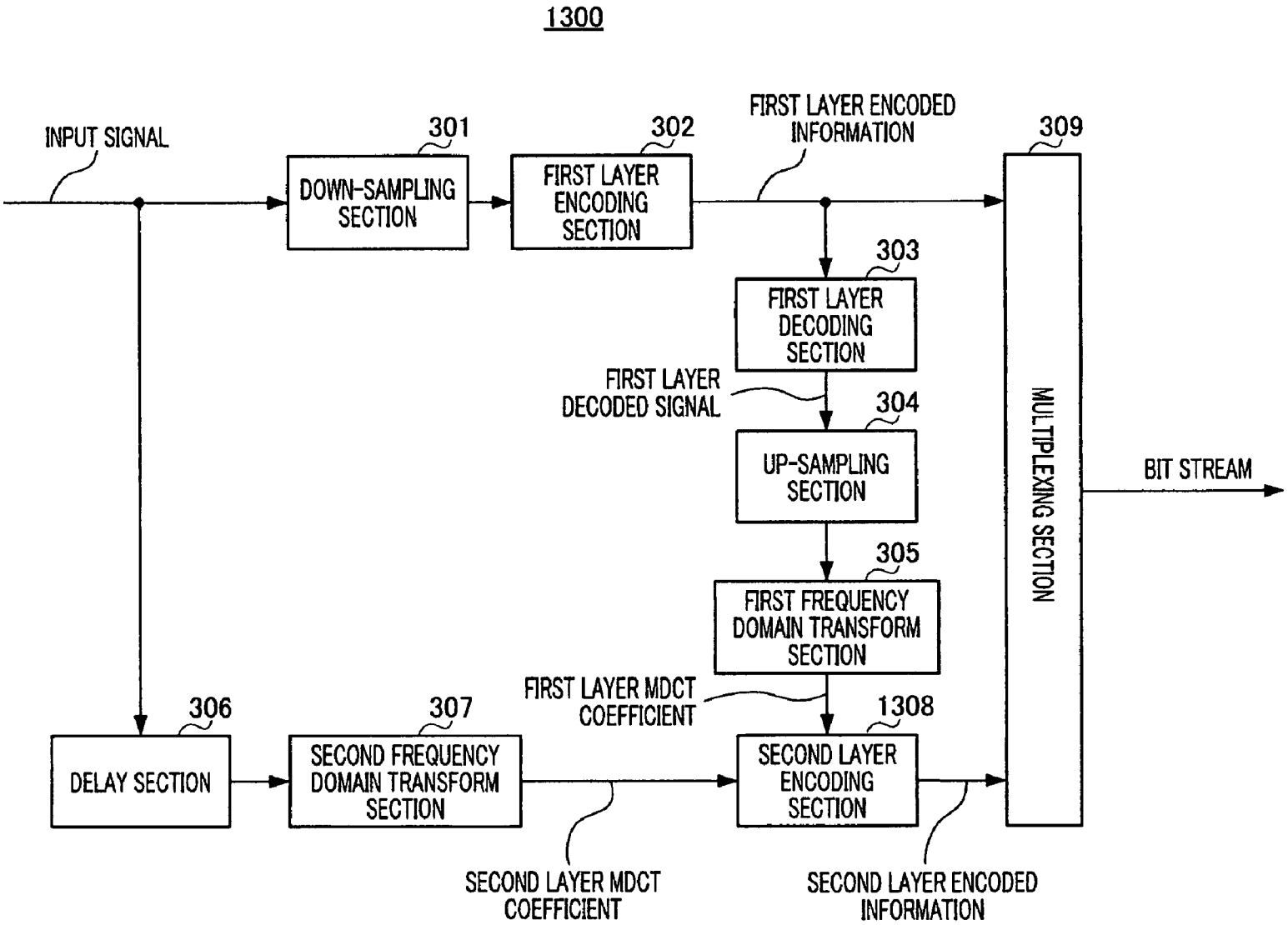
FIG. 26 is a block diagram showing the main configuration of a speech encoding apparatus according to Embodiment 7 of the present invention.

FIG. 26 is a block diagram showing the main configuration of speech encoding apparatus 1300 according to Embodiment 7 of the present invention.

In this figure, speech encoding apparatus 1300 is equipped with down-sampling section 301, first layer encoding section 302, first layer decoding section 303, up-sampling section 304, first frequency domain transform section 305, delay section 306, second frequency domain transform section 307, second layer encoding section 1308, and multiplexing section 309, and has a scalable configuration comprising two layers. In the first layer, a CELP speech encoding method is applied, and in the second layer, the speech encoding method described in Embodiment 1 of the present invention is applied.

With the exception of second layer encoding section 1308, configuration elements in speech encoding apparatus 1300 shown in FIG. 26 are identical to the configuration elements of speech encoding apparatus 300 shown in FIG. 6, and therefore identical configuration elements are assigned the same reference codes and descriptions thereof are omitted here.

Figure 27:
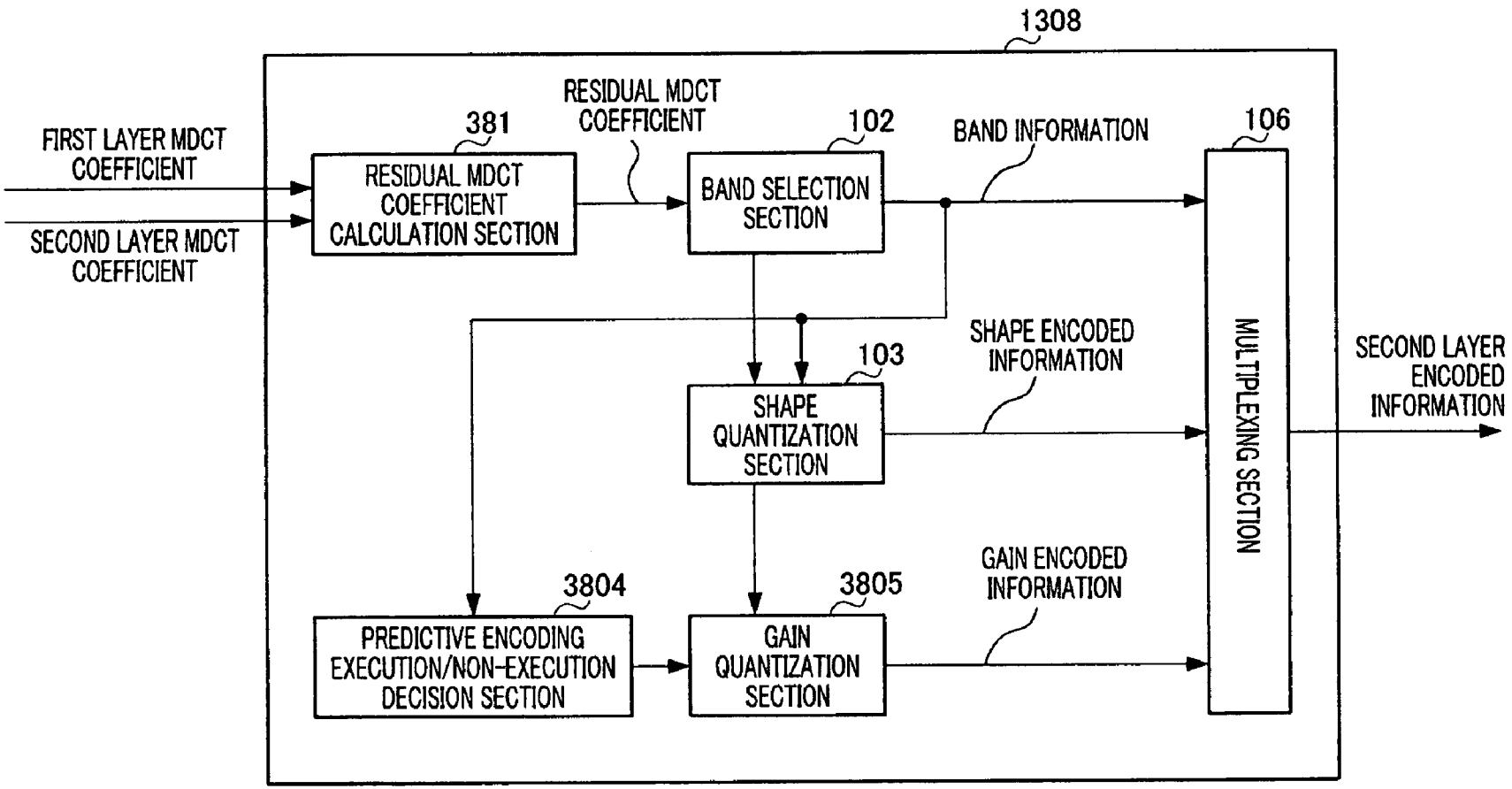
FIG. 27 is a block diagram showing the main configuration of the interior of a second layer encoding section according to Embodiment 7 of the present invention.

FIG. 27 is a block diagram showing the main configuration of the interior of second layer encoding section 1308. Second layer encoding section 1308 mainly comprises residual MDCT coefficient calculation section 381, band selection section 102, shape quantization section 103, predictive encoding execution/non-execution decision section 3804, gain quantization section 3805, and multiplexing section 106. With the exception of predictive encoding execution/non-execution decision section 3804 and gain quantization section 3805, configuration elements in second layer encoding section 1308 are identical to the configuration elements of second layer encoding section 308 shown in FIG. 7, and therefore identical configuration elements are assigned the same reference codes and descriptions thereof are omitted here.

Predictive encoding execution/non-execution decision section 3804 has an internal buffer that stores band information m_max input from band selection section 102 in a past frame. Here, a case will be described by way of example in which predictive encoding execution/non-execution decision section 3804 has an internal buffer that stores band information m_max for the past three frames. Predictive encoding execution/non-execution decision section 3804 first detects a subband common to a past-frame quantization target band and current-frame quantization target band using band information m_max input from band selection section 102 in a past frame and band information m_max input from band select ion section 102 in the current frame. Of L subbands indicated by band information m_max input from band selection section 102, predictive encoding execution/non-execution decision section 3804 determines that predictive encoding is to be applied, and sets Pred_Flag(j)=ON, for a subband selected as a quantization target one frame back in time. On the other hand, of L subbands indicated by band information m_max input from band selection section 102, predictive encoding execution/non-execution decision section 3804 determines that predictive encoding is not to be applied, and sets Pred_Flag(j)=OFF, for a subband not selected as a quantization target one frame back in time. Here, Pred_Flag is a flag indicating a predictive encoding application/non-application determination result for each subband, with an ON value meaning that predictive encoding is to be applied to a subband gain value, and an OFF value meaning that predictive encoding is not to be applied to a subband gain value. Predictive encoding execution/non-execution decision section 3804 outputs a determination result for each subband to gain quantization section 3805. Then predictive encoding execution/non-execution decision section 3804 updates the internal buffer storing band information using band information m_max input from band selection section 102 in the current frame.

Gain quantization section 3805 has an internal buffer that stores a quantization gain value obtained in a past frame. Gain quantization section 3805 switches between execution/non-execution of application of predictive encoding in current-frame gain value quantization according to a determination result input from predictive encoding execution/non-execution decision section 3804. For example, if predictive encoding is to be performed, gain quantization section 3805 searches an internal gain codebook composed of quantity GQ of gain code vectors for each of L subbands, performs a distance calculation corresponding to the determination result input from predictive encoding execution/non-execution decision section 3804, and finds an index of a gain code vector for which the result of Equation (41) below is a minimum. In Equation (41), one or other distance calculation is performed according to Pred_Flag(j) for all j's satisfying j∈Region(m_max), and a gain vector index is found for which the total value of the error is a minimum.

(Equation 41)

$$\mathrm{Gain_q}(i) = \begin{cases} \sum_{j \in Region(m_max)} \left\{ \mathrm{Gain_i}(j) - \sum_{t=1}^{3} (\alpha_t \cdot C_j^i) - \alpha_0 \cdot GC_k^i \right\}^2 & (\mathrm{if}(\mathrm{Pref_Flag}(j) == \mathrm{ON})) \\ \sum_{j \in Region(m_max)} \left\{ \mathrm{Gain_i}(j) - GC_k^i \right\}^2 & (\mathrm{if}(\mathrm{Pred_Flag}(j) == \mathrm{OFF})) \end{cases}$$

$$\begin{pmatrix} i = 0, \ldots, GQ-1 \\ k = 0, \ldots, L-1 \end{pmatrix}$$

In this equation, $GC^i_k$ indicates a gain code vector composing a gain codebook, i indicates a gain code vector index, and k indicates an index of a gain code vector element. For example, if the number of subbands composing a region is five (L=5), k has a value of 0 to 4. Here, $C^t_j$ indicates a gain value of t frames before in time, so that when t=1, for example, $C^t_j$ indicates a gain value of one frame before in time. Also, α is a 4th-order linear prediction coefficient stored in gain quantization section 3805. Gain quantization section 3805 treats L subbands within one region as an L-dimensional vector, and performs vector quantization.

Gain quantization section 3805 outputs gain code vector index G_min for which the result of Equation (41) above is a minimum to multiplexing section 106 as gain encoded information.

Gain quantization section 3805 outputs G_min to multiplexing section 106 as gain encoded information. Gain quantization section 3805 also updates the internal buffer in accordance with Equation (42) below using gain encoded information G_min and quantization gain value $C^t_j$ obtained in the current frame. In Equation (42), a $C^1_{j'}$ value is updated with gain code vector $GC^{G_min_j}$ element index j and j' satisfying j'∈Region(m_max) respectively associated in ascending order.

$$\begin{cases} C^3_{j'} = C^2_j \\ C^2_{j'} = C^1_{j'} \\ C^1_{j'} = GC_j^{G_min} \end{cases} \begin{pmatrix} j' \in \text{Region(m_max)} \\ j = 0, \ldots, L-1 \end{pmatrix} \quad \text{(Equation 42)}$$

Figure 28:
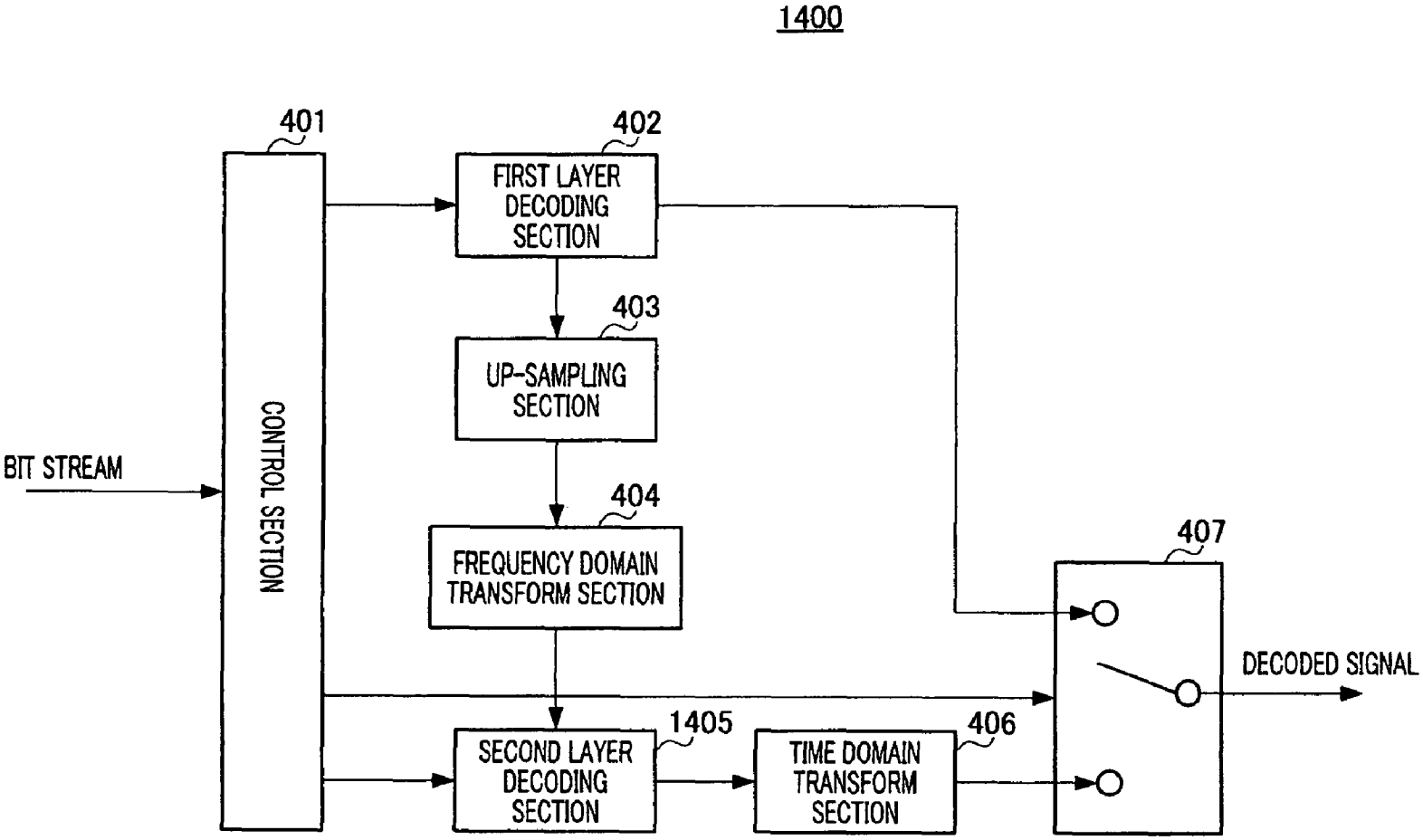
FIG. 28 is a block diagram showing the main configuration of a speech decoding apparatus according to Embodiment 7 of the present invention.

FIG. 28 is a block diagram showing the main configuration of speech decoding apparatus 1400 according to this embodiment.

In this figure, speech decoding apparatus 1400 is equipped with control section 401, first layer decoding section 402, up-sampling section 403, frequency domain transform section 404, second layer decoding section 1405, time domain transform section 406, and switch 407.

With the exception of second layer decoding section 1405, configuration elements in speech decoding apparatus 1400 shown in FIG. 28 are identical to the configuration elements of speech decoding apparatus 400 shown in FIG. 8, and therefore identical configuration elements are assigned the same reference codes and descriptions thereof are omitted here.

Figure 29:
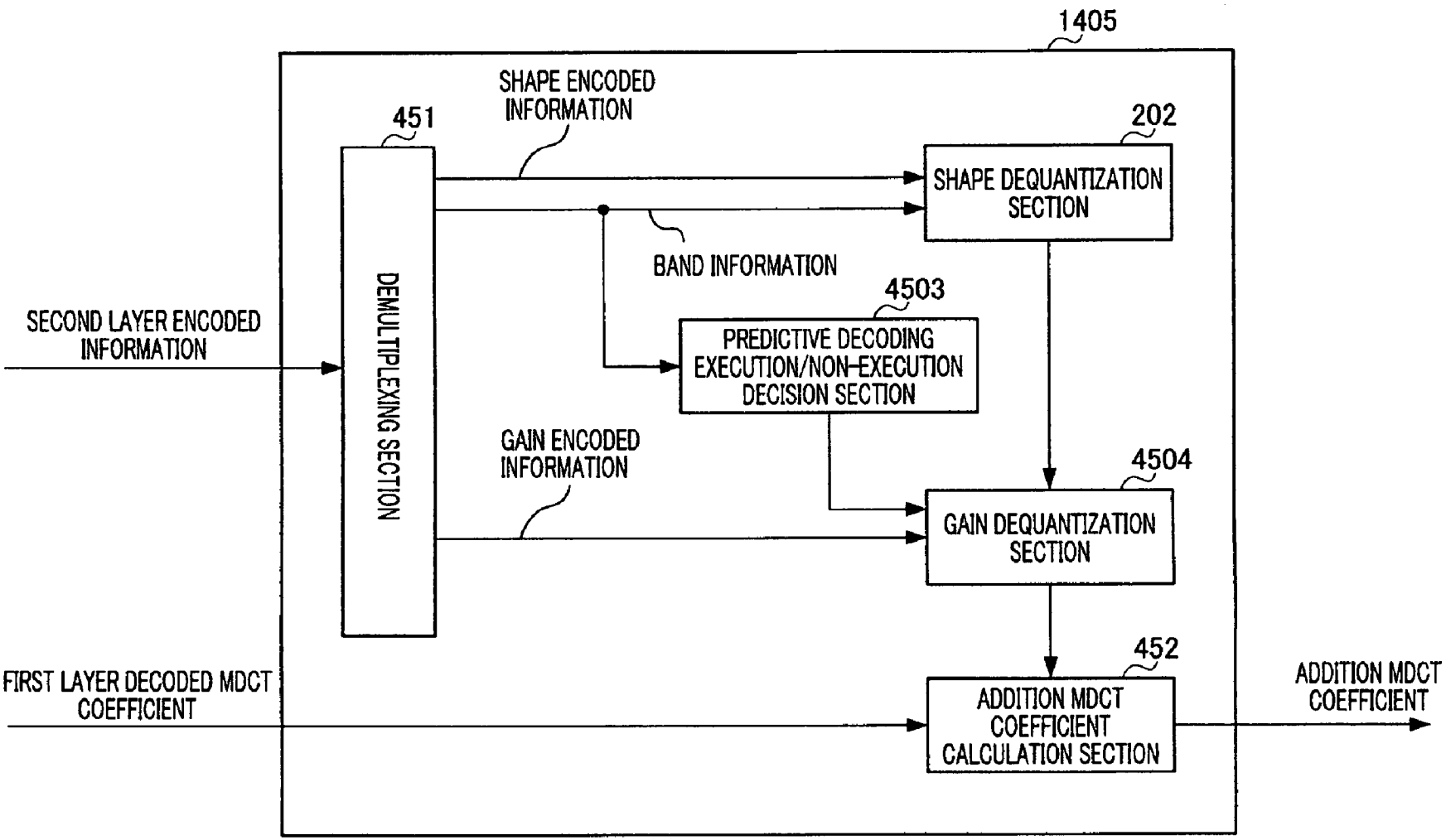
FIG. 29 is a block diagram showing the main configuration of the interior of a second layer decoding section according to Embodiment 7 of the present invention.

FIG. 29 is a block diagram showing the main configuration of the interior of second layer decoding section 1405. Second layer decoding section 1405 mainly comprises demultiplexing section 451, shape dequantization section 202, predictive decoding execution/non-execution decision section 4503, gain dequantization section 4504, and addition MDCT coefficient calculation section 452. With the exception of predictive decoding execution/non-execution decision section 4503 and gain dequantization section 4504, configuration elements in second layer decoding section 1405 shown in FIG. 29 are identical to the configuration elements of second layer decoding section 405 shown in FIG. 9, and therefore identical configuration elements are assigned the same reference codes and descriptions thereof are omitted here.

Predictive decoding execution/non-execution decision section 4503 has an internal buffer that stores band information m_max input from demultiplexing section 451 in a past frame. Here, a case will be described by way of example in which predictive decoding execution/non-execution decision section 4503 has an internal buffer that stores band information m_max for the past three frames. Predictive decoding execution/non-execution decision section 4503 first detects a subband common to a past-frame quantization target band and current-frame quantization target band using band information m_max input from demultiplexing section 451 in a past frame and band information m_max input from demultiplexing section 451 in the current frame. Of L subbands indicated by band information m_max input from demultiplexing section 451, predictive decoding execution/non-execution decision section 4503 determines that predictive decoding is to be applied, and sets Pred_Flag(j)=ON, for a subband selected as a quantization target one frame back in time. On the other hand, of L subbands indicated by band information m_max input from demultiplexing section 451, predictive decoding execution/non-execution decision section 4503 determines that predictive decoding is not to be applied, and sets Pred_Flag(j)=OFF, for a subband not selected as a quantization target one frame back in time. Here, Pred_Flag is a flag indicating a predictive decoding application/non-application determination result for each subband, with an ON value meaning that predictive decoding is to be applied to a subband gain value, and an OFF value meaning that predictive decoding is not to be applied to a subband gain value. Next, predictive decoding execution/non-execution decision section 4503 outputs a determination result for each subband to gain dequantization section 4504. Then predictive decoding execution/non-execution decision section 4503 updates the internal buffer storing band information using band information m_max input from demultiplexing section 451 in the current frame.

Gain dequantization section 4504 has an internal buffer that stores a gain value obtained in a past frame, and switches between execution/non-execution of application of predictive decoding in current-frame gain value decoding according to a determination result input from predictive decoding execution/non-execution decision section 4503. Gain dequantization section 4504 has the same kind of internal gain codebook as gain quantization section 105 of speech encoding apparatus 100, and when performing predictive decoding, for example, obtains gain value Gain_q' by performing gain dequantization in accordance with Equation (43) below. Here, $C''^t_j$ indicates a gain value of t frames before in time, so that when t=1, for example, $C''^t_j$ indicates a gain value of one frame before. Also, α is a 4th-order linear prediction coefficient stored in gain dequantization section 4504. Gain dequantization section 4504 treats L subbands within one region as an L-dimensional vector, and performs vector dequantization. In Equation (43), a Gain_q'(j') value is calculated with gain code vector $GC^{G_min_k}$ element index k and j' satisfying j'∈Region(m_max) respectively associated in ascending order.

$$\text{Gain_q}'(j') = \begin{cases} (\text{if(Pred_Flag}(j') == \text{ON})) \\ \sum_{t=1}^{3} (\alpha_t \cdot C''^t_j) + \alpha_0 \cdot GC_k^{G_min} \\ (\text{if(Pred_Flag}(j') == \text{OFF})) \\ GC_k^{G_min} \end{cases} \begin{pmatrix} j' \in \text{Region(m_max)} \\ k = 0, \ldots, L-1 \end{pmatrix} \quad \text{(Equation 43)}$$

Next, gain dequantization section 4504 calculates a decoded MDCT coefficient in accordance with Equation (44) below using a gain value obtained by current-frame dequantization and a shape value input from shape dequantization section 202, and updates the internal buffer in accordance with Equation (45) below. In Equation (45), a $C''^1_{j'}$ value is updated with j of dequantized gain value Gain_q'(j) and j' satisfying j'∈Region(m_max) respectively associated in ascending order. Here, a calculated decoded MDCT coefficient is denoted by $X''_k$. Also, in MDCT coefficient dequantization, if k is present within B(j') through B(j'+1)−1, the gain value takes the value of Gain_q'(j').

$$X''_k = \text{Gain_q}'(j') \cdot \text{Shape_q}'(k) \begin{pmatrix} k = B(j'), \ldots, B(j'+L)-1 \\ j' \in \text{Region(m_max)} \end{pmatrix} \quad \text{(Equation 44)}$$

$$\begin{cases} C''^3_{j'} = C''^2_{j'} \\ C''^2_{j'} = C''^1_{j'} \\ C''^1_{j'} = \text{Gain_q}'(j) \end{cases} \begin{pmatrix} j' \in \text{Region(m_max)} \\ j = 0, \ldots, L-1 \end{pmatrix} \quad \text{(Equation 45)}$$

Gain dequantization section 4504 outputs decoded MDCT coefficient $X''_k$ calculated in accordance with Equation (44) above to addition MDCT coefficient calculation section 452.

Thus, according to this embodiment, at the time of gain quantization of a quantization target band selected in each frame, whether or not each subband included in a quantization target band was quantized in a past frame is detected. Then vector quantization is performed, with predictive encoding being applied to a subband quantized in a past frame, and with predictive encoding not being applied to a subband not quantized in a past frame. By this means, frequency domain parameter encoding can be carried out more efficiently than with a method whereby predictive encoding application/non-application switching is performed for an entire vector.

In this embodiment, a method has been described whereby switching is performed between application and non-application of predictive encoding in a gain quantization section according to the number of subbands common to a quantization target band selected in the current frame and a quantization target band selected one frame back in time, but the present invention is not limited to this, and a number of subbands common to a quantization target band selected in the current frame and a quantization target band selected two or more frames back in time may also be used. In this case, even if the number of subbands common to a quantization target band selected in the current frame and a quantization target band selected one frame back in time is less than or equal to a predetermined value, predictive encoding may be applied in a gain quantization section according to the number of subbands common to a quantization target band selected in the current frame and a quantization target band selected two or more frames back in time.

It is also possible for the quantization method described in this embodiment to be combined with the quantization target band selection method described in Embodiment 6. A case will be described in which, for example, a region that is a quantization target band is composed of a low-band-side subband group and a high-band-side subband group, the high-band-side subband group is fixed throughout all frames, and a vector in which low-band-side subband group gain and high-band-side subband group are made consecutive is quantized. In this case, within a quantization target band gain vector, vector quantization is performed with predictive encoding always being applied for an element indicating high-band-side subband group gain, and predictive encoding not being applied for an element indicating low-band-side subband group gain. By this means, gain vector quantization can be carried out more efficiently than when predictive encoding application/non-application switching is performed for an entire vector. At this time, in low-band-side subband group, a method whereby vector quantization is performed with predictive encoding being applied to a subband quantized in a past frame, and with predictive encoding not being applied to a subband not quantized in a past frame, is also efficient. Also, for an element indicating low-band-side subband group gain, quantization is performed by switching between application and non-application of predictive encoding using subbands composing a quantization target band selected in a past frame in time, as described in Embodiment 1. By this means, gain vector quantization can be performed still more efficiently. It is also possible for the present invention to be applied to a configuration that combines above-described configurations.

This concludes a description of embodiments of the present invention.

In the above embodiments, cases have been described by way of example in which the method of selecting a quantization target band is to select the region with the highest energy in all bands, but the present invention is not limited to this, and a certain band may also be preliminarily selected beforehand, after which a quantization target band is finally selected in the preliminarily selected band. In such a case, a preliminarily selected band may be decided according to the input signal sampling rate, coding bit rate, or the like. For example, one method is to select a low band preliminarily when the sampling rate is low.

In the above embodiments, MDCT is used as a transform encoding method, and therefore "MDCT coefficient" used in the above embodiments essentially means "spectrum". Therefore, the expression "MDCT coefficient" may be replaced by "spectrum".

In the above embodiments, examples have been shown in which speech decoding apparatuses 200, 200*a*, 400, 600, 800, 1010, 1200, and 1400 receive as input and process encoded data transmitted from speech encoding apparatuses 100, 100*a*, 300, 500, 700, 1000, 1100, and 1300, respectively, but encoded data output by an encoding apparatus of a different configuration capable of generating encoded data having a similar configuration may also be input and processed.

An encoding apparatus, decoding apparatus, and method thereof according to the present invention are not limited to the above-described embodiments, and various variations and modifications may be possible without departing from the scope of the present invention. For example, it is possible for embodiments to be implemented by being combined appropriately.

It is possible for an encoding apparatus and decoding apparatus according to the present invention to be installed in a communication terminal apparatus and base station apparatus in a mobile communication system, thereby enabling a communication terminal apparatus, base station apparatus, and mobile communication system that have the same kind of operational effects as described above to be provided.

A case has here been described by way of example in which the present invention is configured as hardware, but it is also possible for the present invention to be implemented by software. For example, the same kind of functions as those of an encoding apparatus and decoding apparatus according to the present invention can be realized by writing an algorithm of an encoding method and decoding method according to the present invention in a programming language, storing this program in memory, and having it executed by an information processing means.

The function blocks used in the descriptions of the above embodiments are typically implemented as LSIs, which are integrated circuits. These may be implemented individually as single chips, or a single chip may incorporate some or all of them.

Here, the term LSI has been used, but the terms IC, system LSI, super LSI, ultra LSI, and so forth may also be used according to differences in the degree of integration.

The method of implementing integrated circuitry is not limited to LSI, and implementation by means of dedicated circuitry or a general-purpose processor may also be used. An FPGA (Field Programmable Gate Array) for which programming is possible after LSI fabrication, or a reconfigurable processor allowing reconfiguration of circuit cell connections and settings within an LSI, may also be used.

In the event of the introduction of an integrated circuit implementation technology whereby LSI is replaced by a different technology as an advance in, or derivation from, semiconductor technology, integration of the function blocks may of course be performed using that technology. The application of biotechnology or the like is also a possibility.

The disclosures of Japanese Patent Application No. 2006-336270, filed on Dec. 13, 2006, Japanese Patent Application No. 2007-053499, filed on Mar. 2, 2007, Japanese Patent Application No. 2007-132078, filed on May 17, 2007, and Japanese Patent Application No. 2007-185078, filed on Jul. 13, 2007, including the specifications, drawings and abstracts, are incorporated herein by reference in their entirety.

INDUSTRIAL APPLICABILITY

An encoding apparatus and so forth according to the present invention is suitable for use in a communication terminal apparatus, base station apparatus, or the like, in a mobile communication system.

The invention claimed is:

1. An encoding apparatus, comprising:

a transformer that transforms an input signal to a frequency domain to obtain a frequency domain parameter;

a selector that selects a quantization target band from among a plurality of subbands obtained by dividing the frequency domain, and generates band information indicating the quantization target band;

a shape quantizer that quantizes a shape of the frequency domain parameter in the quantization target band;

a gain quantizer that encodes a gain of a frequency domain parameter in the quantization target band to obtain gain encoded information; and a determiner that determines whether predictive encoding is to be performed based on a number of subbands common to the quantization target band and a quantization target band selected in a past, wherein the gain quantizer encodes the gain of the frequency domain parameter in accordance with a determination result of the determiner.

2. The encoding apparatus according to claim 1, wherein the determiner determines that the predictive encoding is to be performed when the number of subbands common to the quantization target band and the quantization target band selected in the past is at least equal to a predetermined value, and determines that the predictive encoding is not to be performed when the number of subbands is less than the predetermined value, and wherein the gain quantizer obtains the gain encoded information by performing the predictive encoding on the gain of a frequency domain parameter in the quantization target band using past gain encoded information when the determiner determines that the predictive encoding is to be performed, and obtains the gain encoded information by non-predictive encoding the gain of a frequency domain parameter in the quantization target band when the determiner determines that the predictive encoding is not to be performed.

3. The encoding apparatus according to claim 1, wherein the gain quantizer obtains the gain encoded information by performing a vector quantization of the gain of the frequency domain parameter.

4. The encoding apparatus according to claim 1, wherein the gain quantizer obtains the gain encoded information by performing a predictive quantizing of the gain using a gain of a frequency domain parameter in a past frame.

5. The encoding apparatus according to claim 1, wherein the selector selects a region for which energy is highest among regions composed of a plurality of subbands as the quantization target band.

6. The encoding apparatus according to claim 1, wherein the selector, when candidate bands exist for which the number of subbands common to the quantization target band and the quantization target band selected in the past is at least equal to a predetermined value and energy is at least equal to a predetermined value, selects a band for which energy is highest among the candidate bands as the quantization target band, and when the candidate bands do not exist, selects a band for which energy is highest in all bands of the frequency domain as the quantization target band.

7. The encoding apparatus according to claim 1, wherein the selector selects a band closest to a quantization target band selected in the past among bands for which energy is at least equal to a predetermined value as the quantization target band.

8. The encoding apparatus according to claim 1, wherein the selector selects the quantization target band after multiplication by a weight that is larger the more toward a low-band side a subband is.

9. The encoding apparatus according to claim 1, wherein the selector selects a low-band-side fixed subband as the quantization target band.

10. The encoding apparatus according to claim 1, wherein the selector selects the quantization target band after multiplication by a weight that is larger the higher the frequency of selection in the past of a subband is.

11. The encoding apparatus according to claim 1, further comprising:

an interpolator that performs interpolation on a gain of a frequency domain parameter in a subband not quantized in the past among subbands indicated by the band information using past gain encoded information, to obtain an interpolation value, wherein the gain quantizer also uses the interpolation value when performing the predictive encoding.

12. The encoding apparatus according to claim 1, further comprising:

a decider that decides a prediction coefficient such that a weight of a gain value of a past frame is larger the larger a subband common to a quantization target band of a past frame and a quantization target band of a current frame is, wherein the gain quantizer uses the prediction coefficient when performing the predictive encoding.

13. The encoding apparatus according to claim 1, wherein the selector fixedly selects a predetermined subband as part of the quantization target band.

14. The encoding apparatus according to claim 1, wherein the selector selects the quantization target band after multiplication by a weight that is larger the more toward a high-band side a subband is in part of the quantization target band.

15. The encoding apparatus according to claim 1, wherein the gain quantizer performs predictive encoding on a gain of a frequency domain parameter in part of the quantization target band, and performs non-predictive encoding on a gain of a frequency domain parameter in a remaining part.

16. The encoding apparatus according to claim 1, wherein the gain quantizer performs a vector quantization of the gain of a nonconsecutive plurality of subbands.

17. A decoding apparatus, comprising:

a receiver that receives information indicating a quantization target band selected from among a plurality of subbands obtained by dividing a frequency domain of an input signal;

a shape dequantizer that decodes shape encoded information in which a shape of a frequency domain parameter in the quantization target band is quantized, to generate a decoded shape;

a gain dequantizer that decodes gain encoded information in which a gain of a frequency domain parameter in the quantization target band is quantized, to generate a decoded gain, and decodes a frequency parameter using the decoded shape and the decoded gain to generate a decoded frequency domain parameter;

a time domain transformer that transforms the decoded frequency domain parameter to the time domain and obtains a time domain decoded signal; and a determiner that determines whether a predictive decoding is to be performed based on a number of subbands common to the quantization target band and a quantization target band selected in a past, wherein the gain dequantizer decodes the gain encoded information in accordance with a determination result of the determiner to generate the decoded gain.

18. The decoding apparatus according to claim 17, wherein the determiner determines that the predictive decoding is to be performed when the number of subbands common to the quantization target band and the quantization target band selected in the past is at least equal to a predetermined value, and determines that the predictive decoding is not to be performed when the number of subbands is less than the predetermined value, and wherein the gain dequantizer performs the predictive decoding of the gain of the frequency domain parameter in the quantization target band using a gain obtained in a past gain decoding when the determiner determines that the predictive decoding is to be performed, and performs a direct dequantization of gain encoded information in which the gain of the frequency domain parameter is quantized in the quantization target band when the determiner determines that the predictive decoding is not to be performed.

19. An encoding method, comprising:

transforming an input signal to a frequency domain to obtain a frequency domain parameter;

selecting a quantization target band from among a plurality of subbands obtained by dividing the frequency domain, and generating band information indicating the quantization target band;

quantizing a shape of the frequency domain parameter in the quantization target band to obtain shape encoded information;

encoding a gain of a frequency domain parameter in the quantization target band to obtain gain encoded information; and determining whether predictive encoding is to be performed based on a number of subbands common to the quantization target band and a quantization target band selected in a past, wherein the gain of the frequency domain parameter is encoded in accordance with a determination result of the determining.

20. A decoding method, comprising:

receiving information indicating a quantization target band selected from among a plurality of subbands obtained by dividing a frequency domain of an input signal;

decoding shape encoded information in which the shape of a frequency domain parameter in the quantization target band is quantized, to generate a decoded shape;

decoding gain encoded information in which a gain of a frequency domain parameter in the quantization target band is quantized, to generate decoded gain, and decoding a frequency domain parameter using the decoded shape and the decoded gain to generate a decoded frequency domain parameter;

transforming the decoded frequency domain parameter to a time domain to obtain a time domain decoded signal; and determining whether predictive decoding is to be performed based on a number of subbands common to the quantization target band and a quantization target band selected in a past, wherein the gain encoded information is decoded in accordance with a determination result of the determining to generate the decoded gain.

* * * * *

UNITED STATES PATENT AND TRADEMARK OFFICE

CERTIFICATE OF CORRECTION

PATENT NO. : 8,352,258 B2
APPLICATION NO. : 12/517956
DATED : January 8, 2013
INVENTOR(S) : T. Yamanashi et al.

It is certified that error appears in the above-identified patent and that said Letters Patent is hereby corrected as shown below:

On Title Page 2, References Cited (56), Other Publications, Column 1, line 22, "EP 0512" should be --EP 07 85 0512--.

Signed and Sealed this
Twenty-third Day of April, 2013

Teresa Stanek Rea
*Acting Director of the United States Patent and Trademark Office*